US010743721B2

(12) United States Patent
Wertheim

(10) Patent No.: US 10,743,721 B2
(45) Date of Patent: Aug. 18, 2020

(54) TAMPER-RESISTANT DEVICES AND SYSTEMS FOR WALL-MOUNTED DISPENSERS

(71) Applicant: ARCHER MANUFACTURING INC., Murrieta, CA (US)

(72) Inventor: Mark Wertheim, Murrieta, CA (US)

(73) Assignee: Archer Manufacturing, Inc., Murrieta, CA (US)

( * ) Notice: Subject to any disclaimer, the term of this patent is extended or adjusted under 35 U.S.C. 154(b) by 0 days.

(21) Appl. No.: 16/688,911

(22) Filed: Nov. 19, 2019

(65) Prior Publication Data

US 2020/0085244 A1 Mar. 19, 2020

Related U.S. Application Data

(63) Continuation-in-part of application No. 16/413,452, filed on May 15, 2019, which is a continuation-in-part of application No. 16/159,505, filed on Oct. 12, 2018, now Pat. No. 10,610,061, which is a continuation of application No. 15/394,800, filed on Dec. 29, 2016, (Continued)

(51) Int. Cl.

| | |
|---|---|
| ***A47K 5/14*** | (2006.01) |
| ***A47K 5/12*** | (2006.01) |
| ***B05B 11/00*** | (2006.01) |

(52) U.S. Cl.

CPC ..... *A47K 5/1211* (2013.01); *A47K 5/12* (2013.01); *A47K 5/1202* (2013.01); *B05B 11/0097* (2013.01); *B05B 11/3052* (2013.01); *A47K 5/14* (2013.01); *B05B 11/00412* (2018.08)

(58) Field of Classification Search

CPC ..... B05B 11/0037; B05B 11/0043; B05B 11/0097; B05B 11/3052; B05B 11/0027; B05B 11/3009; B05B 11/3056; B05B 11/3057; A47K 5/12; A47K 5/1202; A47K 5/1204; A47K 5/1207; A47K 5/1208; A47K 5/1209; A47K 5/1211; A47K 5/06; A47K 5/14

See application file for complete search history.

(56) References Cited

U.S. PATENT DOCUMENTS 1,869,685 A * 8/1932 Gusdorf ..... B65D 35/34 222/96

2,029,701 A 2/1936 Burditt (Continued)

OTHER PUBLICATIONS

USPTO; Notice of Allowance issued in U.S. Appl. No. 16/159,505 dated Jan. 16, 2020.

(Continued)

*Primary Examiner* — Patrick M. Buechner

(74) *Attorney, Agent, or Firm* — Fitch, Even, Tabin & Flannery LLP

(57) ABSTRACT

An accessory device for a wall-mounted dispenser is described. The accessory device may also be attached to the wall and may include a plate having an underside surface shaped to generally match the top edge of the dispenser and a portion of a left side edge and a portion of a right side edge of the dispended so that when the dispenser is mounted to the wall and in a closed position and the rear surface of the plate is generally parallel to and coupled to the wall, the dispenser is able to be opened and closed while tampering to the top edge and portions of the side edges of the dispenser is prevented.

20 Claims, 33 Drawing Sheets

Related U.S. Application Data now Pat. No. 10,123,661, which is a continuation-in-part of application No. 14/092,632, filed on Nov. 27, 2013, now Pat. No. 9,561,517.

(56) References Cited

U.S. PATENT DOCUMENTS

| | | | | |
|---|---|---|---|---|
| 2,833,445 | A | 5/1958 | Spiers | |
| 3,273,752 | A | 9/1966 | Horeczky | |
| 3,450,308 | A * | 6/1969 | Schoenefeld | B65D 5/724 221/305 |
| 3,501,054 | A * | 3/1970 | Maurice | B65D 35/285 222/102 |
| 4,214,676 | A * | 7/1980 | Cassia | A47K 5/1208 222/181.2 |
| 4,391,111 | A | 7/1983 | Marcy | |
| 4,573,612 | A | 3/1986 | Maddison | |
| 4,621,749 | A | 11/1986 | Kanfer | |
| 4,792,064 | A * | 12/1988 | Loesel, Jr. | A47K 5/12 222/181.2 |
| 4,874,113 | A | 10/1989 | Schmidt | |
| 4,931,258 | A | 6/1990 | Zlotnik | |
| 5,174,476 | A | 12/1992 | Steiner | |
| 5,207,355 | A | 5/1993 | Thomsen | |
| 5,265,772 | A | 11/1993 | Bartasevich | |
| 5,379,917 | A | 1/1995 | Brown | |
| 5,443,236 | A | 8/1995 | Bell | |
| 5,464,125 | A | 11/1995 | Daansen | |
| 5,492,247 | A | 2/1996 | Shu | |
| 5,501,372 | A | 3/1996 | Daansen | |
| 5,598,952 | A | 2/1997 | Daansen | |
| 5,632,418 | A | 5/1997 | Brown | |
| 5,791,525 | A | 8/1998 | Fan | |
| 5,992,698 | A | 11/1999 | Copeland | |
| 6,131,773 | A | 10/2000 | Wade | |
| 6,152,330 | A | 11/2000 | Polan | |
| 6,189,740 | B1 | 2/2001 | Wade | |
| 6,216,916 | B1 | 4/2001 | Maddox | |
| 6,404,837 | B1 | 6/2002 | Thompson | |
| 6,619,509 | B2 | 9/2003 | DeKoning | |
| 6,644,516 | B1 | 11/2003 | Foster | |
| 6,668,873 | B1 | 12/2003 | Wertheim | |
| 6,877,642 | B1 | 4/2005 | Maddox | |
| 6,966,463 | B1 | 11/2005 | Yeager | |
| 7,044,328 | B1 | 5/2006 | Ciavarella | |
| 8,020,734 | B1 | 9/2011 | Vandendries | |
| 8,245,881 | B2 | 8/2012 | Ophardt | |
| 8,256,644 | B2 | 9/2012 | Orgna | |
| 8,302,818 | B2 | 11/2012 | Schmidt | |
| 8,505,776 | B2 | 8/2013 | Criswell | |
| 8,528,787 | B2 | 9/2013 | Cittadino | |
| 9,561,517 | B2 | 2/2017 | Wertheim | |
| 9,643,143 | B2 * | 5/2017 | Schultz | B01F 1/0038 |
| 10,123,661 | B2 * | 11/2018 | Wertheim | A47K 5/1202 |
| 10,188,241 | B2 * | 1/2019 | Santoro | A47K 5/1217 |
| 10,242,301 | B2 | 3/2019 | Ophardt | |
| 10,413,133 | B2 | 9/2019 | Schultz | |
| 10,478,020 | B2 * | 11/2019 | Navin | E03C 1/057 |
| 10,610,061 | B2 * | 4/2020 | Wertheim | B05B 11/3052 |
| 2002/0005414 | A1 * | 1/2002 | DeKoning | A47K 5/12 222/181.3 |
| 2002/0074353 | A1 | 6/2002 | Lewis | |
| 2002/0074355 | A1 | 6/2002 | Lewis | |
| 2003/0168471 | A1 | 9/2003 | Redman | |
| 2004/0031816 | A1 | 2/2004 | Schuman | |
| 2004/0251271 | A1 | 12/2004 | Jackson | |
| 2005/0072805 | A1 | 4/2005 | Matthews | |
| 2005/0087563 | A1 | 4/2005 | Ciavarella | |
| 2006/0043114 | A1 | 3/2006 | Jones | |
| 2007/0251953 | A1 | 11/2007 | Criswell | |
| 2009/0212073 | A1 | 8/2009 | Haworth | |
| 2009/0266842 | A1 | 10/2009 | Snodgrass | |
| 2010/0072227 | A1 | 3/2010 | Cittadino | |
| 2011/0011890 | A1 | 1/2011 | Rosenkranz | |
| 2011/0056987 | A1 | 3/2011 | Proper | |
| 2011/0101029 | A1 | 5/2011 | Lewis, II | |
| 2011/0303699 | A1 | 12/2011 | Cittadino | |
| 2012/0111891 | A1 | 5/2012 | McNulty | |
| 2012/0141309 | A1 | 6/2012 | Ciavarella | |
| 2013/0015209 | A1 | 1/2013 | Smith | |
| 2013/0112714 | A1 | 5/2013 | Ho | |
| 2013/0292417 | A1 | 11/2013 | Pelkey | |
| 2014/0231460 | A1 | 8/2014 | Pelkey | |
| 2015/0034677 | A1 | 2/2015 | Duncan | |
| 2015/0144660 | A1 | 5/2015 | Wertheim | |
| 2015/0190827 | A1 | 7/2015 | Ophardt | |
| 2015/0223645 | A1 | 8/2015 | Ray | |
| 2015/0314032 | A1 | 11/2015 | Green | |
| 2016/0051095 | A1 | 2/2016 | Ophardt | |
| 2016/0249623 | A1 | 9/2016 | Warning | |
| 2016/0256015 | A1 | 9/2016 | Ophardt | |
| 2017/0105585 | A1 | 4/2017 | Wertheim | |
| 2017/0119219 | A1 | 5/2017 | Pelfrey | |
| 2017/0203316 | A1 | 7/2017 | Ciavarella | |
| 2017/0337458 | A1 | 11/2017 | Ophardt | |
| 2018/0193859 | A1 | 7/2018 | Yau | |
| 2019/0063980 | A1 | 2/2019 | Kobs | |
| 2020/0055658 | A1 * | 2/2020 | Casper | B01F 15/0445 |

OTHER PUBLICATIONS

Gojo Industries, Inc.; Gojo FMX Security Enclosure; http://gojo.com/united-states/productdisplay.aspx?ProdID={76BA1C56-9DB0-4AF3-9CE1-1443F352C91C}; 1 page; downloaded Feb. 18, 2014.

Norva Plastics; Suicide Prevention Soap Dispenser; http://norvaplastics.com/suicide-prevention-soap-dispenser.asp; 1 page; downloaded Feb. 13, 2014.

USPTO; Non-final Office Action issued in U.S. Appl. No. 14/092,632 dated Apr. 5, 2016.

USPTO; Non-Final Office Action issued in U.S. Appl. No. 15/394,800 dated Mar. 15, 2018.

USPTO; Non-Final Office Action issued in U.S. Appl. No. 16/159,505 dated Oct. 2, 2019.

USPTO; Notice of Allowance issued in U.S. Appl. No. 14/092,632 dated Sep. 22, 2016.

USPTO; Notice of Allowance issued in U.S. Appl. No. 15/394,800 dated Jul. 13, 2018.

USPTO; Restriction Requirement issued in U.S. Appl. No. 14/092,632 dated Nov. 20, 2015.

Vandal Stop Products; SD-Push Front: Technical Data Sheet; http://www.atlasamerican.com/specsheets/SD-PushFront.pdf; 1 page; downloaded Feb. 13, 2014.

Wertheim; U.S. Appl. No. 14/092,632, filed Nov. 27, 2013.

Wertheim; U.S. Appl. No. 15/394,800, filed Dec. 29, 2016.

Wertheim; U.S. Appl. No. 16/159,505, filed Oct. 12, 2018.

Wertheim; U.S. Appl. No. 16/413,452, filed May 15, 2019.

* cited by examiner 100
13
106
114

102
104
112
122
120
124
126
118
108
116
110
13

TAMPER-RESISTANT DEVICES AND SYSTEMS FOR WALL-MOUNTED DISPENSERS

This application is a continuation-in-part of U.S. application Ser. No. 16/413,452, for TAMPER-RESISTANT DEVICES AND SYSTEMS FOR WALL-MOUNTED DISPENSERS, filed May 15, 2019, which is a continuation-in-part of U.S. application Ser. No. 16/159,505, for TAMPER-PROOF AND LIGATION RESISTANT DISPENSER FOR LIQUIDS, filed Oct. 12, 2018, which is a continuation of U.S. application Ser. No. 15/394,800, filed Dec. 29, 2016, for TAMPER-PROOF AND LIGATION RESISTANT DISPENSER FOR LIQUIDS, now U.S. Pat. No. 10,123,661, which is a continuation-in-part of U.S. application Ser. No. 14/092,632, filed Nov. 27, 2013, for TAMPER-PROOF AND LIGATION RESISTANT DISPENSER FOR LIQUIDS, now U.S. Pat. No. 9,561,517, all of which are incorporated in their entirety herein by reference.

BACKGROUND OF THE INVENTION

1. Field of the Invention

The present invention relates generally to wall-mounted dispensers, and more specifically to tamper and ligation resistant wall-mounted dispensers AND.

2. Discussion of the Related Art

There are many wall-mounted dispensers known in the art for dispensing soap, paper towels, or other materials. These dispensers are used in a number of applications, including: dispensers in restrooms, beverage dispensers, liquid dispensers at gas stations, etc. Dispensers are used in self-service types of environments where a product is needed and it is uneconomical or undesirable to have a full-time attendant. In some dispenser embodiments, a user activates the dispenser and an internal mechanism accesses a supply of the product. The product is removed from the internal supply and provided to the user. Since the internal supply is not unlimited, dispensers usually include some type of cover or door that allows an operator to access the internal area of a dispenser, for example for maintenance tasks or restocking of product.

More particularly, there are many "bag-in-box" type wall-mounted dispensers in which the liquid soap or other material is contained in a flexible bag. The dispenser typically includes a vertically disposed base or mounting plate which can be secured to a wall or other vertical surface, and a pivoting cover which is hinged or otherwise attached to the base and is swingable between an open and closed position. When the cover is in an open position, the liquid bag is coupled to the liquid dispensing means. The cover is then closed, securing the liquid bag inside the dispenser.

The liquid dispenser may also include means for securing the cover to the base, for example a locking mechanism including a key, in order to prevent vandalism or tampering.

While wall-mounted dispensers may include intrinsic means for preventing tampering and ligation, in some embodiments it may be desirable to add additional tampering-resistant accessories, such as an apparatus preventing access to the upper portion of the wall-mounted dispenser where the dispenser meets the wall surface for a wall-mounted dispenser that is opened from the top.

SUMMARY OF THE INVENTION

An accessory device for a liquid dispenser is described. The dispenser may be configured to mount to a wall and has a perimeter edge juxtaposed with the wall when the dispenser is mounted to the wall and in a closed position, the perimeter edge including a top edge, a left side edge, a right side edge, and an underside edge, the accessory device comprising: a plate having a thickness and having a front surface and a rear surface wherein the thickness is the distance between the front and rear surfaces, the plate further having an underside surface generally normal to the front surface and rear surface, wherein the underside surface is shaped to generally match the top edge, a portion of the left side edge proximate to the top edge, and a portion of the right side edge proximate to the top edge, wherein when the dispenser is mounted to the wall and in a closed position and the rear surface of the plate is generally parallel to and coupled to the wall, the dispenser is able to be opened and closed while a gap of no more than 2.5 mm (0.1 inches) is maintained between the underside surface and the top edge, and the plate further having an outer surface generally normal to the front surface and the rear surface and excluding the underside surface.

A method of manufacturing a tamper-proof accessory device for a wall mounted liquid dispenser is described. The method may include providing a plate having a thickness and having a front surface and a rear surface wherein the thickness is the distance between the front and rear surfaces, the plate further having an underside surface generally normal to the front surface and rear surface, wherein the underside surface is shaped to generally match the top edge, a portion of the left side edge proximate to the top edge, and a portion of the right side edge proximate to the top edge, wherein when the dispenser is mounted to the wall and in a closed position and the rear surface of the plate is generally parallel to and coupled to the wall, the dispenser is able to be opened and closed while a gap of no more than 2.5 mm (0.1 inches) is maintained between the underside surface and the top edge, and the plate further having an outer surface generally normal to the front surface and the rear surface and excluding the underside surface.

A wall dispenser system for dispensing liquid is described. The wall dispenser system may include a dispenser configured for mounting to a wall, wherein the dispenser has a perimeter edge juxtaposed with the wall when the dispenser is mounted to the wall and in a closed position and the perimeter edge is located at the juxtaposition of the dispenser and the wall, the perimeter edge including a top edge, a left side edge, a right side edge, and an underside edge and an accessory device for a dispenser, comprising a plate having a thickness and having a front surface and a rear surface wherein the thickness is the distance between the front and rear surfaces, the plate further having an underside surface generally normal to the front surface and rear surface, wherein the underside surface is shaped to generally match the top edge, a portion of the left side edge proximate to the top edge, and a portion of the right side edge proximate to the top edge, wherein when the dispenser is mounted to the wall and in the closed position, and the rear surface of the plate is generally parallel to and coupled to the wall, the dispenser is able to be opened and closed while a gap of no more than 2.5 mm (0.1 inches) is provided between the underside surface, the top edge, the portion of the left edge, and the portion of the right edge, and the plate further having an outer surface generally normal to the front surface and the rear surface and excluding the underside surface.

An accessory device system for a wall-mounted dispenser is described. The system may include an accessory device for a dispenser, wherein the dispenser is configured to mount to a wall and has a perimeter edge juxtaposed with the wall when the dispenser is in a closed position and mounted to the wall, the perimeter edge including a top edge, a left side edge, a right side edge, and an underside edge, the accessory device comprising: a plate having a thickness and having a front surface and a rear surface wherein the thickness is the distance between the front and rear surfaces, the plate further having an underside surface generally normal to the front surface and rear surface, wherein the underside surface is shaped to generally match the top edge, a portion of the left side edge proximate to the top edge, and a portion of the right side edge proximate to the top edge, wherein when the dispenser is mounted to the wall and in a closed position and the rear surface of the plate is generally parallel to and coupled to the wall, the dispenser is able to be opened and closed while a gap of no more than 2.5 mm (0.1 inches) is maintained between the underside surface and the top edge, and the plate further having an outer surface generally normal to the front surface and the rear surface and excluding the underside surface and a backing plate, wherein the backing plate is interposed between the dispenser and wall when the dispenser is mounted to the wall, and wherein the backing plate is interposed between the accessory device and the wall when the dispenser is mounted to the wall, and the accessory device is coupled to the backing plate.

A method is described for preventing tampering of a wall-mounted dispenser, wherein the dispenser is configured to mount to a wall and has a perimeter edge juxtaposed with the wall when the dispenser is mounted to the wall and in a closed position, the perimeter edge including a top edge, a left side edge, a right side edge, and an underside edge. The method may include the steps of: coupling an accessory device to a wall, the accessory device comprising a plate having a thickness and having a front surface and a rear surface, wherein the rear surface is of the plate is generally parallel to and coupled to the wall, wherein the thickness is the distance between the front and rear surfaces, the plate further having an underside surface generally normal to the front surface and rear surface, wherein the underside surface is shaped to generally match the top edge, a portion of the left side edge proximate to the top edge, and a portion of the right side edge proximate to the top edge and coupling the wall-mounted dispenser to the wall such that the dispenser is able to be opened and closed while a gap of no more than 2.5 mm (0.1 inches) is maintained between the underside surface and the top edge.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
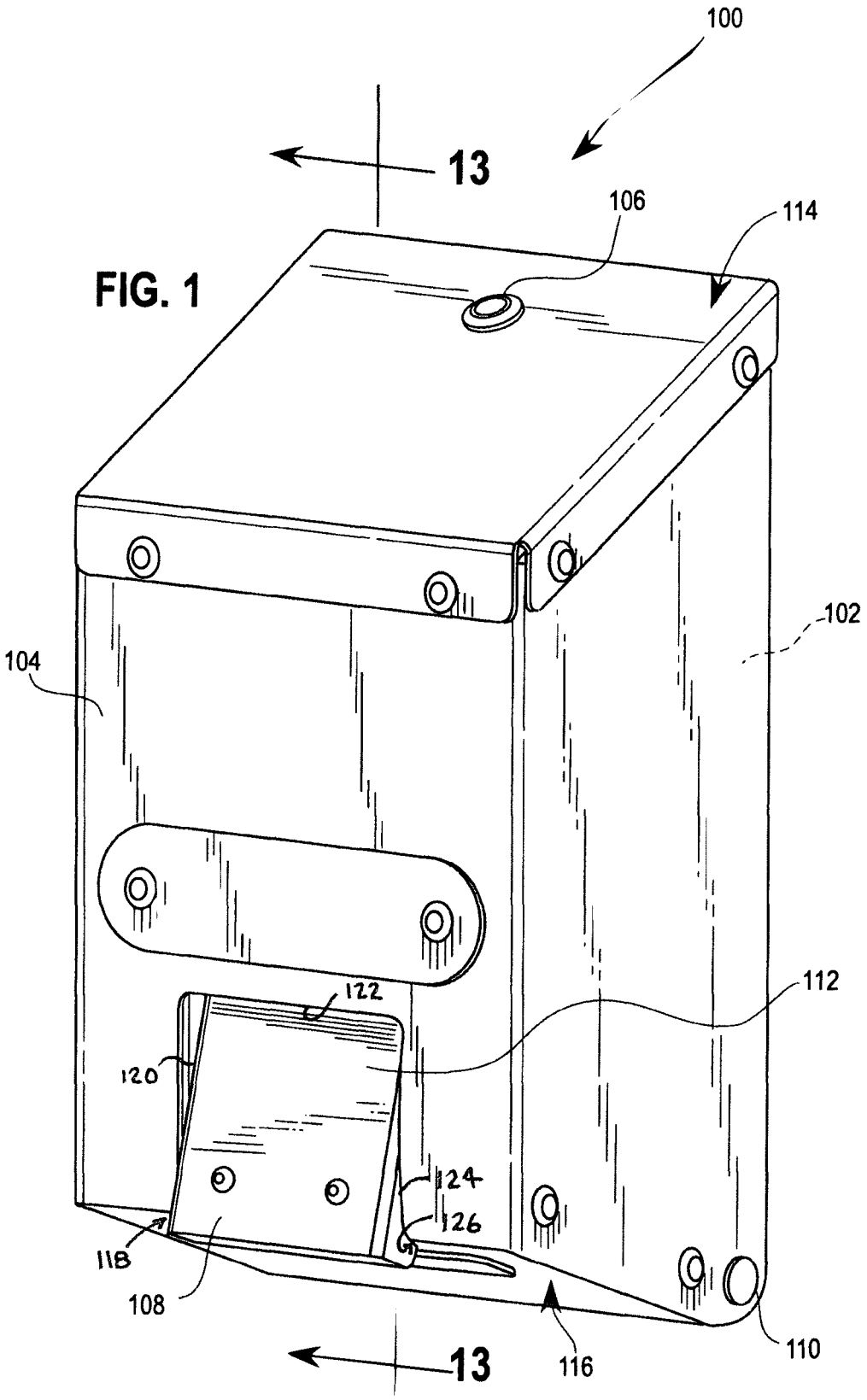
FIG. 1 shows an example of a perspective view of a liquid dispenser in a closed position in accordance with aspects of the present disclosure.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Referring first to FIG. 1, a perspective view of a liquid dispenser 100 in a closed position, in one embodiment of the invention is shown. Shown are the liquid dispenser 100, a back housing 102, a cover 104, a locking mechanism 106, an actuator 108, a pivot bolt 110, a cover opening 112, a liquid dispenser top surface 114, and a liquid dispenser bottom surface 116.

The liquid dispenser 100 includes the back housing 102 and the cover 104 configured to hold and dispense a liquid (not shown). A lower portion of the cover 104 is pivotally coupled to a lower portion of the back housing 102 with two pivot bolts 110, one pivot bolt 110 on each side of the cover 104, so that the cover is automatically rotated downward and away from the back housing 102 when the locking mechanism 106 is in an unlocked configuration, as shown below in FIG. 2.

In the present embodiment, the back housing 102, the cover 104 and the actuator 108 are comprised of stainless steel plates, with thicknesses of approximately 14-16 gauge.

Around the actuator, there are seven gaps, five of which are shown in FIG. 1. First and second gaps 118, 126 are at the left and right corners of the actuator 108 and are less than 1/10 of an inch in width, for example, no more than 0.027 inches width. Third and fourth gaps 120, 124 run along the left and right edges, respectively, of the actuator 108 and are less than 1/10 of an inch in width, for example, no more than 0.040 inches width. A fifth gap 122 is located between the actuator 108 and the top of the cover opening 112. The fifth gap 122 is only present when the actuator 108 is depressed (i.e., there is no gap when the actuator 108 is released), and measures less than three-eighths of an inch in width, for example, no more than 0.248 inches width.

The locking mechanism 106 is coupled to the liquid dispenser top surface 114, and is configured for securing the cover 104 to the back housing 102 when the liquid dispenser 100 is in the closed position shown in FIG. 1. When the locking mechanism 106 is released, the cover 104 is automatically rotated about the pivot bolts 110 so that the liquid dispenser 100 is in an open position (as shown below in FIG. 2).

The cover 104 includes the cover opening 112 located in the lower portion of the cover 104 such that the actuator 108 is received within the cover opening 112 and pivotally hinged to an upper portion of an interior face of the cover 104, as shown in more detail below in FIG. 13. The outward and inward rotation of the actuator 108 is limited by contact of the actuator 108 with the cover 104 when the actuator 108 is rotated in either direction.

Referring again to FIG. 1, the liquid dispenser 100 in the closed position is shown. The liquid dispenser 100 is operated conventionally, with a liquid cartridge 200 (as shown below in FIGS. 12, 14) disposed so that a pump nozzle 1106 is near to or in contact with an interior face of the actuator 108. When the actuator 108 is pushed, the pump 202 is activated, dispensing the liquid through the pump nozzle 1106 and through the cover opening 112 to a user (not shown). The amount of the liquid dispensed is limited by the pump 202 configuration and also by configuring the cover 104 so that the actuator contacts the cover 104 after the pump 202 has been pushed inward a prescribed distance, halting the flow of liquid (as described further below in FIG. 13).

However, conventional liquid dispensers as shown in the prior art are not suitable for installation in a high-security facility, such as a prison, where tampering, vandalism and ligation are concerns. The present invention advantageously includes a number of innovations to increase the structural strength of the liquid dispenser 100 to prevent tampering of and vandalism to the liquid dispenser 100, and prevent ligation caused by securing a ligature in an opening, crevice or gap of the liquid dispenser 100, as described in more detail below. The structural strength of the dispenser 100 is defined as the measure of the ability of the dispenser to resist breakage or deformation when subjected to expected applied forces, for example, the forces applied by a person attempting to pry, fracture, or bend the dispenser 100.

A plurality of plates comprising the liquid dispenser 100 are comprised of stainless steel, providing resistance to vandalism and tampering. Those skilled in the art will note that the design may be modified for use with other suitably structurally strong and corrosion-resistant materials, such as mild steel or aluminum. The dispenser 100 may also be configured to receive paint or a coating, for example a powder coating. In the embodiment shown, the plate edges are generally rounded or smoothed.

The configuration of the liquid dispenser 100 is such that the liquid cartridge 200, which includes a liquid container 204 and the pump 202, is entirely enclosed within a perimeter of the liquid dispenser 100 when the liquid dispenser 100 is in the closed position, reducing the possibility of tampering with or removal of the pump 202 or liquid container 204. The term "ligation gap" is herein defined as a gap between members or portions of the liquid dispenser which is wide enough to wedgingly receive an article available to the person in the high-security facility, for example, a shoelace.

The locking mechanism 106 prevents the liquid cartridge 200 from being opened without an unlocking device (not shown), further preventing tampering, vandalism or possible ligation. The locking mechanism 106 is described further below in FIG. 5.

Liquid dispenser 100 may comprise a dispenser configured for mounting to a wall, wherein the dispenser has a perimeter edge juxtaposed with the wall when the dispenser is mounted to the wall and in a closed position and the perimeter edge is located at the juxtaposition of the dispenser and the wall, the perimeter edge including a top edge, a left side edge, a right side edge, and an underside edge. In some examples, the liquid dispenser 100 is a liquid soap dispenser. However, in some embodiments the dispenser may be a paper towel dispenser.

In some examples, the dispenser is one of a liquid soap dispenser and a paper towel dispenser. Liquid dispenser 100 may couple the wall-mounted dispenser to the wall such that the dispenser is able to be opened and closed while a gap of no more than 2.5 mm (0.1 inches) is maintained between the underside surface and the top edge. Liquid dispenser 100 may be an example of, or include aspects of, the corresponding element or elements described with reference to FIGS. 2, 13, 16, 17, and 20-23.

Figure 2:
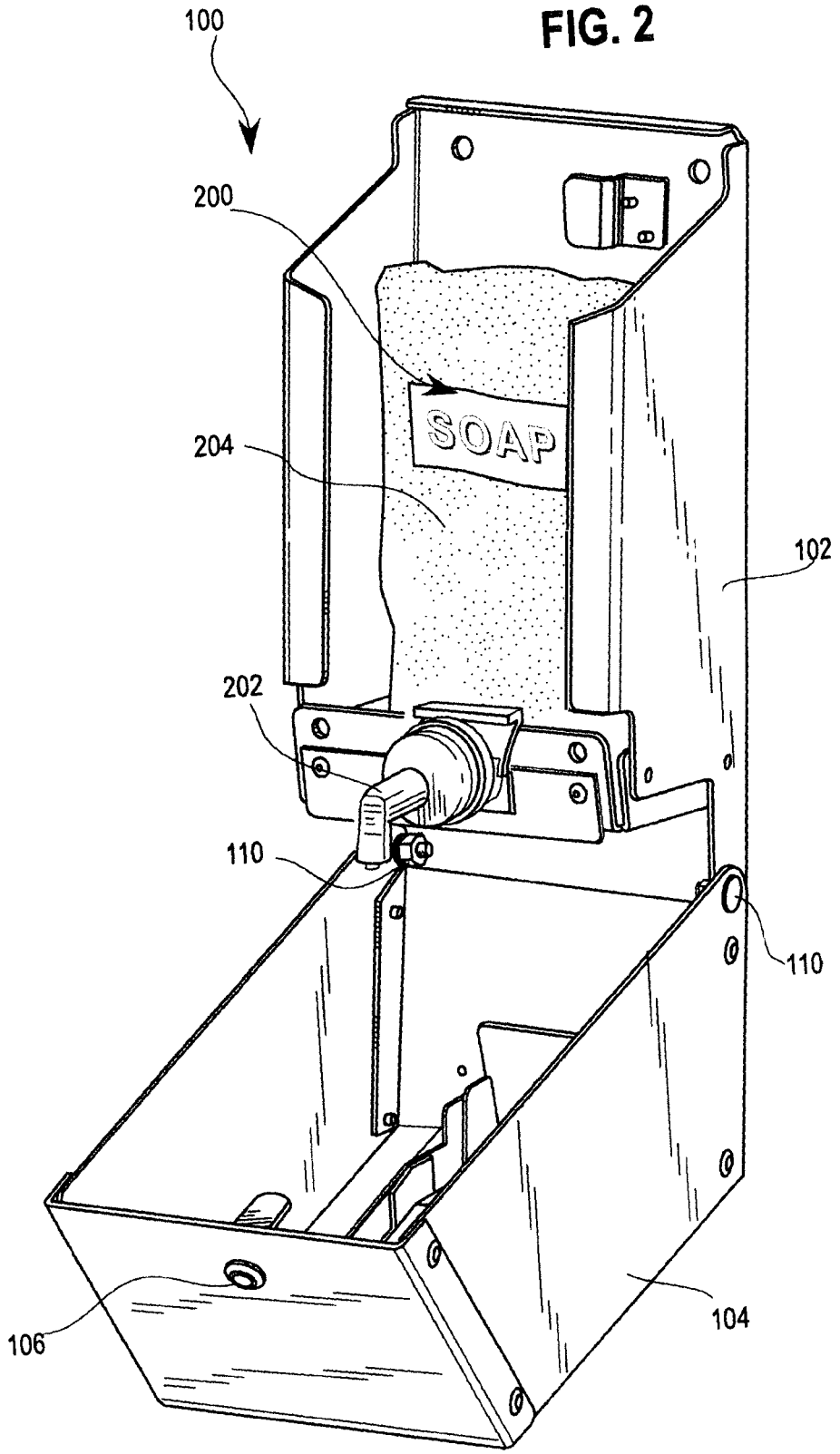
FIG. 2 shows an example of a perspective view of the liquid dispenser in the open position in accordance with aspects of the present disclosure.

Referring next to FIG. 2, a perspective view of the liquid dispenser 100 in the open position is shown. Shown are the liquid dispenser 100, the back housing 102, the cover 104, the locking mechanism 106, the pivot bolt 110, the liquid cartridge 200, the pump 202, and the liquid container 204.

As described previously in FIG. 1, when the locking mechanism 106 is in the unlocked configuration, due to the location of the pivot bolts 110 proximate to a bottom of the liquid dispenser 100, the cover 104 automatically rotates outward and downward when the back housing 102 is coupled to a vertical surface, for example, a wall (not shown).

The liquid cartridge 200 includes the pump 202 and the liquid container 204. The liquid container 204 is in fluid communication with the pump 202 to allow the liquid to flow through the pump 202 when the pump 202 is activated. The liquid cartridge 200 is demountably coupled to the back housing 102 so that the pump 202 is positioned for activation by the actuator 108 when the liquid dispenser 100 is in the closed position. The liquid container 204 is of a size, shape and material suitable for use in the present embodiment of the invention. In the embodiment shown, the liquid container 204 is a bag-type container comprising a thin plastic, for example, PET.

Referring again to FIG. 2, the liquid dispenser 100 is shown in the unlocked configuration, resulting in the open position. The automatic rotation of the cover 104 allows for access to the liquid cartridge 200 for maintenance or replacement. While in the present embodiment the entire liquid cartridge 200 is replaced to prevent cross-contamination of bacteria, those skilled in the art will note that alternate embodiments include the pump demountably coupled to the liquid container 204, so that one may be replaced without replacing the other.

Figure 3:
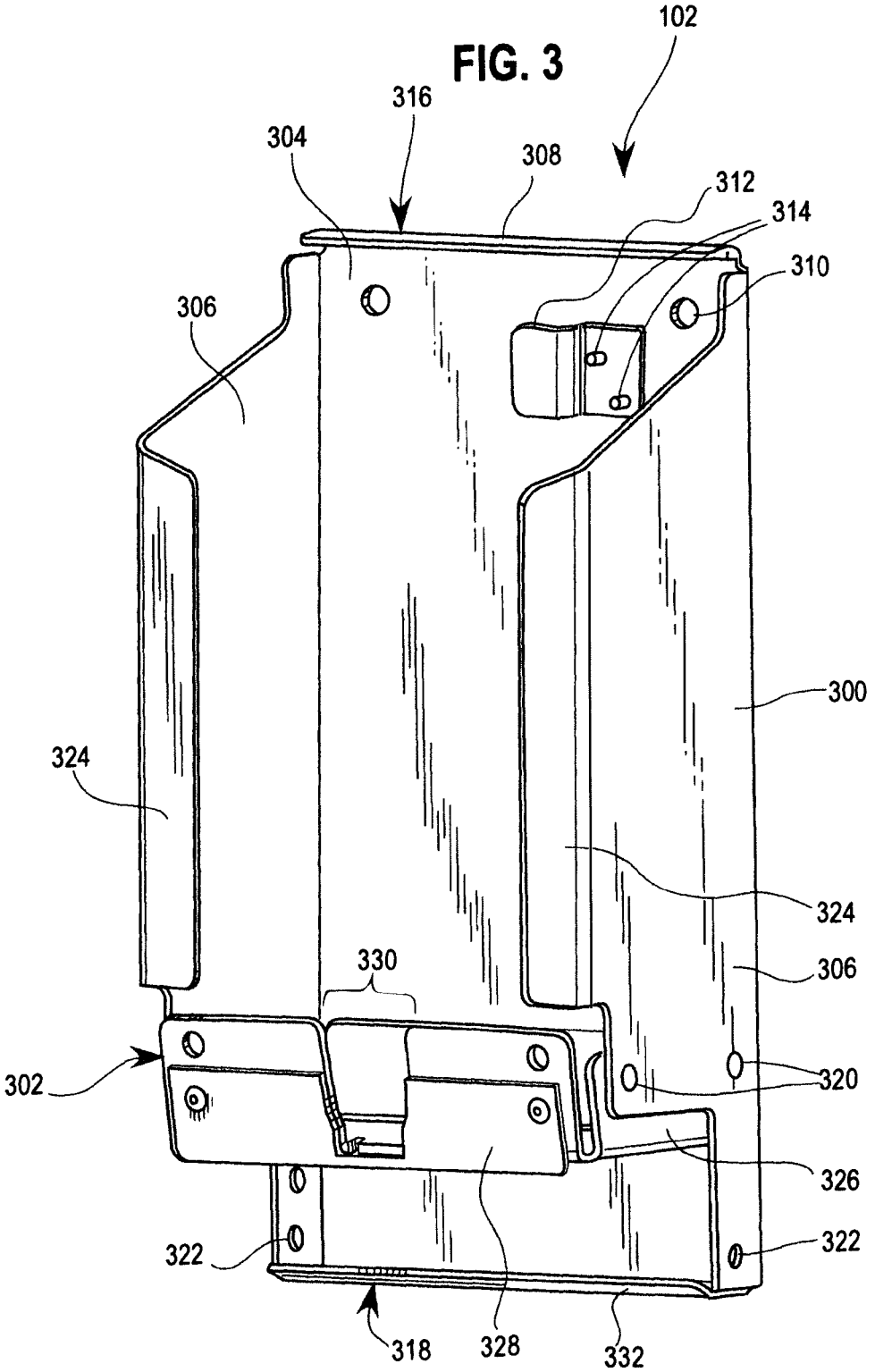
FIG. 3 shows an example of a perspective view of the back housing of the liquid dispenser in accordance with aspects of the present disclosure.

Referring next to FIG. 3, a perspective view of the back housing 102 of the liquid dispenser 100 is shown. Shown are the back housing 102, a back plate 300, a cartridge support assembly 302, a back plate rear wall 304, a plurality of back plate side walls 306, a back plate top flange 308, a plurality of mounting holes 310, a latch plate 312, a plurality of latch plate rivets 314, a back housing top edge 316, a back housing bottom edge 318, a plurality of rivet holes 320, a hinge hole 322, a plurality of back plate front flanges 324, a cartridge support plate side wall 326, a cartridge support plate front wall 328, and a pump cutout 330, and a back plate bottom flange 332

The back housing 102 includes the back plate 300 and the cartridge support assembly 302. The back plate 300 is shaped to form a general vertical channel-shape, with the opening of the channel facing outward and the channel walls generally perpendicular to the channel base. The back plate rear wall 304 corresponds to the base of the channel shape, and the two back plate side walls 306 correspond to the two channel walls.

The back plate rear wall 304 comprises 14-gauge stainless steel, and is generally rectangular-shaped, with the addition of the back plate top flange 308 extending outward from a top edge of the back plate 300 in a generally perpendicular direction, and the back plate bottom flange 332 extending outward from a bottom edge of the back plate 300 in a generally perpendicular direction.

The back plate rear wall 304 includes the plurality of mounting holes 310 used for coupling the liquid dispenser 100 directly to the vertical support. It will be obvious to those skilled in the art that the size and location of the mounting holes 310 are dependent on the type of mounting equipment (for example, screws, drywall anchors or masonry anchors) and type of vertical support structure to be mounted to, for example, wood studs, drywall or concrete masonry units.

The latch plate 312 comprises 14-gauge stainless steel, is coupled to the back plate rear wall 304 and includes a lateral jog. In the present embodiment, one end of the latch plate 312 is coupled to an interior face of the back plate rear wall 304 using at least one hollow latch plate rivet 314. In the present embodiment, two latch plate rivets 314 are used. The latch plate rivets 314 are installed so that the end of a latch plate rivet shaft is generally flush with an exterior face of the back plate rear wall 304. The latch plate 312 is coupled to the back plate rear wall 304 to provide a latch point for the locking mechanism 106 when the liquid dispenser 100 is closed and the locking mechanism 106 is in the locked configuration. It should be noted that while a latching mechanism is shown, alternate methods of securing the cover 104 to the back housing 102 may be used.

The two back plate side walls 306 extend outward in a generally perpendicular direction from the back plate rear wall 304. The back plate side walls 306 include a narrow portion proximate to the back housing top edge 316, then slope steeply outward to approximately 2.75" in width. Proximate to a top extent of the cartridge support assembly 302, the width of each back plate side wall 306 decreases to approximately 2.5". Proximate to a bottom extent of the cartridge support assembly 302 the width of each back plate side wall 306 decreases to about 1.25".

Each back plate side wall 306 includes the hinge hole 322 proximate to the back housing bottom edge 318 for receiving the pivot bolts 110 shown in FIGS. 1, 2. The back plate side walls 306 also include a plurality of rivet holes 320 sized and located for coupling the cartridge support assembly 302 to the back plate 300 using a plurality of rivets 600 (not shown). It should be appreciated that the size, number and location of rivets 600 may vary depending on the type and size of rivets 600 used, the thicknesses of the plates, the spacing of the rivets 600, and other connection variables.

Each back plate side wall 306 includes the integral back plate front flange 324 extending inward perpendicular to the back plate side wall 306 at an edge of the back plate side wall 306 distal to the back plate rear wall 304. The back plate front flange 324 is generally included for a widest segment of the back plate side wall 306.

The cartridge support assembly 302 is formed in a shallow rectangular tray shape. Each cartridge support plate side wall 326 is coupled to the corresponding back plate side wall 306. The cartridge support plate front wall 328 includes a generally u-shaped pump cutout 330. The cartridge support assembly 302 is described further below in FIG. 4.

Referring again to FIG. 3, the back housing 102 is generally configured to provide a structurally strong, mountable base for the pivoting cover 104, be capable of receiving the locking mechanism 106 of the cover 104, and support the liquid cartridge 200 in the position required to dispense the liquid to the user, while ensuring that the liquid cartridge 200 is entirely enclosed by the perimeter of the liquid dispenser 100 when the liquid dispenser 100 is in the closed position.

The shape of the back plate 300, a general vertical channel, provides a holding cavity for the liquid cartridge 200. The back plate side walls 306 prevent the liquid cartridge 200 from coming into contact with the liquid cartridge 200 when the liquid dispenser 100 is closed, and protects the liquid container 204 from puncture. In addition, the back plate side walls 306 increase the structural strength of the back housing 102.

The back plate 300 also includes the back plate bottom flange 332, which advantageously reduces a bottom gap between the back housing bottom edge 318 and a bottom of the cover 104, preventing tampering and a ligation point, as shown further below in FIG. 10.

Similarly, the back plate top flange 308 reduces a top gap between the back housing top edge 316 and a top of the cover, preventing tampering and a ligation point.

The back plate rear wall 304 includes the plurality of mounting holes 310 for securing the liquid dispenser 100 to the vertical support. The liquid dispenser 100 is coupled directly to the vertical support without the use of an intermediate wall mounting bracket, advantageously preventing the possibility of removal of the liquid dispenser 100 as a result of tampering with the intermediate wall mounting bracket.

The latch plate 312 coupled to the back plate rear wall 304 provides a secure latch point for the locking mechanism 106 attached to the cover 104. The use of latch plate rivets 314 to attach the latch plate 312 to the back plate rear wall 304, and providing a latch plate 312 comprised of steel, secures the cover 104 against removal due to bending or detachment of the latch plate 312 from the back plate 300. It should be noted that other latch plate 312 materials, shapes, and methods of coupling may be suitable to provide cover 104 securement to the back plate 300. The latch plate rivets 314 are installed flush with the exterior face of the back plate rear wall 304 so that the liquid dispenser 100 may be mounted flush against the vertical support in order to eliminate a possible pry point.

The back plate side walls 306 are generally shaped to provide the holding cavity, as noted above, and to overlap with an interior face of the front plate side walls 502 to prevent access to the interior of the dispenser 100, and reduce the possibility of ligation, when the dispenser 100 is in the closed position.

The back plate side walls 306 are narrowed proximate to the back housing bottom edge 318 and the back housing top edge 316 to allow the cover 104 to rotate into the closed position. The width of the back plate side walls 306 proximate to the back housing bottom edge 318 are of suitable width for including the hinge hole 322. The back plate side walls 306 also include the back plate front flanges 324 to provide additional restraint for the liquid cartridge 200 coupled to the back housing 102 and rigidity to the back housing 102.

The cartridge support assembly 302 is configured to support the liquid cartridge 200, allow for maintenance and replacement of the liquid cartridge 200, and maintain the pump 202 in the required location and orientation for activation by and dispensing through the actuator 108. The pump cutout 330 is configured for demountable coupling of the pump 202 to the cartridge support assembly 302, and is described further in FIGS. 4, 11.

Figure 4:
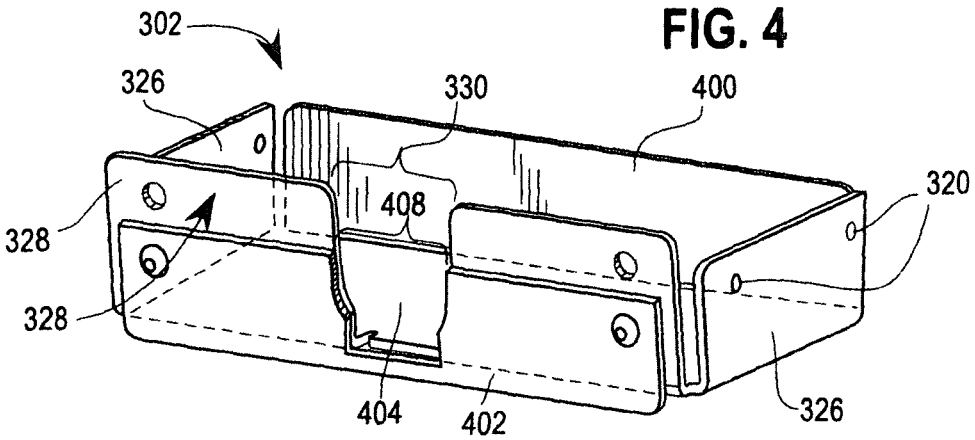
FIG. 4 shows an example of a perspective view of the cartridge support assembly in accordance with aspects of the present disclosure.

Referring next to FIG. 4, a perspective view of the cartridge support assembly 302 in one embodiment of the present invention is shown. Shown are the cartridge support assembly 302, the plurality of rivet holes 320, the plurality of cartridge support plate side walls 326, the cartridge support plate front wall 328, the pump cutout 330, a cartridge support plate 400, a pump shim plate 402, a cartridge support assembly base 404, and a pump shim plate cutout 408.

The cartridge support assembly 302 includes the cartridge support plate 400 and the pump shim plate 402. As shown above, the cartridge support plate 400 is shaped in a generally rectangular shallow tray shape, and is rivetedly coupled to the back plate side walls 306 so that the cartridge support assembly base 404 provides support for the liquid container 204.

The cartridge support plate front wall 328 forms the front side of the rectangular tray shape, and generally aligns with a plane of the back plate front flanges 324. The cartridge support plate front wall 328 includes the generally U-shaped pump cutout 330 extending from a top edge of the cartridge support plate front wall 328 to a bottom edge of the cartridge support plate front wall 328. The pump cutout 330 is configured for demountable coupling of the liquid cartridge 200 in a dispensing position.

In the present embodiment, the cartridge support plate front wall 328 location and angle with respect to the cartridge support assembly base 404 is configured to ensure that the pump 202 is in the correct dispensing position when the liquid dispenser 100 is in the closed position and the liquid dispenser 100 is locked.

The cartridge support assembly 302 includes the pump shim plate 402 rivetedly coupled to the front face of the cartridge support plate front wall 328. The pump shim plate 402 includes the pump shim plate cutout 408 in a shape aligning with the pump cutout 330 when the pump shim plate 402 is coupled to the cartridge support plate 400.

Referring again to FIG. 4, the cartridge support assembly 302 of the back housing 102 is shown. The cartridge support assembly 302 provides demountable coupling of the liquid cartridge 200 to the back housing 102. In the present embodiment, the pump 202 is a type manufactured by Rexam Airspray for use with a liquid container 204. The exemplary pump 202 includes a pump flange 1104 for sliding into the pump cutout 330 for coupling of the pump 202 to the liquid dispenser 100. The pump cutout 330 is configured to wedgingly receive the exemplary pump 202, but those skilled in the art will note that the cartridge support assembly 302 may be modified to accommodate alternate pumps and liquid cartridges. The liquid cartridge 200 is described further below in FIG. 11.

Also due to the configuration of the exemplary pump 202, the pump shim plate 402 is sized and located to provide a shim to the cartridge support plate front wall 328 in order to wedgingly couple the exemplary pump 202 to the cartridge support assembly 302. The pump shim plate 402 is shown riveted to the cartridge support plate 400, but alternate forms of coupling, for example screws or welding, may also be used. The pump shim plate 402 may not be required if alternate means for mounting the pump 202 are used.

The cartridge support assembly base 404 provides support for the liquid container 204 when the liquid dispenser 100 is in either the open or the closed position.

Figure 5:
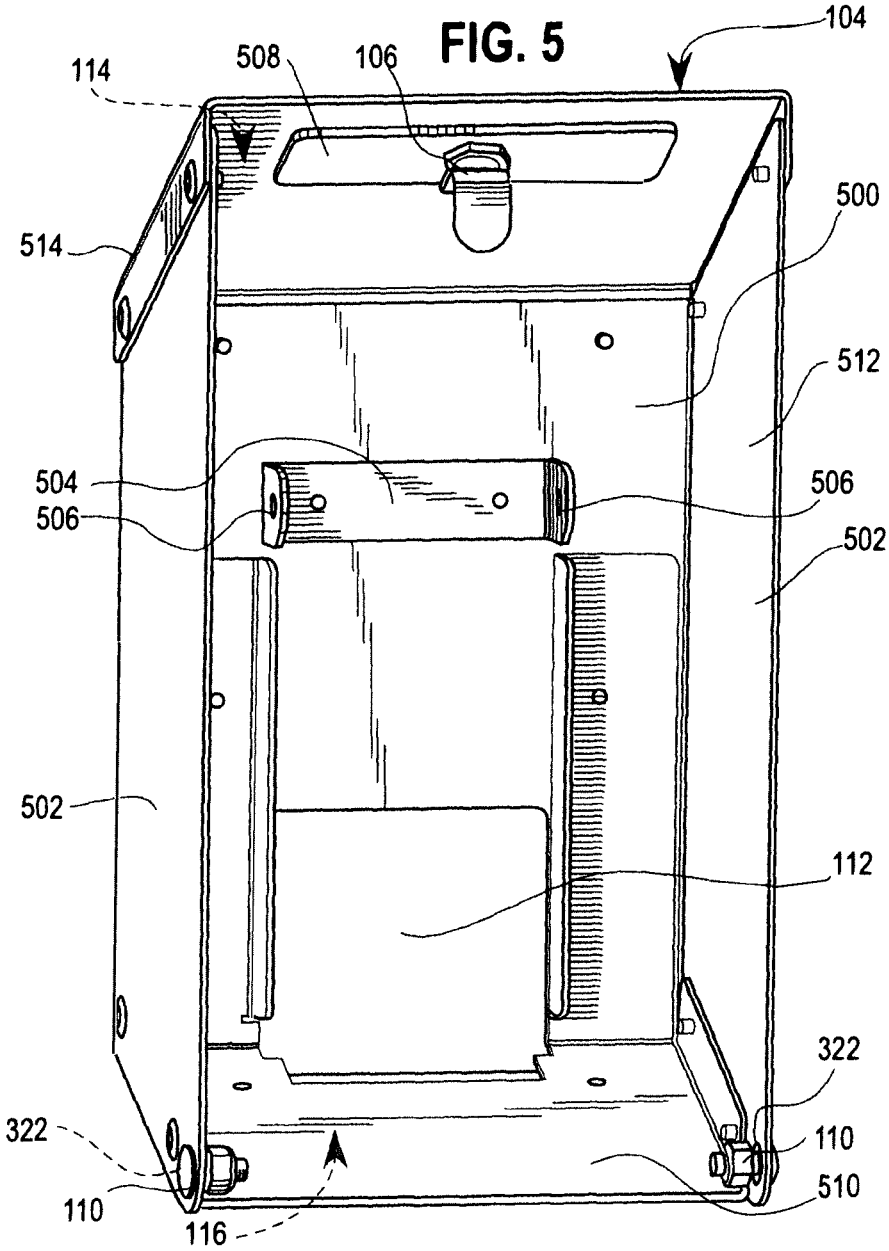
FIG. 5 shows an example of a perspective view of the interior of the cover in accordance with aspects of the present disclosure.

Referring next to FIG. 5, a perspective view of the interior of the cover in one embodiment of the invention is shown. Shown are the cover 104, the locking mechanism 106, the plurality of pivot bolts 110, the opening h112, the liquid dispenser bottom surface 116, the plurality of hinge holes 322, a front plate front wall 500, a plurality of front plate side walls 502, a pivot plate 504, a plurality of actuator pivot holes 506, a lock plate 508, a base plate 510, a front plate 512, and a top plate 514.

The front plate 512 is formed in a general vertical channel shape, where the front plate front wall 500 corresponds to the channel base and the two front plate side walls 502 correspond to the channel sides. Each front plate side wall 502 includes the hinge hole 322 proximate to a bottom rear corner of the front plate side wall 502.

The pivot plate 504 is generally channel-shaped, with the base of the channel coupled to an interior face of the front plate front wall 500 above the cover opening 112, the channel sides each including one actuator pivot hole 506 for pivotally coupling the actuator 108 to the pivot plate 504 using an actuator pivot bolt 1302 (as shown below in FIG. 13). In the present embodiment, the pivot plate 504 is welded to the front plate front wall 500. The front plate front wall 500 includes the cover opening 112 proximate to a bottom of the front plate front wall 500, as described further below in FIG. 6.

The top plate 514 is rivetedly coupled to a top edge of the front plate front wall 500 and a top edge of each front plate side wall 502, and includes the locking mechanism 106 and the lock plate 508. The top plate 514 is described further below in FIG. 7.

The base plate 510 is rivetedly coupled to the front plate front wall 500 above the cover opening 112 and to the front plate side walls 502 proximate to a bottom edge of each front plate side wall 502, and is described further below in FIG. 8.

Referring again to FIG. 5, the cover 104 is shown in one embodiment of the present invention as being comprised of the front plate 512, the top plate 514 and the base plate 510. The coupling of the front plate 512, the top plate 514 and the base plate 510 forms a generally trapezoidal prism shape, with the smaller trapezoidal prism base forming a front of the liquid dispenser 100 and the wider trapezoidal base open to receive the back housing 102 within the trapezoidal prism shape when the liquid dispenser 100 is in the closed position. The trapezoidal prism shape results in sloping of the liquid dispenser top surface 114 and the liquid dispenser bottom surface 116 when the liquid dispenser 100 is in the closed position.

The front plate side walls 502 are configured so that each rear vertical edge of the front plate 512 generally aligns with the exterior face of the back plate rear wall 304 when the liquid dispenser 100 is in the closed position, minimizing a ligation gap between the front plate side walls 502 and the vertical support. Likewise, the top plate 514 is configured so that a rear horizontal edge of the top plate 514 generally aligns with the exterior face of the back plate rear wall 304 when the liquid dispenser 100 is in the closed position. As a result, the possibility of tampering or ligation is prevented when the liquid dispenser 100 is mounted on the vertical support and in the closed position and locked configuration.

Due to the location of the pivot bolts 110 proximate to the liquid dispenser bottom surface 116, the bottom gap must be maintained between the cover 104 and the back housing 102 to allow the cover 104 to pivot relative to the back housing 102. The bottom gap is described further below in FIG. 10.

Figure 6:
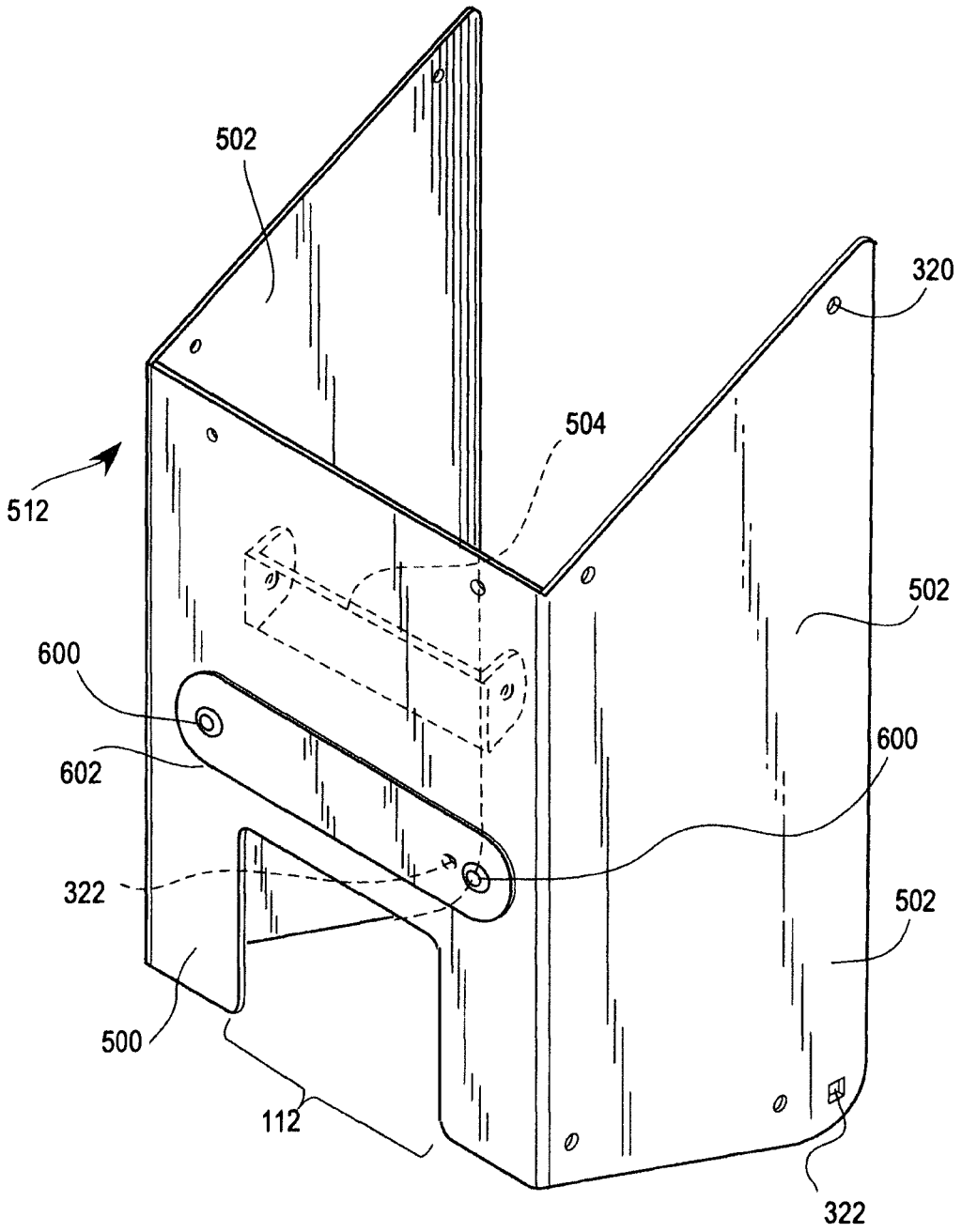
FIG. 6 shows an example of a front plate of the cover in accordance with aspects of the present disclosure.

Referring next to FIG. 6, the front plate 512 of the cover 104 is shown. Shown are the plurality of rivet holes 320, the plurality of hinge holes 322, the front plate front wall 500, the plurality of front plate side walls 502, the pivot plate 504, the front plate 512, the plurality of rivets 600, and a cover reinforcing plate 602.

As described previously in FIG. 5, the front plate 512 is part of the generally trapezoidal prism shape. The front plate 512 includes the plurality of rivet holes 320 for coupling to the top plate 514 and to the base plate 510. The front plate 512 also includes the hinge hole 322 proximate to the bottom rear corner of each front plate side wall 502 for pivotally coupling the cover 104 to the back housing 102.

The front plate front wall 500 includes the generally rectangular cover opening 112 proximate to the bottom of the front plate front wall 500.

The cover reinforcing plate 602 is rivetedly coupled to an exterior face of the front plate front wall 500 above the cover opening 112 using the same rivets 600 as used for coupling the base plate front tabs 802 (as shown below in FIG. 8) to the interior face of the front plate front wall 500.

The pivot plate 504 is coupled to the interior face of the front plate front wall 500, as previously described in FIG. 5.

Referring again to FIG. 6, the front plate 512 of the cover 104 is shown according to one embodiment of the invention. The front plate 512 is shaped to provide minimal gaps between the front plate 512 and the back housing 102, the top plate 514 and the base plate 510 when the liquid dispenser 100 is in the closed position. The liquid dispenser bottom surface 116 and the liquid dispenser top surface 114 are sloped, preventing an item (not shown) from being placed on top of the liquid dispenser 100 when the liquid dispenser 100 is in the closed position.

The cover reinforcing plate 602 provides additional rigidity and structural strength to the front plate front wall 500, preventing deformation and tear-out of the front plate 512 if the actuator 108 is subject to a force causing outward leverage of the actuator 108 against the front plate 512 at the cover opening 112. The cover reinforcing plate 602 also provide additional stiffness and structural strength to the cover 104 where the stiffness and strength has been reduced due to the proximity of the cover opening 112.

Figure 7:
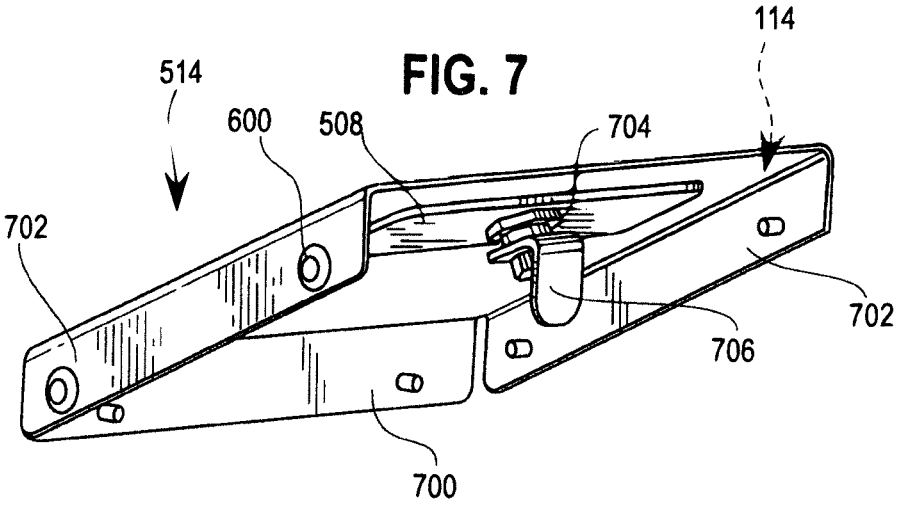
FIG. 7 shows an example of a top plate of the cover in accordance with aspects of the present disclosure.

Referring next to FIG. 7, the top plate 514 of the cover 104 is shown according to one embodiment of the present invention. Shown are the liquid dispenser top surface 114, the lock plate 508, the top plate 514, the plurality of rivets 600, a top plate front flange 700, two top plate side flanges 702, a tubular cam lock 704, and a cam lever 706.

As previously described, the top plate 514 is rivetedly coupled to the front plate 512 to form the sloping top of the liquid dispenser 100. In the present embodiment, the top plate 514 includes three flanges, the top plate front flange 700 aligning generally with the front plate front wall 500 and each top plate side flange 702 aligning generally with one front plate side wall 502. The top plate flanges 700, 702 are oriented downward and riveted to the top edges of the front plate side walls 502 using the plurality of rivets 600. At each front vertical corner of the liquid dispenser 100, the vertical edges of the top plate flanges 700, 702 forming the corner are juxtaposed.

The locking mechanism 106 is coupled to the top plate 514 proximate to a rear edge of the front plate 512 such that a keyhole (not shown) is located on the liquid dispenser top surface 114. In the present embodiment the locking mechanism 106 is the tubular cam lock 704 including the L-shaped cam lever 706. The tubular cam lock 704 is locked and unlocked by a tubular key unlocking device (not shown). The locking mechanism 106 is located and configured so that when the tubular cam lock 704 is in the unlocked position, and the liquid dispenser 100 is in the closed position, locking the tubular cam lock 704 will rotate the cam lever 706 so that it is received by the latch plate 312 (shown in FIG. 2-3) and the cover 104 is secured to the back housing 102.

The lock plate 508 is coupled to an interior face of the top plate 514 by sandwiching it between the shaft of the cam lock 704 and the top plate 514.

Referring again to FIG. 7, the top plate 514 is rivetedly coupled to the top edges of the front plate 512, providing a sloping surface which advantageously prevents an item from being placed on the liquid dispenser top surface 114, as previously shown in FIG. 6.

The top plate flanges 700, 702 are rivetedly coupled to the front plate 512 to prevent removal of or vandalism to the top plate 514. The vertical edges of the top plate flanges 700, 702 are juxtaposed at each front vertical corners of the liquid dispenser 100, preventing tampering with the liquid dispenser 100 by using a gap between the top plate flanges 700, 702 to pry up the top plate flanges 700, 702. The juxtaposition of the vertical edges of the top plate flanges 700, 702 also removes a ligation gap on the liquid dispenser 100, and prevents objects from being inserted through a corner gap into the interior of the dispenser 100 and puncturing the liquid container 204.

The tubular cam lock 704 coupled to the top plate 514 secures the cover 104 to the back housing 102 so that only authorized persons with the corresponding unlocking device (in this embodiment the tubular key unlocking device) may access the interior of the liquid dispenser 100. Those skilled in the art will recognize that locking mechanisms configured for alternate locking devices, such as a combination lock or a cut key lock, may be used.

The lock plate 508 coupled to the interior face of the top plate 514 at the locking mechanism 106 location provides additional structural strength to the top plate 514 to prevent pull-out of the locking mechanism 106 if the cover 104 is tampered with.

Figure 8:
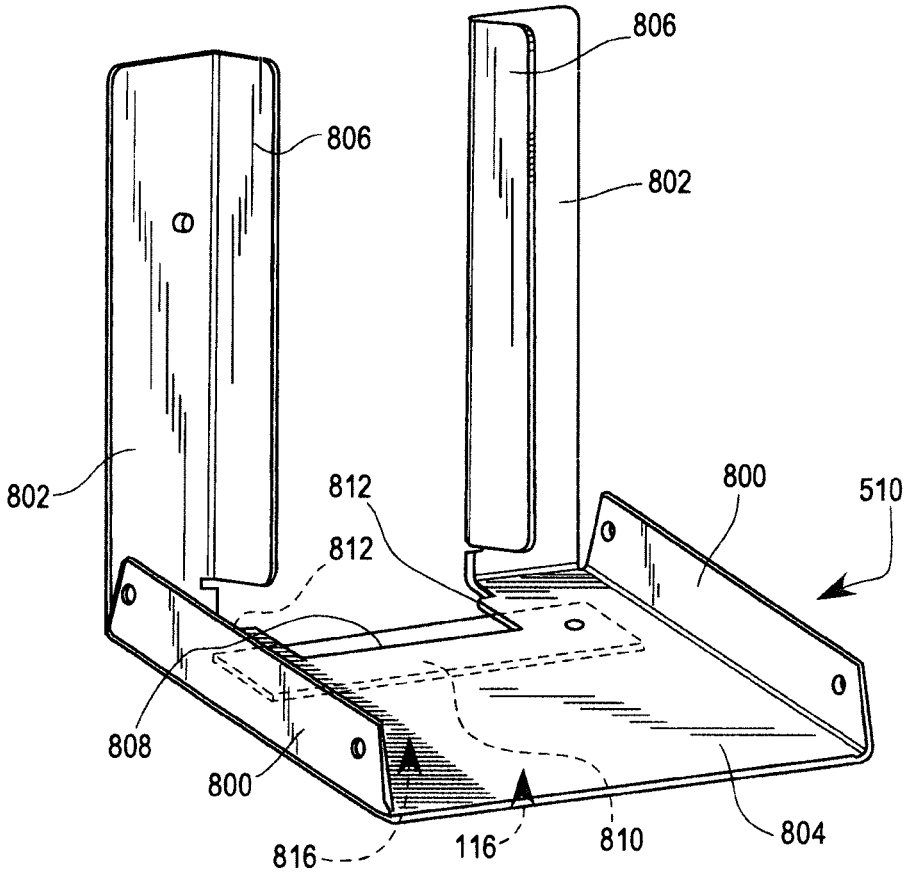
FIG. 8 shows an example of a base plate in accordance with aspects of the present disclosure.

Referring next to FIG. 8, one embodiment of the base plate 510 is shown. Shown are the liquid dispenser bottom surface 116, the base plate 510, a base plate side flange 800, a plurality of base plate front tabs 802, a base plate bottom 804, a plurality of front tab flanges 806, a base plate notch 808, the base reinforcing plate 810, and a plurality of base plate notch shoulders 812.

As previously described in FIG. 5, the base plate 510 is rivetedly coupled to the front plate 512. The base plate bottom 804 includes the base plate side flange 800 located on each side of the liquid dispenser 100, each base plate side flange 800 overlapped with the bottom edge of the corresponding front plate side wall 502 to form two bottom side corners of the liquid dispenser 100. The base plate side flange 800 is configured to overlap with an interior face of the front plate side wall 502. In the present embodiment, the base plate side flanges 800 are coupled to the front plate side walls 502 using the plurality of rivets 600 (not shown). Rear edges of the base plate side flanges 800 are sloped linearly away from the rear of the liquid dispenser 100 to allow the cover 104 to pivot to the closed position without the base plate side flanges 800 contacting the back housing 102.

The base plate 510 includes the base plate front tabs 802 extending upward from a front edge of the base plate bottom 804 at an angle of approximately 20 degrees. Each base plate front tab 802 is configured so that an inner vertical edge of the base plate front tab 802 aligns with the extent of the cover opening 112 when the base plate 510 is coupled to the cover 104. An outer vertical edge of each base plate front tab 802 is configured so that the outer vertical edge of the base plate front tab 802 is adjacent to a proximate front vertical corner of the cover 104 when the base plate 510 is coupled to the front plate 512. Thus, the width of the base plate front tab 802 is generally equal to an interior width of the front plate front wall 500 proximate to the cover opening 112. Each base plate front tab 802 includes a front tab flange 806, extending inward from the inner vertical edge of the base plate front tab 802 (proximate to the cover opening 112), in a generally perpendicular direction. In the present embodiment, the front tab flange 806 extends from a top edge of the base plate front tab 802 downward to a location proximate to the base plate bottom 804.

The base plate 510 includes the base plate notch 808, located in a center front portion of the base plate bottom 804. The base plate notch 808 is stepped inward towards the rear of the base plate bottom 804, such that a front portion of the base plate notch 808 is wider that a rear portion of the base plate notch 808, forming the base plate notch shoulder 812. The extent of the front portion of the base plate notch 808 is configured to align with the cover opening 112 when the front plate 512 is coupled to the base plate 510.

The base reinforcing plate 810 is rivetedly coupled to an exterior face of the base plate bottom 804. The base reinforcing plate 810 is generally rectangular in shape, and oriented to cover a longitudinal rear portion of the base plate notch 808.

Referring again to FIG. 8, the base plate 510 of the cover 104 is shown. The base plate 510 is configured to provide flush bottom corners and to be coupled to at least one interior face of the front plate 512, in order to provide additional structural strength to the cover 104 to discourage and prevent tampering. In addition, the base plate front tabs 802 coupled to the interior face of the front plate front wall 500 proximate to the cover opening 112 provide additional structural strength to the front plate 512 at a comparatively weak area of the front plate 512. The front tab flanges 806 provide even more structural strength to the front plate front wall 500, and also prevent access to the interior of the liquid dispenser 100 when the actuator 108 is rotated inwards, which would otherwise form a ligation gap between the front plate front wall 500 and the actuator 108.

The base plate notch 808 is configured for receiving the actuator 108 in both the at-rest and actuated positions. The base plate notch shoulders 812 halts the rotation of the actuator 108 when the actuator 108 contacts the base plate notch shoulder 812 as the actuator 108 is pushed inward. This prevents damage of the pump 202 due to excessive force on the pump 202 when the actuator 108 is pushed inward.

The base plate notch 808 is also sized to minimize a ligation gap between the actuator 108 and the base plate notch 808 during operation of the liquid dispenser 100, to prevent tampering with the liquid dispenser 100 or ligation using external materials wedged in the gap. In addition, the base reinforcing plate 810 is coupled to the exterior face of the base plate bottom 804, partially overlapping the base plate notch 808. The base reinforcing plate 810 adds structural strength to the base plate 510 at a location weakened by the base plate notch 808, and also minimizes an actuator bottom ligation gap between the actuator 108 and the base plate bottom 804 when the actuator 108 is rotated inward, preventing tampering and ligation.

Figure 9:
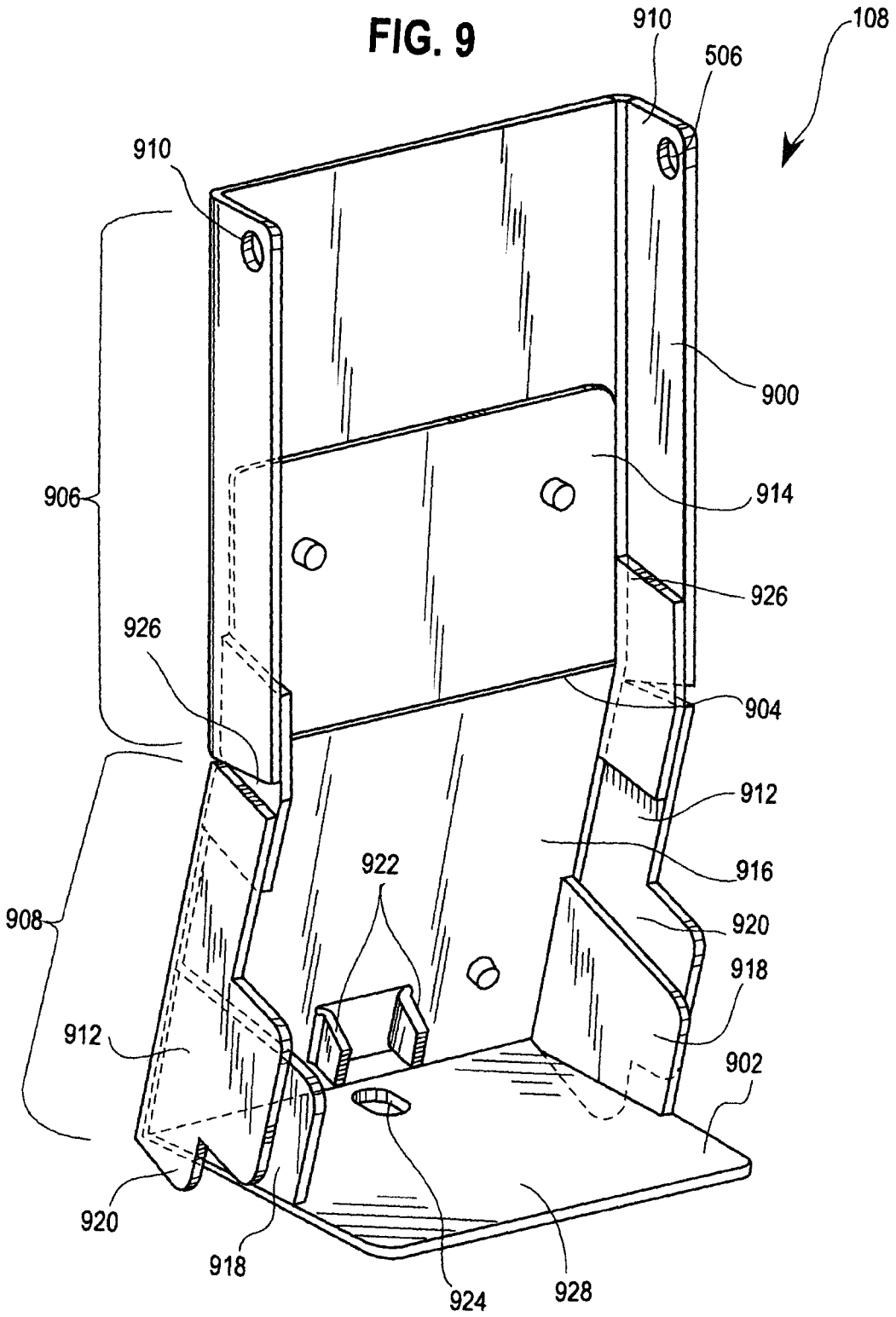
FIG. 9 shows an example of an actuator in accordance with aspects of the present disclosure.

Referring next to FIG. 9, the actuator 108 is shown in one embodiment of the invention. Shown are the actuator 108, the plurality of actuator pivot holes 506, a top actuator plate 900, a pump guide 902, a horizontal bend 904, a top actuator plate top segment 906, a top actuator plate bottom segment 908, a plurality of top segment side flanges 910, a plurality of bottom segment side flanges 912, a pump guide top segment 914, a pump guide middle segment 916, a plurality of pump guide side flanges 918, a plurality of bottom tabs 920, a plurality of guide tabs 922, a dispensing hole 924, and a plurality of gusset plates 926.

As previously shown in FIG. 1, the actuator 108 is pivotally coupled, proximate to a top edge of the actuator 108, to the interior face of the front plate front wall 500 and is partially accessible through the cover opening 112.

The actuator 108 is comprised of two primary members: the top actuator plate 900 and the pump guide 902. An exterior face of the top actuator plate 900 is oriented generally parallel to the front plate front wall 500. The pump guide 902 forms a general L-shape, with a vertical portion of the pump guide 902 rivetedly coupled to the interior face of the top actuator plate 900, and a horizontal portion of the pump guide 902 extending inward towards the rear of the liquid dispenser 100.

The top actuator plate 900 includes the outward horizontal bend 904, of approximately 15 degrees, located proximate to a vertical midpoint of the top actuator plate 900, such that when the actuator 108 is coupled to the cover 104, a bottom portion of the actuator 108 extends outward past a perimeter of the cover 104. The top actuator plate top segment 906 is defined as a portion of the top actuator plate 900 located above the horizontal bend 904, and the top actuator plate bottom segment 908 is defined as a portion of the top actuator plate 900 located below the horizontal bend 904.

The top actuator plate top segment 906 includes the integral top segment side flanges 910 at each vertical edge of the top actuator plate top segment 906. Each top segment side flange 910 extends inward from the top actuator plate top segment 906 in a generally perpendicular direction. Each top segment side flange 910 includes the actuator pivot hole 506 proximate to a top edge of the top segment side flange 910.

The top actuator plate bottom segment 908 also includes integral bottom segment side flanges 912 at each vertical edge of the top actuator plate bottom segment 908, similar in orientation to the top segment side flanges 910. Due to the horizontal bend 904, a gap between a bottom edge of the top segment side flange 910 and a top edge of the proximate bottom segment side flange 912 forms a V-shape, with the point of the V coinciding with the horizontal bend 904 location. The bottom segment side flanges 912 each include a bottom tab 920 proximate to a bottom edge of each bottom segment side flange 912.

Two chevron-shaped gusset plates 926 are coupled to the top actuator plate 900. The angle of each gusset plate 926 is configured to approximately match an angle between the top actuator plate top segment 906 and the top actuator plate bottom segment 908. Each gusset plate 926 is coupled to both a bottom portion of the top segment side flange 910 and a top portion of the bottom segment side flange 912, thus coupling each top segment side flange 910 to the proximate bottom segment side flange 912 and covering the V-shaped gap between the side flanges 910, 912.

The pump guide 902 includes three integral segments forming a general L-shape. A lower end of the pump guide top segment 914 is integrally coupled to an upper end of the pump guide middle segment 916, forming the generally vertical portion of the L-shape. The pump guide top segment 914 and the pump guide middle segment 916 are coupled at an angle to match the angle between the top actuator plate top segment 906 and the top actuator plate bottom segment 908. The pump guide bottom segment 928 is coupled to a lower end of the pump guide middle segment 916, the pump guide bottom segment 928 extending inward at an angle of approximately 80 degrees, forming the generally horizontal portion of the L-shape. Each pump guide side flange 918 is coupled to a lower side portion of each pump guide middle segment 916 proximate to the pump guide bottom segment 928, and extends generally vertically inward along a portion of a horizontal edge of the pump guide bottom segment 928, forming a generally horizontal corner where the lower edge of the pump guide side flange 918 abuts a horizontal edge of the pump guide bottom segment 928.

The pump guide middle segment 916 includes two vertical guide tabs 922 formed by cutting an I-shape into the pump guide middle segment 916 and folding the resulting guide tabs 922 inward. The guide tabs 922 are located such that a pump nozzle 1106 is between the guide tabs 922 when the cover 104 is in the closed position.

The pump guide bottom segment 928 includes the oval dispensing hole 924 located proximate to a front edge of the actuator 108. The dispensing hole 924 is equidistant from each guide tab and is located in a position suitable for dispensing of the liquid from the pump nozzle 1106 through the dispensing hole 924 when the cover 104 is in the closed position, as shown below in FIG. 12). The configuration of the dispensing hole 924 is the minimum required to allow the liquid to be entirely dispensed through the dispensing hole 924 when the pump nozzle 1106 includes a nozzle insert 1108 as described further below in FIGS. 11, 12.

Referring again to FIG. 9, the actuator 108 is shown. The actuator 108 is comprised of two members, the top actuator plate 900 and the pump guide 902. The top actuator plate 900 forms a continuous generally vertical exterior surface to the actuator 108, preventing prying. The pump guide 902 is coupled to an interior face of the top actuator plate 900, increasing the structural strength of the actuator 108, preserving the continuous surface of the actuator 108, and providing the guide tabs 922 for aligning the pump nozzle 1106 with the dispensing hole 924. The pump guide 902 also forms a generally continuous underside of the actuator 108, preventing access to and possible tampering with the liquid cartridge 200.

The coupling of the pump guide 902 to the top actuator plate 900 also advantageously increases the structural strength and resistance to deformation of the actuator 108, preventing removal of the actuator 108 due to bending of the actuator 108. A lower edge of the top actuator plate 900 is configured to form a salient corner with the pump guide 902, preventing prying of the top actuator plate 900 with respect to the pump guide 902.

The top edge of each top segment side flange 910 is pivotally coupled to the interior face of the front plate front wall 500, so as to provide pressure to the pump 202, thus actuating the pump 202, when the actuator 108 is pushed inward. The top actuator plate 900 includes the top segment side flanges 910 and the bottom segment side flanges 912 to provide additional structural strength and stiffness to the actuator 108, and to prevent access to the interior of the liquid dispenser 100 when in the closed position.

The top actuator plate bottom segment 908 is coupled relative to the top actuator plate top segment 906 to provide a pushing surface that projects from the perimeter of the cover 104, while the top actuator plate top segment 906 remains generally parallel to the perimeter of the cover 104.

The gusset plates 926 coupling each top segment side flange 910 to the proximate bottom segment side flange 912 provide additional reinforcement and structural strength to the top segment side flanges 910 and bottom segment side flanges 912 to reduce the likelihood of removal of the actuator 108 from the liquid dispenser 100 due to tampering.

The bottom segment side flanges 912 each include the bottom tab 920 to provide additional closure to the actuator 108 when the actuator 108 is in the outmost position, prevent objects from being inserted into the dispenser 100, and to strengthen the actuator 108 against prying forces or forces aimed at bending the actuator 108 to gain access to the dispenser 100 interior.

The pump guide 902 forms the underside of the actuator 108, and includes the dispensing hole 924. As described further below, the dispensing hole 924 is intentionally small in order to prevent a ligation gap at the dispensing hole 924 location. As a result, the margin of error of placement of the pump nozzle 1106 relative to the dispensing hole 924 is small. To ensure the correct pump nozzle 1106 placement, the guide tabs 922 included in the pump guide 902 align and hold the pump nozzle 1106 in a position required to align the nozzle discharge with the dispensing hole 924.

Figure 10:
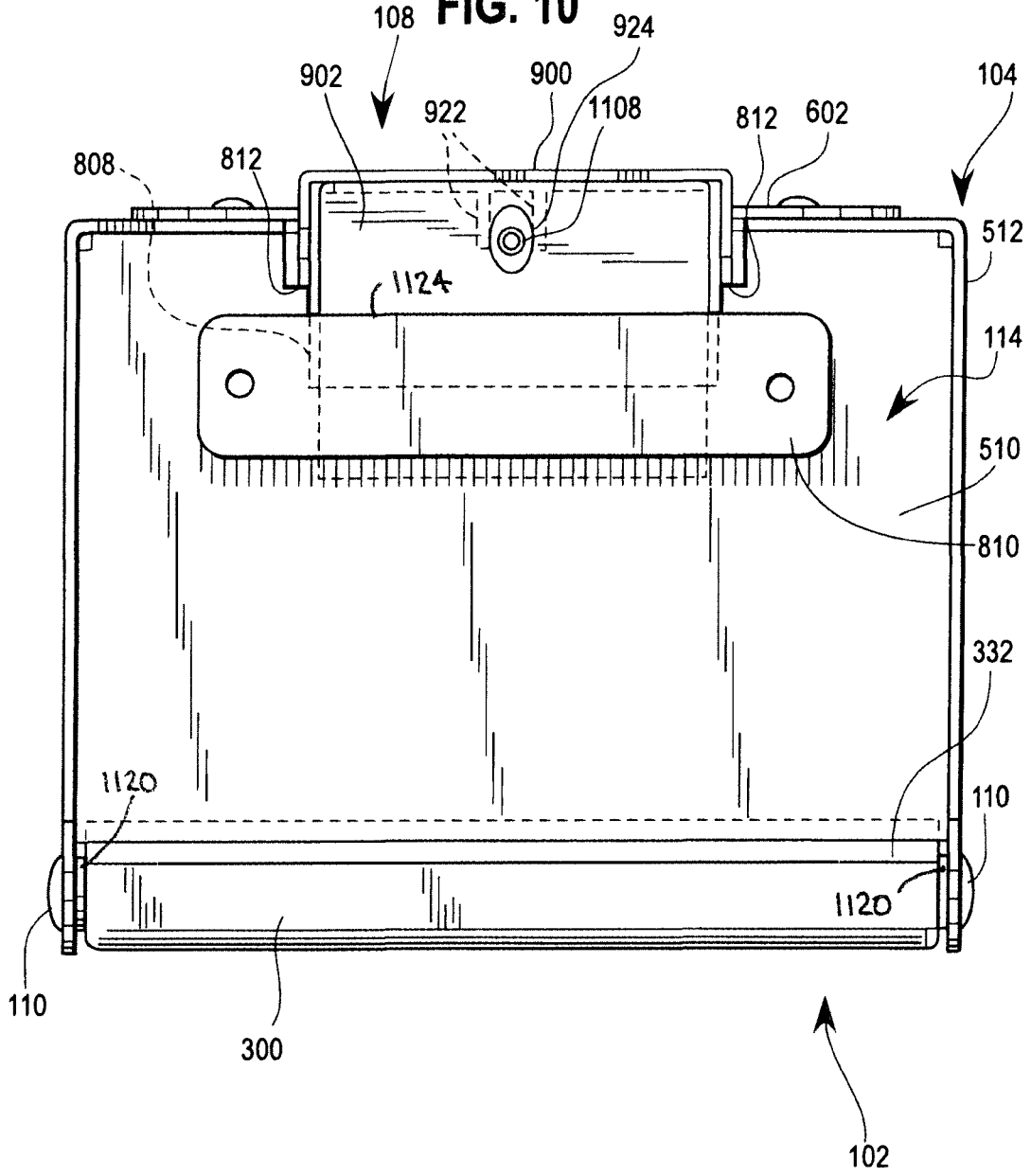
FIG. 10 shows an example of a bottom surface of the liquid dispenser in accordance with aspects of the present disclosure.

Referring next to FIG. 10, the liquid dispenser bottom surface 116 is shown. Shown are the back housing 102, the cover 104, the actuator 108, a plurality of pivot bolts 110, the back plate 300, the back plate bottom flange 332, the base plate 510, the front plate 512, the cover reinforcing plate 602, the base plate notch 808, the base reinforcing plate 810, the base plate notch shoulders 812, the top actuator plate 900, the pump guide 902, the plurality of guide tabs 922, the dispensing hole 924, and the nozzle insert 1108.

As previously described, the liquid dispenser 100 is configured to dispense the liquid through the dispensing hole 924 when the actuator 108 is pushed inward and the pump 202 is activated. The guide tabs 922 of the pump guide 902, shown on either side of the pump nozzle 1106, maintain the pump nozzle 1106 in the position necessary to align the pump nozzle 1106 with the dispensing hole 924. The dispensing hole 924 is elliptical in shape with a major diameter of less than 0.5 inches, for example, no more than 0.375 inches, for example no more than 0.35 inches width, and a minor diameter of less than 0.25 inches, for example, no more than 0.218 inches.

The base reinforcing plate 810 is shown overlapping with the base plate notch 808 to minimize the actuator gap 1124 formed between the pump guide 902 and the base plate 510 when the actuator 108 is pushed inward, thus preventing a ligation gap and tampering. The actuator gap 1124 is less than 1/10 of an inch in width, for example, no more than 0.034 inches width. Similarly, the back plate bottom flange 332 is shown overlapping with the interior face of a rear portion of the base plate 510 to prevent a ligation gap between the back plate 300 and the base plate 510 at the hinge location. As such, when the cover 104 is closed against the back housing 102, no ligation gap is present between the back plate 300 and the base plate 510 at the hinge location.

The generally horizontal portion of the pump guide 902 is shown extending past a rear edge of the base plate notch 808, preventing access to the rear edge of the pump guide 902 when the actuator 108 is rotated outward until it contacts the front plate 512, thus preventing possible vandalism to or removal of the actuator 108 from the liquid dispenser 100.

Figure 11:
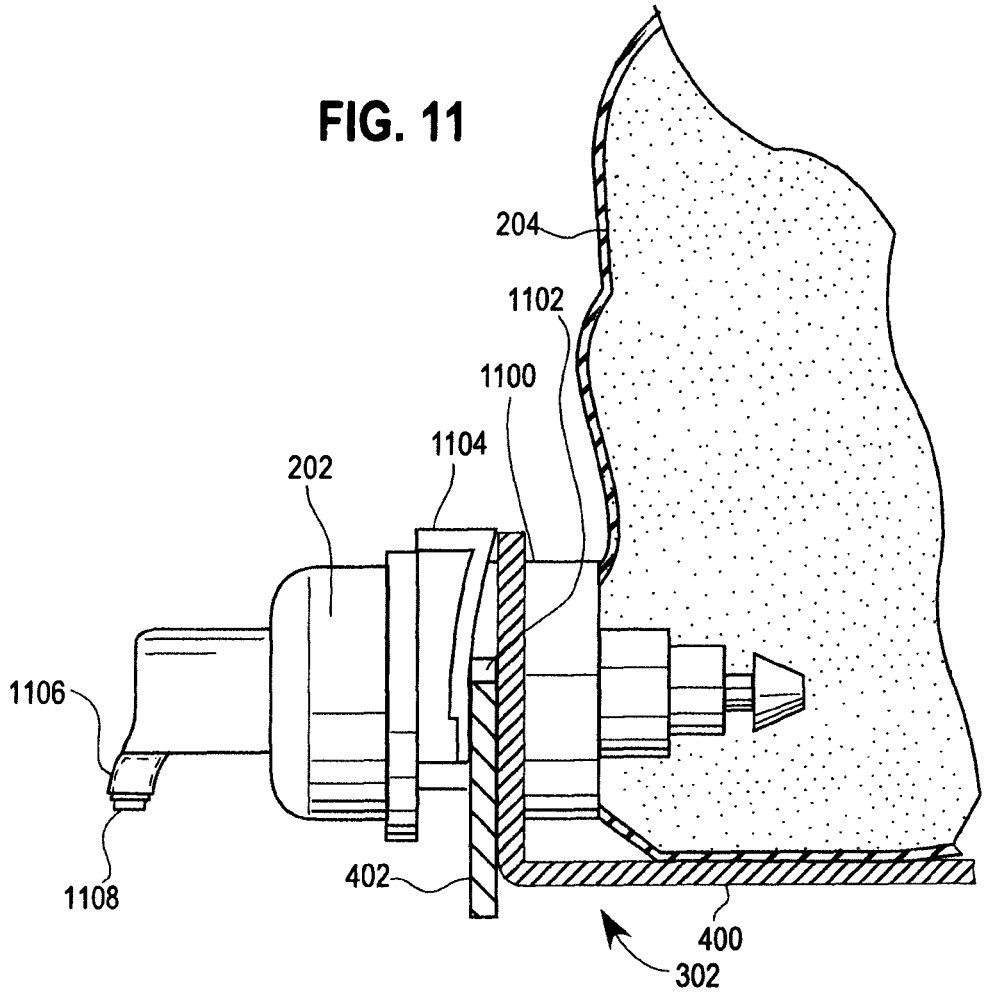
FIG. 11 shows an example of a pump coupled to cartridge support assembly in accordance with aspects of the present disclosure.

Referring next to FIG. 11, the pump 202 is shown coupled to the cartridge support assembly 302 in one embodiment of the present invention. Shown are the pump 202, the liquid container 204, the cartridge support assembly 302, the pump shim plate 402, the nozzle insert 1108, a pump body 1100, a pump notch 1102, a pump flange 1104, and the pump nozzle 1106.

The pump 202 is demountably coupled to the cartridge support assembly 302 by sliding the pump body 1100 downward into the pump cutout 330 so that the pump notch 1102 is coupled to the pump shim plate 402 and the cartridge support plate 400 at the pump cutout 330, and the pump flange 1104 is wedgingly coupled to a front face of the cartridge support plate front wall 328 and a front face of the pump shim plate 402. Those skilled in the art will note that alternate pump types and pump mounting configurations may be used instead of the pump type and pump mounting configuration shown.

The pump nozzle 1106 includes the nozzle insert 1108, which is wedgingly coupled to the interior of the pump nozzle 1106. The nozzle insert 1108 is comprised of a compressible plastic material, for example, a thermoplastic elastomeric material. When the nozzle insert 1108 is coupled to the pump nozzle 1106, a lower portion of the nozzle insert 1108 projects from the pump nozzle 1106. The nozzle insert 1108 is described further below in FIG. 12.

Referring again to FIG. 11, the pump 202 is demountably coupled to the cartridge support assembly 302 to allow for replacement of the liquid cartridge 200 while also securing the pump 202 in the required location for dispensing the liquid through the dispensing hole 924.

The nozzle insert 1108 reduces the diameter of a liquid stream dispensed from the pump nozzle 1106, as the liquid stream diameter dispensed from the pump 202 lacking the nozzle insert 1108 would be too wide for the entire liquid stream to exit through the dispensing hole 924. In the present embodiment, the pump 202 is a liquid-to-foam type pump, but it will be apparent to those with ordinary skill in the art that the reduction in diameter applies equally to a foam stream. The nozzle insert 1108 is described further below in FIG. 12.

Figure 12:
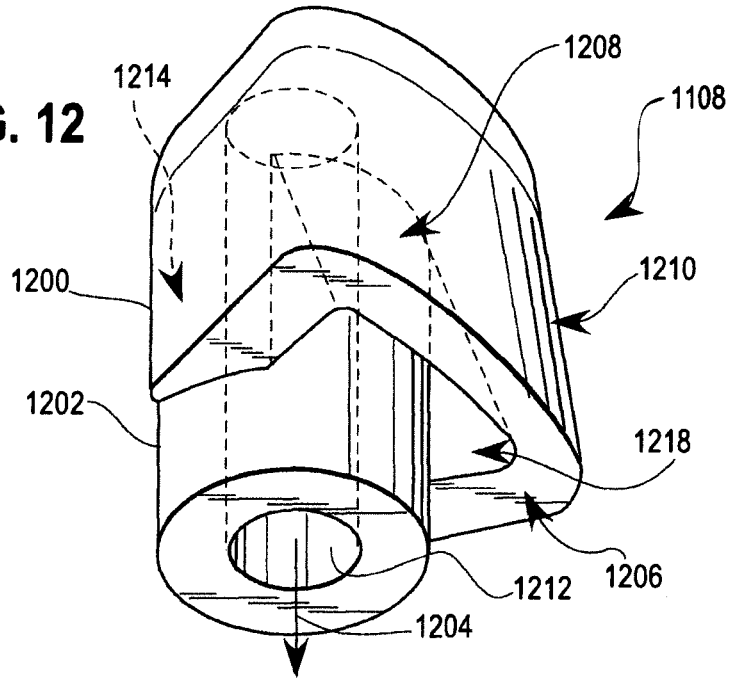
FIG. 12 shows an example of a perspective view of the nozzle insert in accordance with aspects of the present disclosure.

Referring next to FIG. 12, a perspective view of the nozzle insert 1108 is shown in one embodiment of the invention. Shown are the nozzle insert 1108, a body segment 1200, a projection segment 1202, a direction of liquid flow 1204, an outer edge 1206, an exterior surface 1208, a front surface 1210, a dispensing bore 1212, and a rear corner 1214.

In the present embodiment, the nozzle insert 1108 comprises thermoplastic elastomeric material. The nozzle insert 1108 includes the body segment 1200 and the projection segment 1202. The body segment 1200 is shaped to wedgingly fit within the pump nozzle 1106. In the present invention, the body segment 1200 is in a general triangular prism shape, with the longitudinal axis of the prism parallel to the direction of liquid flow 1204 through the nozzle insert 1108. The body segment 1200 includes the outer edge 1206, corresponding to the end of the triangular prism shape distal to the pump nozzle 1106.

The projection segment 1202 is integrally coupled to the outer edge 1206 and is generally tubular in shape. The nozzle insert 1108 exterior surface 1208 is configured so that when the body segment 1200 is wedgingly received in the pump nozzle 1106, the outer edge 1206 generally aligns with the edge of the pump nozzle 1106, and the projection segment 1202 projects outward from the pump nozzle 1106.

The front surface 1210 of the nozzle insert 1108 corresponds to a face of the triangular prism that faces generally outward when the pump 202 is coupled to the liquid dispenser 100. The front surface 1210 is formed in a slightly convex shape.

The nozzle insert 1108 includes the dispensing bore 1212. The longitudinal axis of the center of the dispensing bore 1212 is located proximate to the body segment rear corner 1214 located proximate to the rear of the liquid dispenser 100 (not shown) when the pump 202 is installed in the liquid dispenser 100. The dispensing bore 1212 is approximately 0.087" in diameter.

The nozzle insert 1108 includes the cavity 1218 in a portion of the body segment 1200 proximate to the outer edge 1206. The cavity 1218 is located proximate to the front surface 1210 of the nozzle insert 1108.

Referring again to FIG. 12, as previously described, the nozzle insert 1108 decreases the diameter of the liquid stream so that the liquid stream is dispensed through the narrow dispensing hole 924 in the actuator 108. The nozzle insert 1108 is comprised of a thermoplastic elastomeric material, providing flexibility and durability. The combination of material flexibility and the nozzle insert 1108 shape results in a watertight seal between the exterior surface 1208 of the nozzle insert 1108 and the pump nozzle 1106, preventing liquid leakage between the pump nozzle 1106 and the nozzle insert 1108. Those skilled in the art will recognize that the nozzle insert may comprise other suitably flexible and durable materials, for example, rubber.

The front surface 1210 is formed in a shape that is slightly more convex than a shape of a front interior surface of the pump nozzle 1106. In addition, the cavity 1218 proximate to the front surface 1210 allows for greater flexibility of movement of the front surface 1210. As a result, when the nozzle insert 1108 is inserted into the pump nozzle 1106, the front surface 1210 is compressed and moves towards the dispensing bore 1212, resulting in a less convex shape and providing a tight seal between the front surface 1210 and the front interior surface for the pump nozzle 1106. The resulting compression also pushes out the other sides of the body segment 1200, providing a tight seal between the pump nozzle 1106 and all sides of the body segment 1200, preventing liquid leakage when the pump 202 is actuated.

The dispensing bore 1212 diameter is configured to provide the maximum rate of liquid flow while providing a liquid stream diameter small enough to entirely flow through the dispensing hole 924, as previously noted.

The projection segment 1202 projects from the edge of the pump nozzle to extend the dispensing bore 1212 to a location adjacent to the dispensing hole 924 so that the liquid stream remains compressed until just before it passes through the dispensing hole 924. As the liquid stream will widen gradually once it leaves the dispensing bore 1212, the projection segment 1202 allows the dispensing hole 924 to be made smaller than if the projection segment 1202 were not included and the liquid stream widened before passing through the dispensing hole 924. The smaller dispensing hole 924 is necessary to prevent ligation using the dispensing hole 924. In the present embodiment, the dispensing hole 924 is configured to prevent a knot in a standard shoelace from being passed through the dispensing hole 924. Those skilled in the art will note that the dispensing hole may be configured to prevent other articles from being passed through the dispending hole 924.

As noted previously, the exemplary pump 202 is a liquid-to-foam pump, resulting in the foam stream dispensed from the pump 202. As the foam stream expands more quickly than the comparative liquid stream, the projection segment 1202 allows the foam to pass through the dispensing hole 924 immediately after exiting the nozzle insert 1108, allowing the foam stream to entirely exit the liquid dispenser 100 while still accommodating the small dispensing hole 924.

Figure 13:
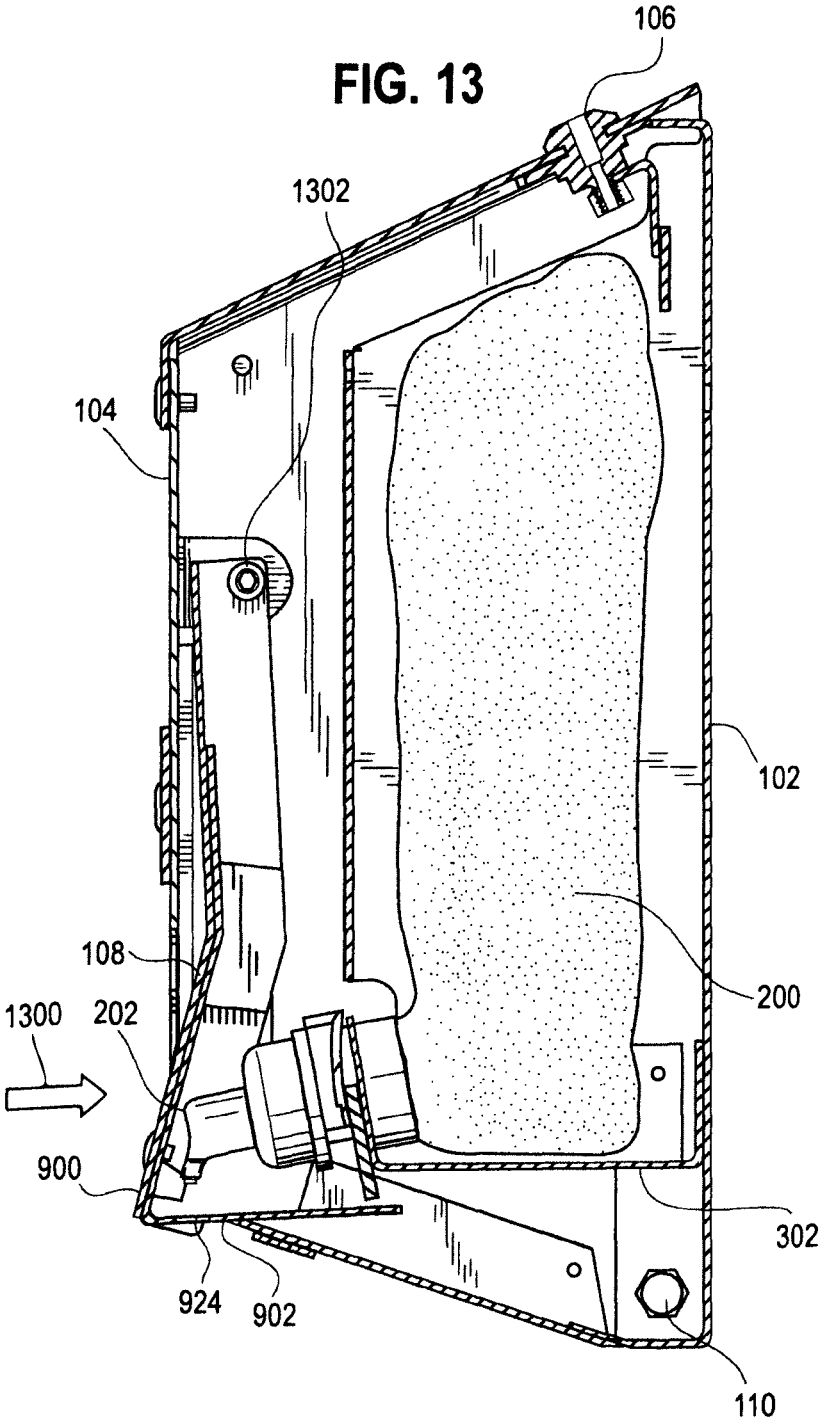
FIG. 13 shows an example of a cross-sectional view of the liquid dispenser with the liquid cartridge installed in accordance with aspects of the present disclosure.

Referring next to FIG. 13, a cross-sectional view of the liquid dispenser 100 with the liquid cartridge 200 installed is shown. Shown are the back housing 102, the cover 104, the locking mechanism 106, the actuator 108, the pivot bolt 110, the liquid cartridge 200, the pump 202, the cartridge support assembly 302, the top actuator plate 900, the pump guide 902, the dispensing hole 924, the nozzle insert 1108, an activation force arrow 1300, and an actuator pivot bolt 1302.

As previously described, the liquid dispenser 100 is operated when the actuator 108 is pushed inward (as indicated by the activation force arrow 1300), causing the actuator 108 to pivot at the actuator pivot holes 506 and rotate inward towards the back housing 102, pushing in a moveable portion of the pump 202 and dispensing the liquid through the pump nozzle 1106, through the nozzle insert 1108, through the dispensing hole 924 and then to the user. The pump 202, including the nozzle insert 1108, does not extend past the perimeter of the liquid dispenser 100, in order to prevent tampering of the pump 202 or nozzle insert 1108. The combination of the nozzle insert 1108 and the dispensing hole 924 allow for dispensing of the liquid through the small dispensing hole 924 while still using a standard pump 202, while reducing the size of the dispensing hole 924 in order to prevent a ligation point.

Figure 14:
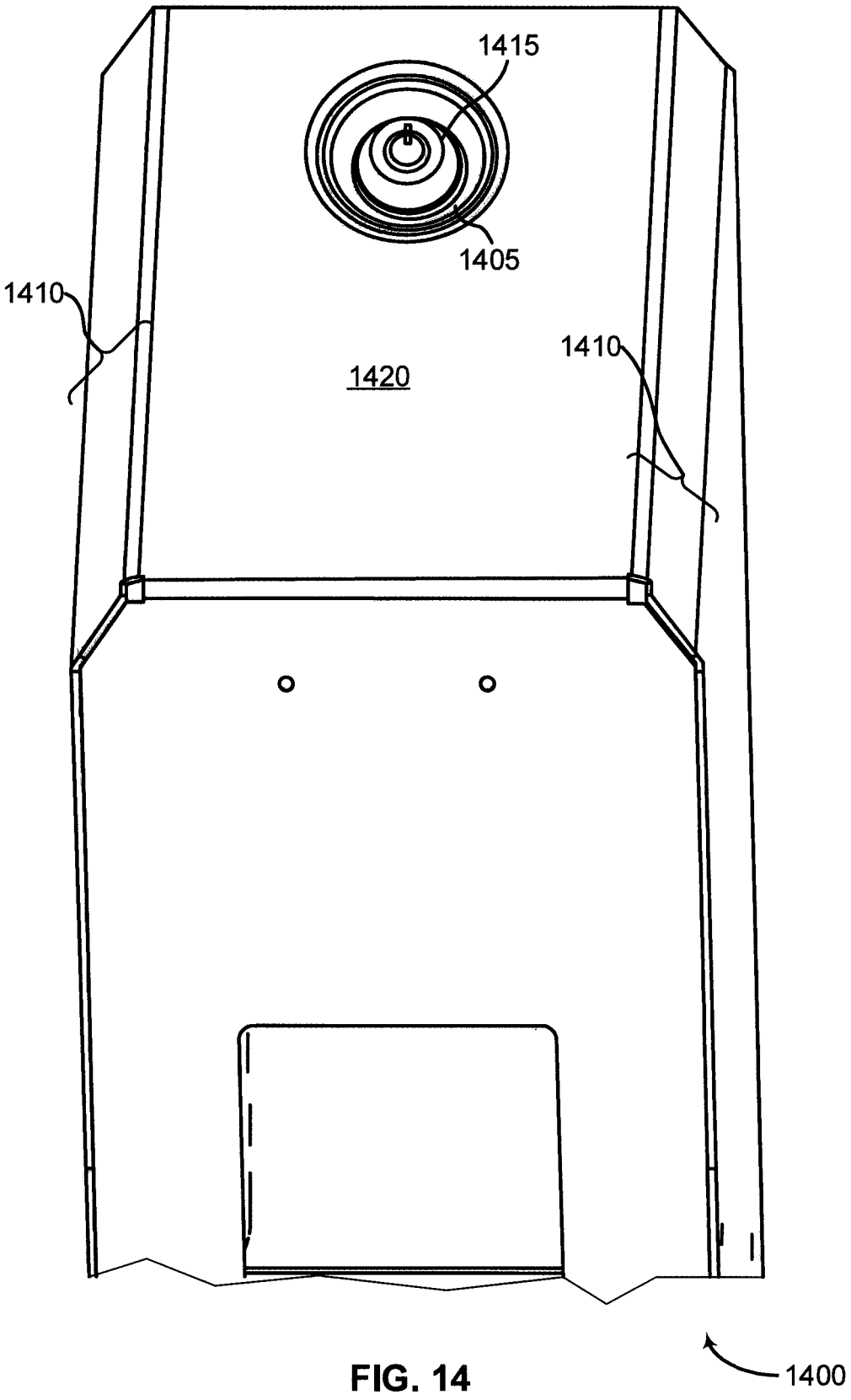
FIG. 14 shows an example of a front view of the cover in accordance with aspects of the present disclosure.

FIG. 14 shows an example of a front view of the cover in accordance with aspects of the present disclosure. Cover 1400 may be an example of, or include aspects of, the corresponding element or elements described with reference to FIGS. 5, 15, 17, 20, 22, and 23. Cover 1400 may include depression 1405, chamfered edge 1410, lock 1415, and top surface 1420. Lock 1415 may be an example of, or include aspects of, the corresponding elements described with reference to FIGS. 1, 2, 5, 13 and 15. Top surface 1420 may be an example of, or include aspects of, the corresponding elements described with reference to FIGS. 1, 5, 7, and 15.

Cover 1400 may be an additional embodiment of the dispenser cover described above, but it will be understood that the embodiments may be implemented separately (e.g. including only the greater slant of the top surface without the chamfer or changes to the lock area).

In one additional embodiment, an increased slant of the top surface of the cover 1400 makes it even more difficult to create a hang point. Also, the increased slant prevents the dispenser from being used as a cup holder. By one embodiment, the angle of the top surface is between 10 and 55 degrees. By other embodiments the angle of the top surface is between 25 and 55 degrees, or is between 35 and 55 degrees.

The top corners are chamfered to form the chamfered edges 1410 to eliminate the 90 degree edge. The addition of the chamfered edges 1410 reduces head trauma should a person decide to slam his or someone else's head into the top of the dispenser. Extreme slant of the top surface 1420 adds to the security and reduces water going into the lock 1415. The increases slant of the top surface 1420 not only make it impossible to get something caught on it but also reduces the surface close to the locking point where a towel or hands can grab and force the dispenser open. The chamfered edges 1410 take some of the load off the lock 1415 by taking making the dispenser narrower at the top where vandals grab, making it more difficult to vandalize the modified dispenser.

A circular portion of the top surface 1420 of the cover 1400 concentric with the lock 1415 forms a bowl-like depression 1405 in which the lock 1415 sits. The top of the lock 1415 is flush with the top surface outside of the depressed area 1405. This "Belly button" feature (depression 1405) of the lock area where the lock 1415 is recessed in the depression 1405 makes the lock 1415 flush and will eliminating the chance of a rope, string or cut sheet being caught on it. In a shower the depression 1405 also collects water at the bottom of the curvature of the depression 1405. This function also helps keep water from entering lock 1415 and flows around and to the bottom of the depression 1405 where it does no damage. The depression shape of the depression 1405 also has an anti-ligation effect and the slant of the depression 1405 (due to the slanted top surface 1420) slows down the amount of water that can go into the lock 1415 in a shower situation.

Figure 15:
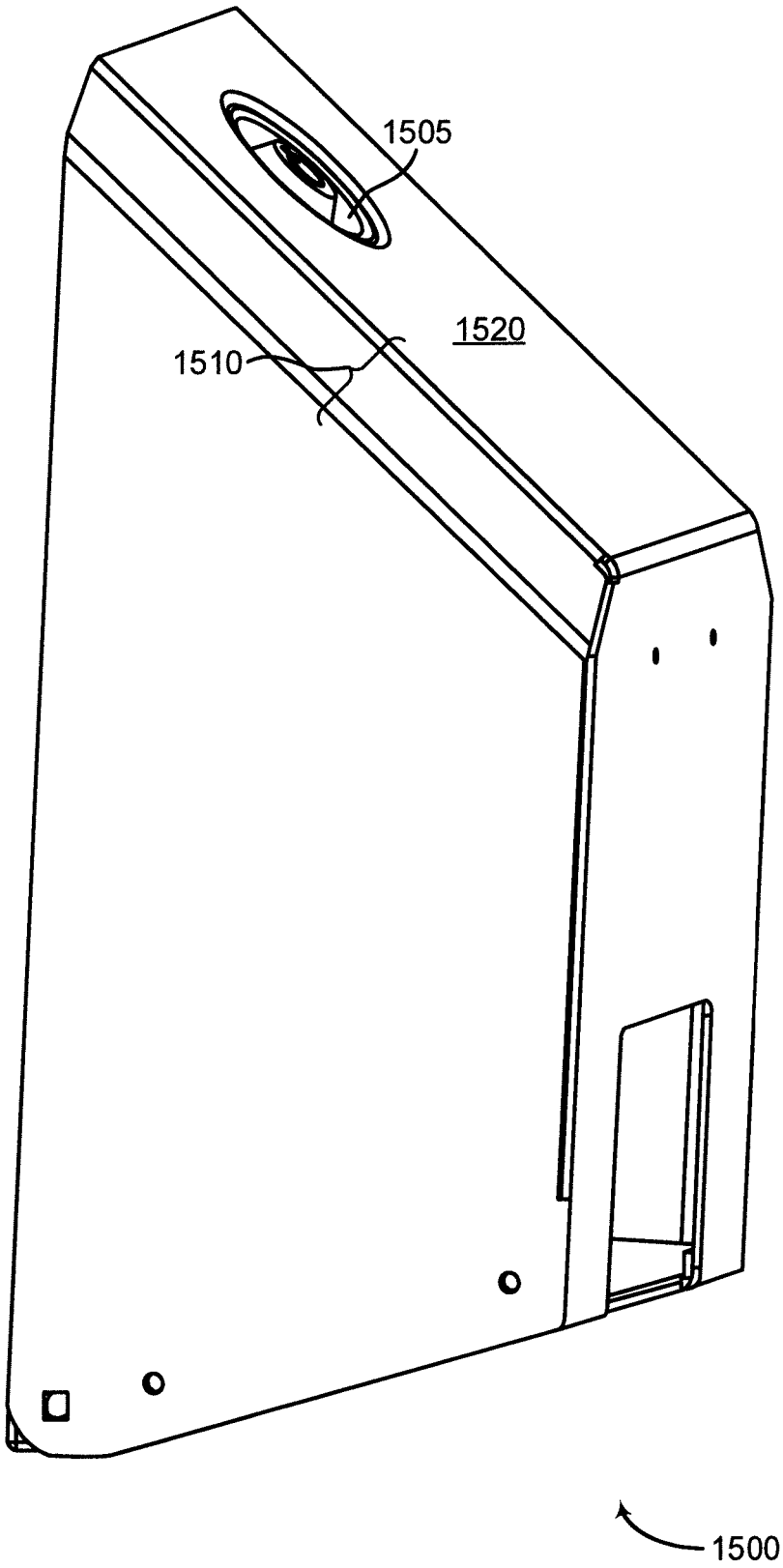
FIG. 15 shows an example of a side view of the cover in accordance with aspects of the present disclosure.

FIG. 15 shows an example of a side view of the cover in accordance with aspects of the present disclosure. Cover 1500 may represent a side view of the cover 1400 described with reference to FIG. 14.

Cover 1500 may include depression 1505 and chamfered edge 1510. Cover 1500 may include lock 1515 and top surface 1520. Lock 1515 may be an example of, or include aspects of, the corresponding element or elements described with reference to FIGS. 1, 2, 5, 13, and 14. Top surface 1520 may be an example of, or include aspects of, the corresponding element or elements described with reference to FIGS. 1, 5, 7, and 14.

Figure 16:
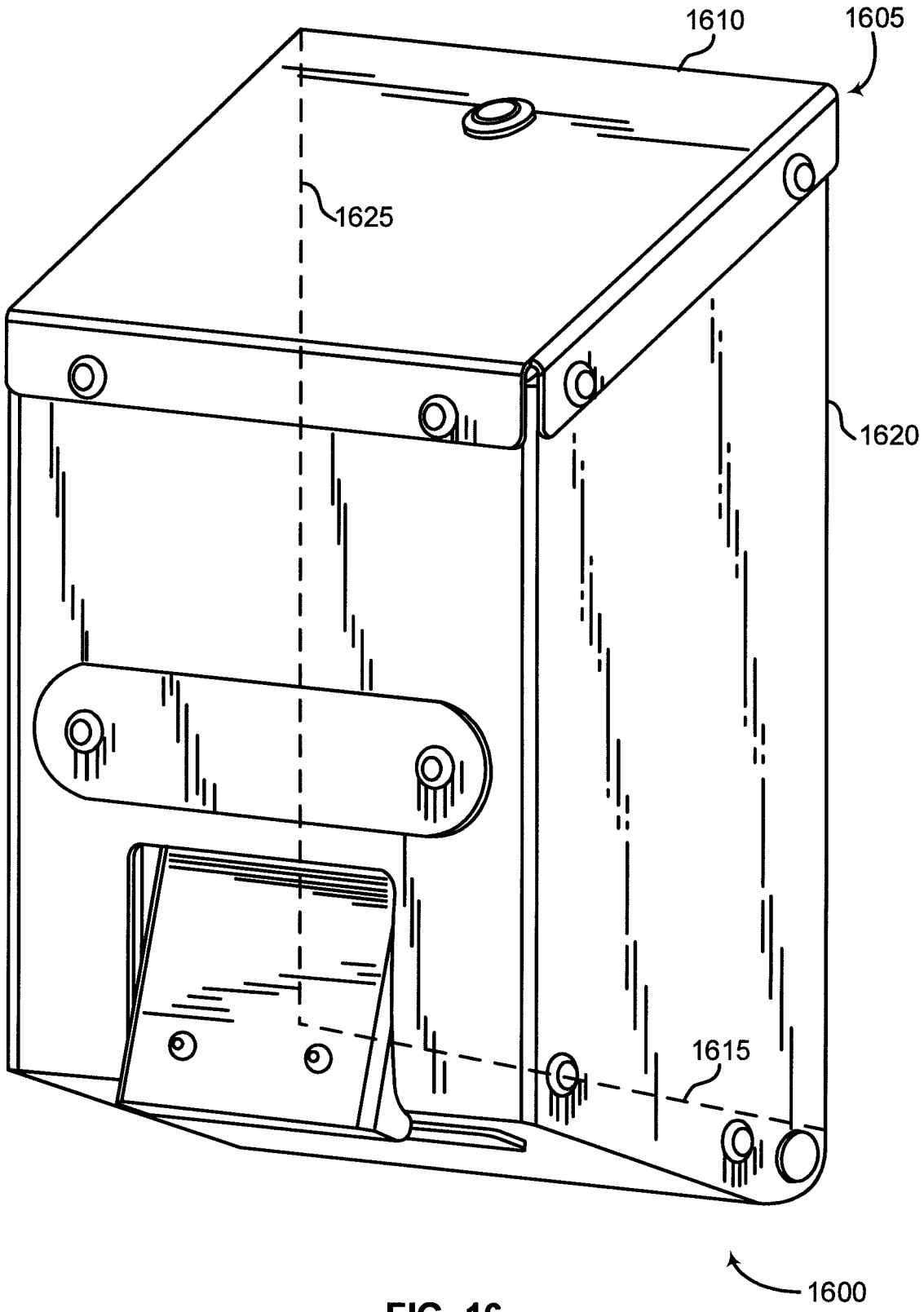
FIG. 16 shows an example of a liquid dispenser in accordance with aspects of the present disclosure.

FIG. 16 shows an example of a liquid dispenser in accordance with aspects of the present disclosure. Liquid dispenser 1600 may be an example of, or include aspects of, the corresponding element or elements described with reference to FIGS. 1, 2, 13, 17, and 20-23.

Liquid dispenser 1600 may include perimeter edge 1605. Perimeter edge 1605 may include top edge 1610, underside edge 1615, right side edge 1620, and left side edge 1625. The dispenser edges of the dispenser where the dispenser abuts the wall are herein defined as together comprising a perimeter edge 1605. The perimeter edge 1605 includes a generally horizontal top edge 1610 (which may be curved and/or sloped in some embodiments), a generally vertical and/or angled right side edge 1620, a generally vertical and/or angled left side edge 1625, and a generally horizontal underside edge 1615. The edges together form a continuous perimeter edge 1605 where the dispenser abuts the wall.

Figure 17:
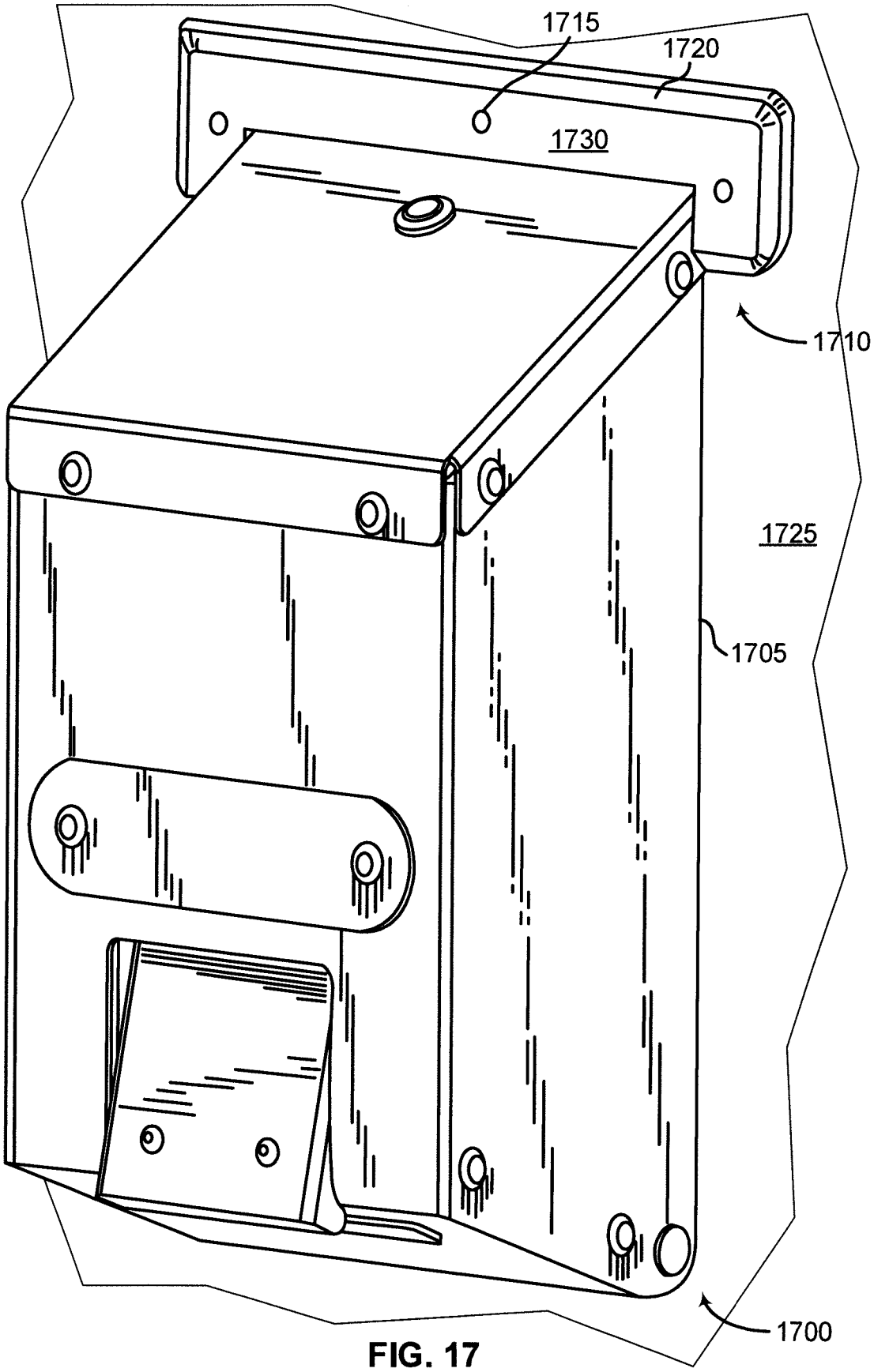
FIG. 17 shows an example of a liquid dispenser with an accessory device in accordance with aspects of the present disclosure.

FIG. 17 shows an example of a liquid dispenser 1700 with an accessory device 1710 mounted to a wall 1725 in accordance with aspects of the present disclosure. Wall 1725 includes any generally vertical surface suitable for mounting the dispenser. Liquid dispenser 1700 may be an example of, or include aspects of, the corresponding element or elements described with reference to FIGS. 1-13, 16, and 20-23.

Although the term "liquid dispenser" is used, in some examples the dispenser may be configured for and used for other types of dispensable/consumable products. In one example, the dispenser is configured for solid dispensables such as paper towels. Liquid dispenser 1700 may include cover 1705. Cover 1705 may be an example of, or include aspects of, the corresponding element or elements described with reference to FIGS. 1, 2, 5-7, 9, 10, and 13-16. Accessory device 1710 comprises plate 1730 and includes fastener holes 1715 and chamfer 1720.

Figure 18:
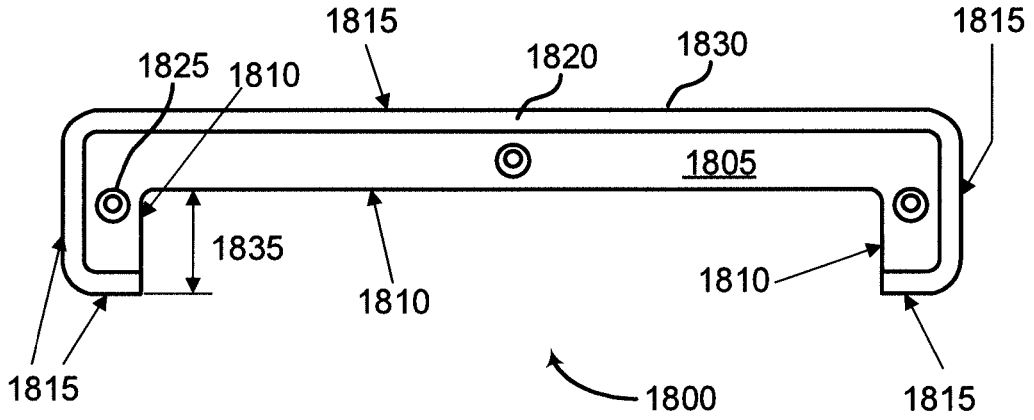
FIG. 18 shows an example of a front elevation of an accessory device in accordance with aspects of the present disclosure.

FIG. 18 shows an example of a front elevation of an accessory device in accordance with aspects of the present disclosure. Accessory device 1800 may be an example of, or include aspects of, the corresponding element or elements described with reference to FIGS. 17, and 19-27. Accessory device 1800 may include front surface 1805, underside surface 1810, outer surface 1815, chamfer 1820, fastener holes 1825, and plate 1830.

Accessory device 1800 may comprise a plate 1830 having a thickness and having the front surface 1805 and a rear surface wherein the thickness is the distance between the front surface 1805 and rear surface, the plate 1830 further having an underside surface 1810 generally normal to the front surface 1805 and rear surface, wherein the underside surface 1810 is shaped to generally match the top edge 1610, a portion of the left side edge 1625 proximate to the top edge, and a portion of the right side edge 1620 proximate to the top edge 1610, wherein when the dispenser 1700 is mounted to the wall 1725 and in the closed position, and the rear surface of the plate 1730 is generally parallel to and coupled to the wall 1725. In one embodiment when the accessory device 1800 and the dispenser are mounted to the wall 1725 a gap between the dispenser top edge 1610 and the proximate underside surface 1810 (also referred to as the first gap) is no more than 2.5 mm (0.1 inches). In another embodiment each gap between the dispenser edges and the proximate underside surfaces 1810 is configured to allow for proper operation of the dispenser, i.e. the dispenser cover may open and close without interference with the accessory device 1800. In another embodiment each gap is equal to the minimum width required for proper operation of the dispenser. In another embodiment each gap is equal to the minimum width required for proper operation of the dispenser, plus an additional distance, for example, a 1 mm additional distance added to each minimum width to account for tolerances.

Figure 20:
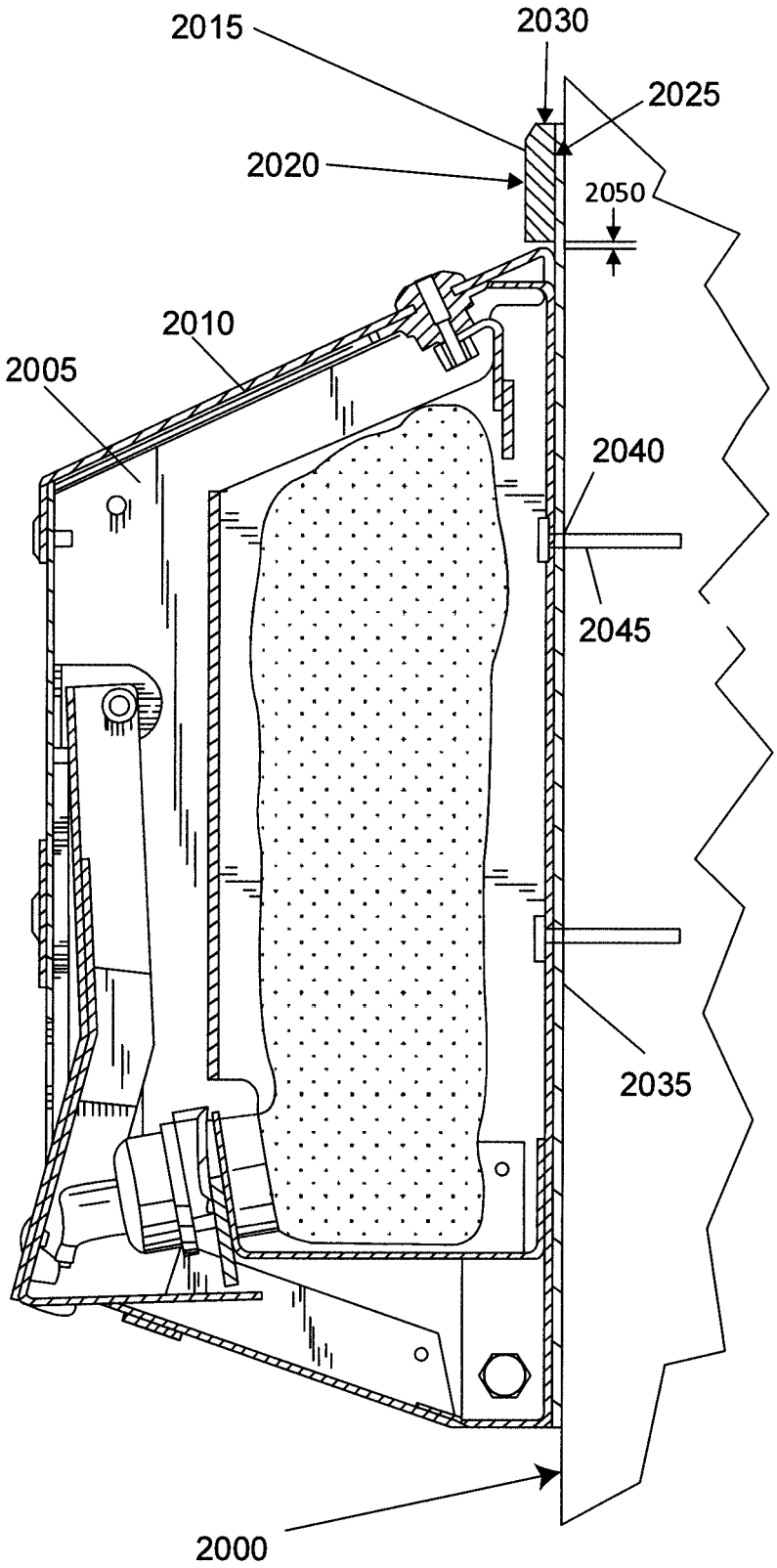
FIG. 20 shows an example of a section through a liquid dispenser with an accessory device and backing plate, all coupled to a wall in accordance with aspects of the present disclosure.

In another embodiment the gaps between the underside surfaces 1810 and the proximate side edges 1620 1625 (also referred to as the second and third gaps) are configured to prevent opening of the dispenser when the accessory device is mounted to the wall above the dispenser, the dispenser is closed and locked, and a lateral blow is applied to the dispenser. In cases where the portion of the accessory device 1710 abutting the wall is radiused, it will be understood that the gap is the clear distance between the furthest extent of the accessory device 1710 at that location and the proximate underside surface 1810 of the accessory device 1710 (as shown in FIG. 20).

In one embodiment a normal distance between the underside surface 1810 and the outer surface 1815 is at least 13 mm (0.5 inches).

Accessory device 1710 may be coupled to the wall 1725. Accessory device 1710 may be an example of, or include aspects of, the corresponding element or elements described with reference to FIGS. 18-27.

The accessory device 1710 may be a separate accessory as shown above and mounted directly to the wall 1725 above the dispenser 1700. When mounted directly to the wall 1725 it is installed after installation of the dispenser on the wall 1725. It may also be mounted to a backing plate which is in turn coupled to the wall as shown in FIG. 20.

Accessory device 1800 may include chamfered edge 1820. The accessory device 1800 may include fastener holes 1825 configured to receive fasteners 1715. Chamfered edge 1820 may be formed by an intersection of the outer surface 1815 and the front surface 1805. In some examples, an angle of the chamfered edge 1820 is between 40 and 50 degrees.

Fastener holes 1825 may be in the accessory device 1800 (and the backing plate where the backing plate is used, wherein the fastener holes 1825 of the accessory device 1800 and corresponding fastener holes of the backing plate align). Thus, fastener holes 1715 may be through the plate thickness and may also include corresponding fastener holes 1715 through the backing plate.

In the embodiment shown in FIG. 18, the underside side portion length 1835 is the length of one underside portion proximate to the corresponding dispenser side edge. In one embodiment of the present invention, the underside side length for each side (i.e. proximate to left side edge and right side edge) is at least 15 mm long. In some embodiments the underside side portion length 1835 is configured to prevent access to the top corners of the dispenser.

Figure 19:
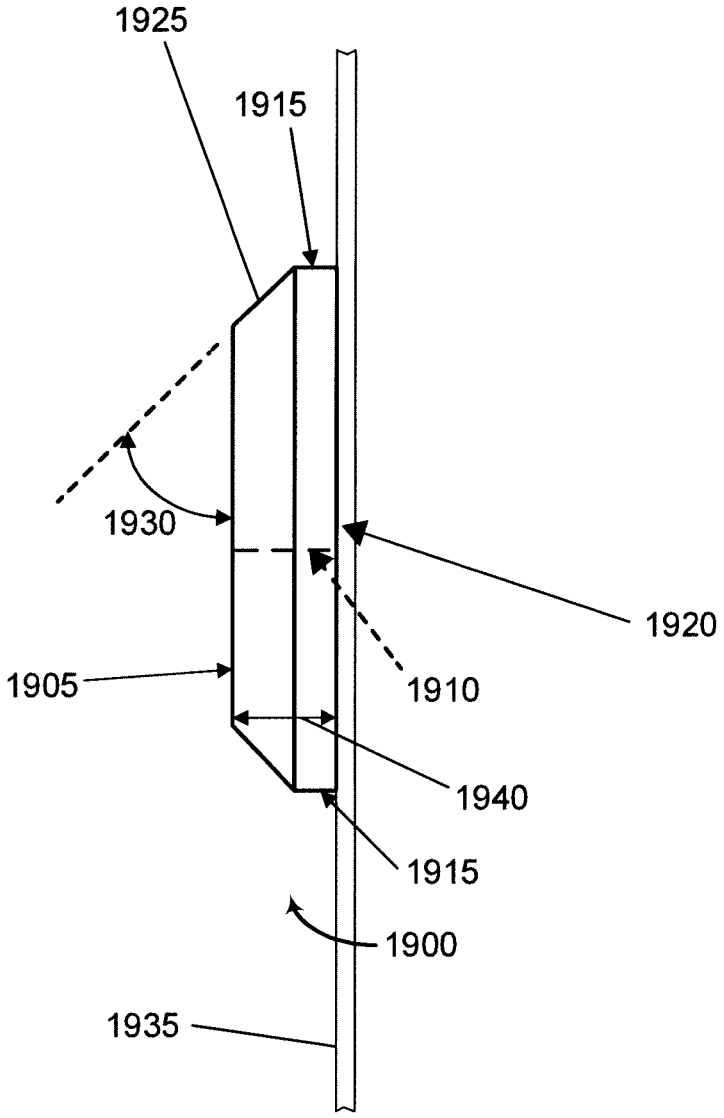
FIG. 19 shows an example of a side elevation of an accessory device in accordance with aspects of the present disclosure.

FIG. 19 shows an example of a side elevation of an accessory device in accordance with aspects of the present disclosure. Accessory device 1900 may be an example of, or include aspects of, the corresponding element or elements described with reference to FIGS. 17, 18, and 20-27. Accessory device 1900 may include front surface 1905, underside surface 1910, outer surface 1915, rear surface 1920, chamfered edge 1925, and thickness 1940

In some examples, an angle 1930 of the chamfered edge 1925 is between 40 and 50 degrees.

FIG. 20 shows an example of a section through a liquid dispenser with an accessory device and backing plate, all coupled to a wall in accordance with aspects of the present disclosure. The example shown includes wall 2000, liquid dispenser 2005, cover 2010, accessory device 2015, backing plate 2035, mounting holes 2040, and fastener 2045. Liquid dispenser 2005 may be an example of, or include aspects of, the corresponding element or elements described with reference to FIGS. 1, 2, 13, 16, 17, and 21-23.

Accessory device 2015 may include front surface 2020, rear surface 2025, and outer surface 2030.

Backing plate 2035 may be interposed between the accessory device 2015 and the wall 2000 when the dispenser 2005 is mounted to the wall 2000, and the accessory device 2015 is coupled to the backing plate 2035. In some examples, the backing plate 2035 includes a plurality of holes configured for mounting the backing plate 2035 to the wall 2000. In some examples, the backing plate 2035 is comprised of stainless steel. In some examples, the backing plate 2035 extends to a perimeter of the accessory device 2015 and the dispenser 2005 when the dispenser 2005, accessory device 2015 and the backing plate 2035 are mounted to the wall 2000.

In other words, backing plate 2035 may be coupled to the wall 2000, wherein when the accessory device 2015 is coupled to the wall 2000 the backing plate 2035 is interposed between the accessory device 2015 and the wall 2000 prior to coupling the accessory device 2015 to the wall 2000. In some examples, the backing plate 2035 extends to a perimeter of the accessory device 2015 and the dispenser 2005 when the dispenser 2005, accessory device 2015 and the backing plate 2035 are mounted to the wall 2000. Backing plate 2035 may be an example of, or include aspects of, the corresponding element or elements described with reference to FIG. 24.

Figure 29:
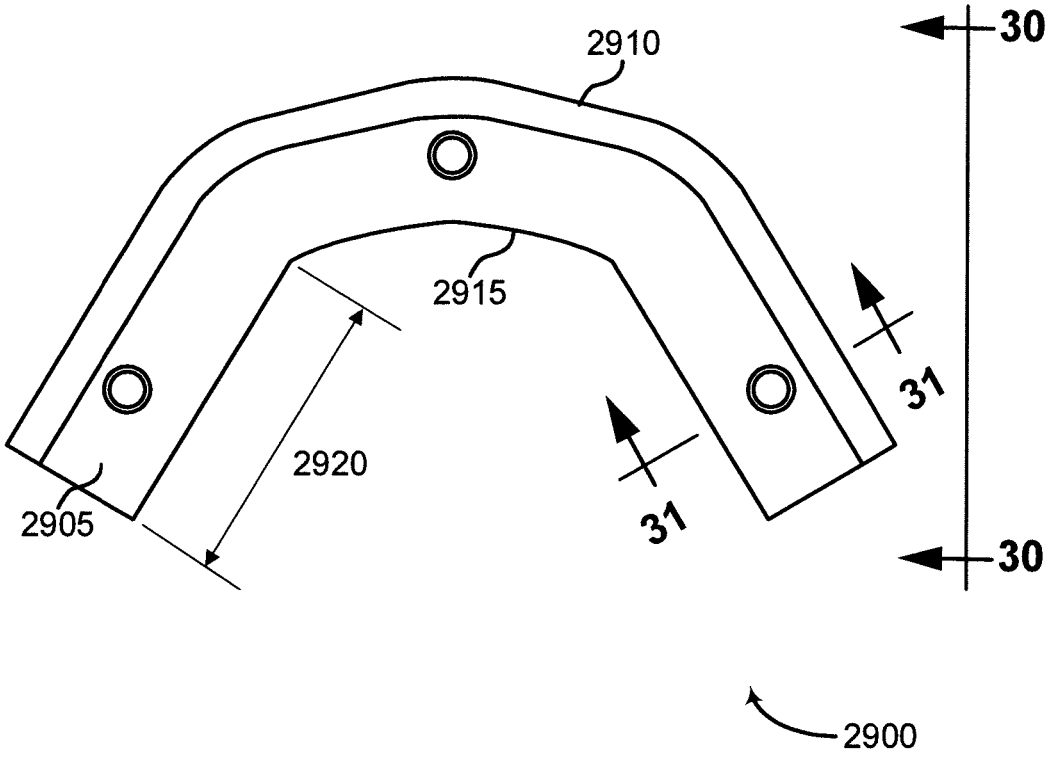
FIG. 29 shows an example of a front view of an accessory device in accordance with aspects of the present disclosure.

In the embodiment shown in FIG. 20 the backing plate 2035 (also referred to as the base plate) extends generally to the perimeter of the combined dispenser and accessory device perimeter. The backing plate 2035 and the accessory device 2015 may together comprise an accessory device system, for example as shown in FIG. 29.

The backing plate 2035 is interposed between the dispenser/accessory device and the wall 2000. The backing plate 2035 in some embodiments extends to the outer edges of the accessory device system without going beyond the perimeter of the dispenser 2005. In some embodiments the backing plate 2035 may extend beyond one or more perimeter edges of the dispenser 2035 and/or accessory device 2015. In some embodiments the backing plate 2035 may be a partial backing plate and not fully extend to the perimeter of the accessory device 2015 and/or dispenser 2005.

Figure 21:
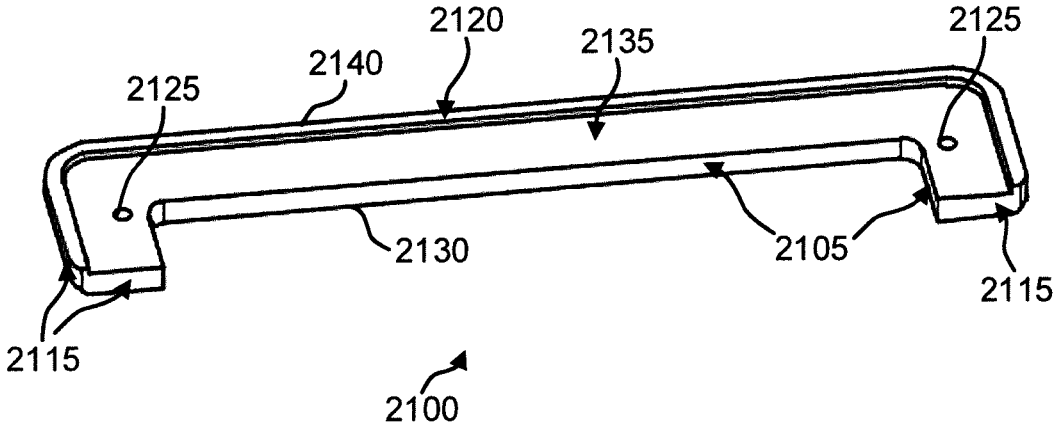
FIG. 21 shows an example of a rear perspective view of an accessory device in accordance with aspects of the present disclosure.

FIG. 21 shows an example of a back perceptive of an accessory device in accordance with aspects of the present disclosure. Accessory device 2100 may be an example of, or include aspects of, the corresponding element or elements described with reference to FIGS. 16, 17, 18, and 22-31. Accessory device 2100 may include underside surface 2105, front surface, outer surface 2115, rear lip surface 2120, fastener holes 2125, plate 2130, lip 2140, and rear surface 2135.

Accessory device 2100 may comprise a plate 2130 having a thickness and having the front underside (rear surface) 2105 and a front surface wherein the thickness is the distance between the rear surface 2105 and front surface, the lip 2120 further providing an additional thickness equal to a thickness of a plate that in practice is juxtaposed with the rear surface 2135 generally parallel to the rear surface 2135 and front surface, wherein the underside surface 2105 is shaped to generally match the top edge 1610, a portion of the left side edge 1625 proximate to the top edge, and a portion of the right side edge 1620 proximate to the top edge 1610, wherein when the dispenser 2205 is mounted to the wall 2200 and in the closed position, and the rear surface of the plate is generally parallel to and coupled to a wall. In one embodiment when the accessory device 2100 and the dispenser are mounted to the wall a gap between the dispenser top edge 1610 and the proximate underside surface 2105 (also referred to as the first gap) is no more than 2.5 mm (0.1 inches). In another embodiment each gap between the dispenser edges and the proximate underside surfaces 2105 is configured to allow for proper operation of the dispenser, i.e. the dispenser cover may open and close without interference with the accessory device 2100. In another embodiment each gap is equal to the minimum width required for proper operation of the dispenser. In another embodiment each gap is equal to the minimum width required for proper operation of the dispenser, plus an additional distance, for example, a 1 mm additional distance added to each minimum width to account for tolerances.

The lip 2140 has a thickness (depth) approximately equal to the thickness of a backing plate or a dispenser housing rear wall, and has a perimeter that extends beyond the cover top edge 1610, the portion of the cover left side edge 1625 proximate to the cover top edge 1610, and the portion of the cover right side edge 1620 proximate to the cover top edge 1610. As a result, the lip 2140 covers any gap between the accessory device 2110 and the backing plate (or housing rear wall) at the outer edges of the backing plate, eliminating a potential point of access, e.g., as a ligation point or pry point.

Figure 21A:
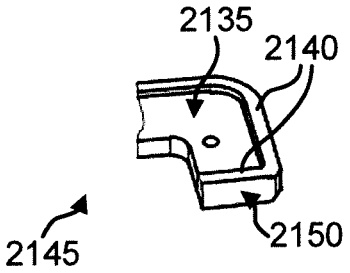
FIG. 21A shows an example of a partial rear perspective view of an accessory device in accordance with aspects of the present disclosure.

As shown in FIG. 21A, in an alternative embodiment an the lip 2140 includes an additional lip portion at the lower outer surface portion 2150. The lower edge of the backing plate or back plate rear wall extension is thereby covered.

Figure 22:
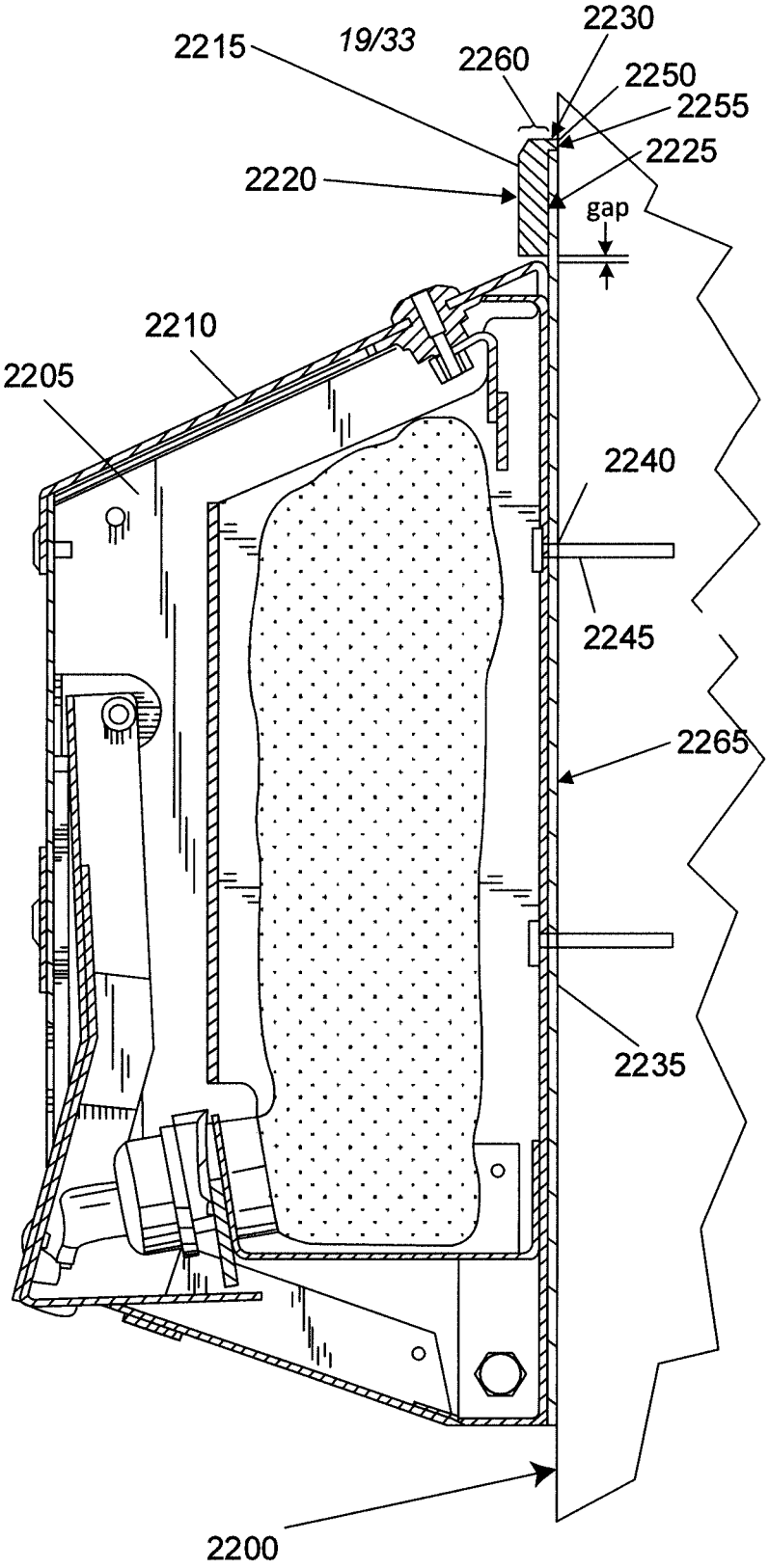
FIG. 22 shows an example of a section through a liquid dispenser with an accessory device and backing plate, all coupled to a wall in accordance with aspects of the present disclosure.

FIG. 22 shows an example of a section through a liquid dispenser with an accessory device and backing plate, all coupled to a wall in accordance with aspects of the present disclosure. The example shown includes wall 2200, liquid dispenser 2205, cover 2210, accessory device 2215, backing plate 2235, mounting holes 2240, fasteners 2245, lip 2250, plate 2260, and backing plate rear surface 2265. Liquid dispenser 2205 may be an example of, or include aspects of, the corresponding element or elements described with reference to FIGS. 1, 2, 13, 16, 17, 21-27, and 34-36.

Accessory device 2215 may include front surface 2220, rear surface 2225, outer surface 2230, lip 2250, and rear lip surface 2255. The rear lip surface 2255, as shown in FIG. 22, is generally parallel to the rear surface 2225. The accessory device 2215 comprises plate 2260, which has a thickness consisting of the distance between the front surface 2220 and the rear surface 2225. The lip 2330 further provides an additional thickness equal to the thickness of the backing plate 2235, whereby a front surface of the backing plate 2235 is juxtaposed with the rear surface and the rear lip surface 2255 is juxtaposed with the wall 2200 surface, i.e. the rear lip surface 2255 is generally in the same plane as the backing plate rear surface 2265.

Backing plate 2235 may be interposed between the accessory device 2215 and the wall 2200 when the dispenser 2205 is mounted to the wall 2200, and the accessory device 2215 is coupled to the backing plate 2235. The lip 2250 overlaps an edge of the backing plate 2235, blocking access to the interface between the backing plate 2235 and the accessory device 2215. In some examples, the backing plate 2235 includes a plurality of holes 2240 configured for mounting the backing plate 2235 to the wall 2200. In some examples, the backing plate 2235 is comprised of stainless steel. In some examples, the backing plate 2235 extends to a perimeter of the accessory device 2215 and the dispenser 2205 when the dispenser 2205, accessory device 2215 and the backing plate 2035 are mounted to the wall 2200.

In other words, backing plate 2235 may be coupled to the wall 2200, wherein when the accessory device 2215 is coupled to the wall 2200 the backing plate 2235 is interposed between the accessory device 2215 and the wall 2200 prior to coupling the accessory device 2215 to the wall 2200. In some examples, the backing plate 2235 extends to a perimeter of the accessory device 2215 and the dispenser 2205 when the dispenser 2205, accessory device 2215 and the backing plate 2235 are mounted to the wall 2200. Backing plate 2235 may be an example of, or include aspects of, the corresponding element or elements described with reference to FIG. 28.

In the embodiment shown in FIG. 22 the backing plate 2235 (also referred to as the base plate) extends generally to the perimeter of the combined dispenser and accessory device lip 2250 interior perimeter. The backing plate 2235 and the accessory device 2215 may together comprise an accessory device system, for example as shown in FIG. 22.

The backing plate 2235 is interposed between the dispenser/accessory device 2205/2215 and the wall 2200. The backing plate 2235 in some embodiments extends to the outer edges of the accessory device system without going beyond the perimeter of the dispenser 2205. In some embodiments the backing plate 2235 may extend beyond one or more perimeter edges of the dispenser 2235 and/or accessory device 2215. In some embodiments the backing plate 2235 may be a partial backing plate and not fully extend to the perimeter of the accessory device 2215 and/or dispenser 2205.

In some embodiments the lip 2250 has a width (i.e. the generally vertical dimension of the lip 2250 when the accessory device 2215 is coupled to the wall 2200) greater than the lip 2250 thickness. In other embodiments the lip 2250 has a width generally equal to the lip 2250 thickness. In yet other embodiments the lip 2250 has a width less than the lip 2250 thickness.

Figure 23:
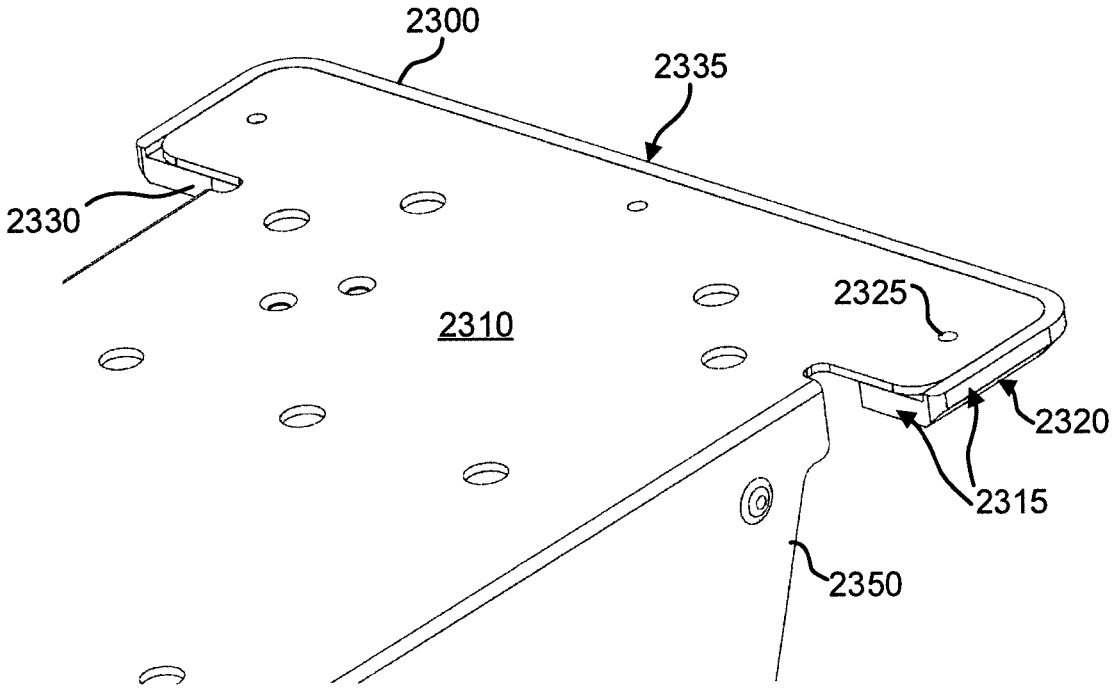
FIG. 23 shows an example of a rear perspective view of an accessory device and dispenser back housing in accordance with aspects of the present disclosure.

FIG. 23 shows an example of a back perceptive of an accessory device 2300 and backing plate 2350 in accordance with aspects of the present disclosure. Accessory device 2300 may be an example of, or include aspects of, the corresponding element or elements described with reference to FIGS. 16, 17, 18, and 22-36. Accessory device 2300 may include underside surface, front surface, backing plate rear surface 2310, outer surface 2315, fastener holes 2325, lip 2330, and rear lip surface 2335.

Accessory device 2300 may comprise a plate 2330 having a thickness and having the front underside (rear surface) and the front surface wherein the thickness is the distance between the rear surface and front surface, the lip 2330 further providing an additional thickness equal to a thickness of the backing plate 2350, a portion of which is juxtaposed with a rear surface of the accessory device 2300, wherein an underside surface of the accessory is shaped to generally match the upper edges of the dispenser when the dispenser 2205 is mounted to the wall 2200 and in the closed position (as shown in FIG. 22), and the backing plate rear surface 2310 is generally parallel to and coupled to a wall.

The lip 2330 has a thickness (depth) approximately equal to the thickness of the backing plate 2350, 1650, and has a width that extends beyond the dispenser top edge 1610, the portion of the left side edge 1625 proximate to the top edge 1610, and the portion of the right side edge 1620 proximate to the top edge 1610. As a result, the lip 2330 covers any gap between the accessory device 2310 and the backing plate 2350, eliminating a potential point of access, e.g., as a ligation point or pry point.

Figure 24:
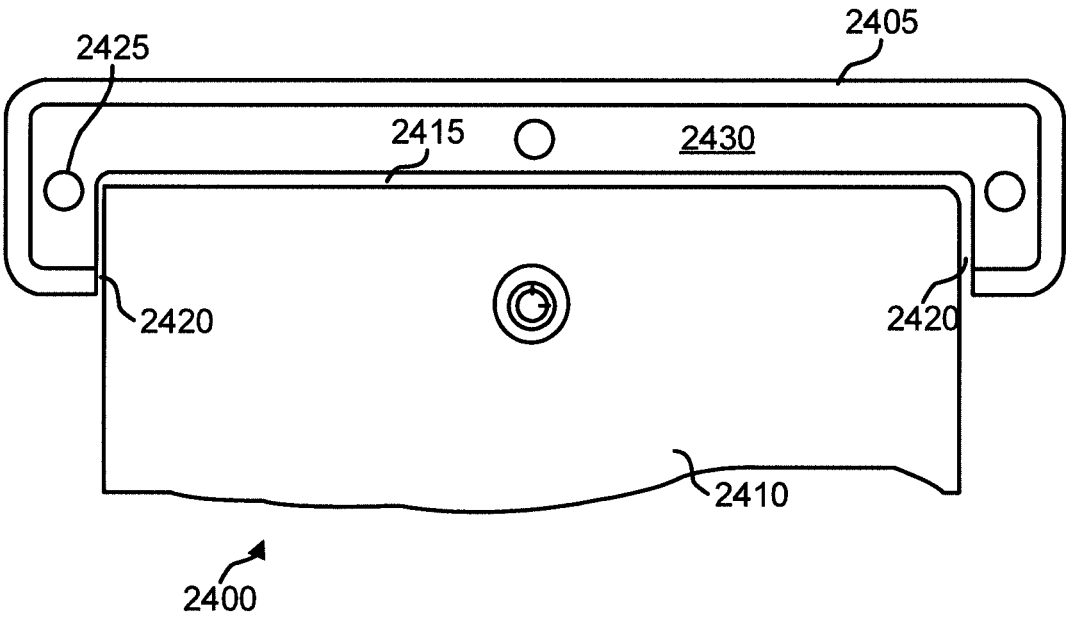
FIG. 24 shows an example of a front view of an accessory device and a liquid dispenser mounted on a wall in accordance with aspects of the present disclosure.

FIG. 24 shows an example of a front view of an accessory device and a liquid dispenser mounted on a wall in accordance with aspects of the present disclosure. The example shown includes liquid dispenser 2400, accessory device 2405, cover 2410, top gap 2415, and side gaps 2420.

Liquid dispenser 2400 may be an example of, or include aspects of, the corresponding element or elements described with reference to FIGS. 1, 2, 13, 16, 17, 20, 24, and 25.

Accessory device 2405 may be an example of, or include aspects of, the corresponding element or elements described with reference to FIGS. 17-20, and 25-30.

Accessory device 2405 may include front surface 2430 and may be separated from the liquid dispenser 2400 by gaps 2415, 2420. The top gap 2415 (also referred to as the first gap) is the clear distance between the top edge of the dispenser 2300 (also shown as gap 2050 of FIG. 20) and the accessory device 2305, and the side gaps 2320 (also referred to as the second gap and the third gap) is the clear distance between the side of the dispenser 2300 and the accessory device 2305. In some examples, the side gaps 2320 and the top gap 2415 are the same size. In some examples, the size of top gap 2415 is configured to prevent prying of the top edge 1610 of the dispenser 2400. In some embodiments the width of the top gap 2415 is configured to prevent wedging of a ligation material in the top gap 2415. In some embodiments, the top gap 2415 is no more than 2.5 mm (0.1 inches) wide. In some embodiments the top gap 2415 is no more than 1 mm (0.04 inches) wide. In some embodiments the width of the side gaps 2420 are configured to prevent wedging of a ligation material in each of the side gaps 2420. In some embodiments the In some embodiments the top gap 2415 is no more than 0.5 mm (0.02 inches) wide. In some embodiments side gaps 2420 are each no more than 2.5 mm (0.1 inches) wide. In some embodiments the side gaps 2420 are each no more than 1 mm (0.04 inches) wide. In some embodiments the side gaps 2420 are each no more than 0.5 mm (0.02 inches) wide. In some embodiments the side gaps 2420 are configured to prevent opening of the dispenser 2400 when the accessory device 2105 is mounted to the wall above the dispenser 2400, the dispenser 2400 is closed and locked, and a lateral blow is applied to the dispenser 2400.

In some embodiment each gap 2415 2420 is equal to the minimum width required for proper operation of the dispenser 2400. In another embodiment each gap is equal to the minimum width required for proper operation of the dispenser 2400, plus an additional distance, for example, a 1 mm additional distance added to each minimum width to account for tolerances.

Thus, the accessory device 2405 prevents prying of the dispenser 2400 at the top corners (the intersection of the top edge 1610 with the right side edge 1620 and the left side edge 1625) to open it. It also creates a protective barrier where a string or cut sheet cannot be caught by the top corners.

The accessory device 2405 may be a 3D part that holds the dispenser cover 2410 in place during extreme impact from either side. It also protects the dispenser cover 2410 from prying open as there is always some slop/leeway when locking the cover 2410. The accessory device 2405 is a solid plate that prevents tools being used successfully to damage the dispenser.

The accessory device 2405 may be a separate piece placed over the dispenser and have the same effectiveness or attached built into the dispenser.

The accessory device 2405 can be used on any dispenser that is in an environment where dispensers of any type can be tampered with or where suicidal patients live or are treated. While an exemplary liquid soap dispenser is shown, it will be understood that the accessory device may be modified for use with any similarly-configured wall-mounted dispenser, such as a wall-mounted paper towel dispenser or a toilet paper dispenser.

The accessory device 2405 not only adds to the ligation protection but also supports the dispenser from lateral blows as it will stop the cover 2410 from extending to the left or the right. It also protects that dispenser 2400 from being pried open. The accessory device 2405 may come in a variety of shapes and sizes for different equipment. The accessory device 2405 is adaptable for many different dispenser perimeter shapes.

The accessory device 2405 prevents vandalism by preventing someone from pushing the cover 2410 to one side where the lock is and making a gap. The gap can be used to put a shoelace in and create a noose for suicide, or a gap where the dispenser's security is compromised. That is why the accessory device 2405 comes down and surrounds some of the sides of the dispenser 2400.

The accessory device 2405 also limits lateral flexing of the cover 2410. Without the accessory device, if the top portion of the dispenser is hit hard enough in a lateral direction (i.e. parallel to the wall), the cover 2400 could flex so that the cam lever 706 of the locking mechanism 106 would slip off the latch plate 312. As a result, the dispenser cover 2410, no longer secured by the locking mechanism 106, would be freed and rotate downward into the open position. With the accessory device 2405 installed, the cover 2400 can only move laterally the distance the side gap 2420 before contacting the proximate underside surface 1810, which stops the lateral movement of the dispenser. With the eyebrow, any lateral force is absorbed by the inside of the inside surface 1810 of the accessory device so there is no excessive flexing of the dispenser and no popping open of the dispenser cover 2410. In one embodiment the eyebrow thickness and/or side gaps 1810 are configured such that the dispenser remains closed when the dispenser cover is locked and a lateral blow is applied to the dispenser.

Another embodiment contemplated herein is to create a thicker accessory device which does all the same functions but can also work as a water shield or water fall diverting the shower water, where these are often placed, from pouring directly into the lock.

One of the challenges of a tamper-proof dispenser is maintaining the dispenser integrity long term in use. When a dispenser is struck, it can tweak the dispenser so the lock does not engage or engage properly. When this happens the dispenser is vulnerable. The accessory device 2405 aids in maintaining the dispenser 2400 and making it less vulnerable to damage.

Figure 25:
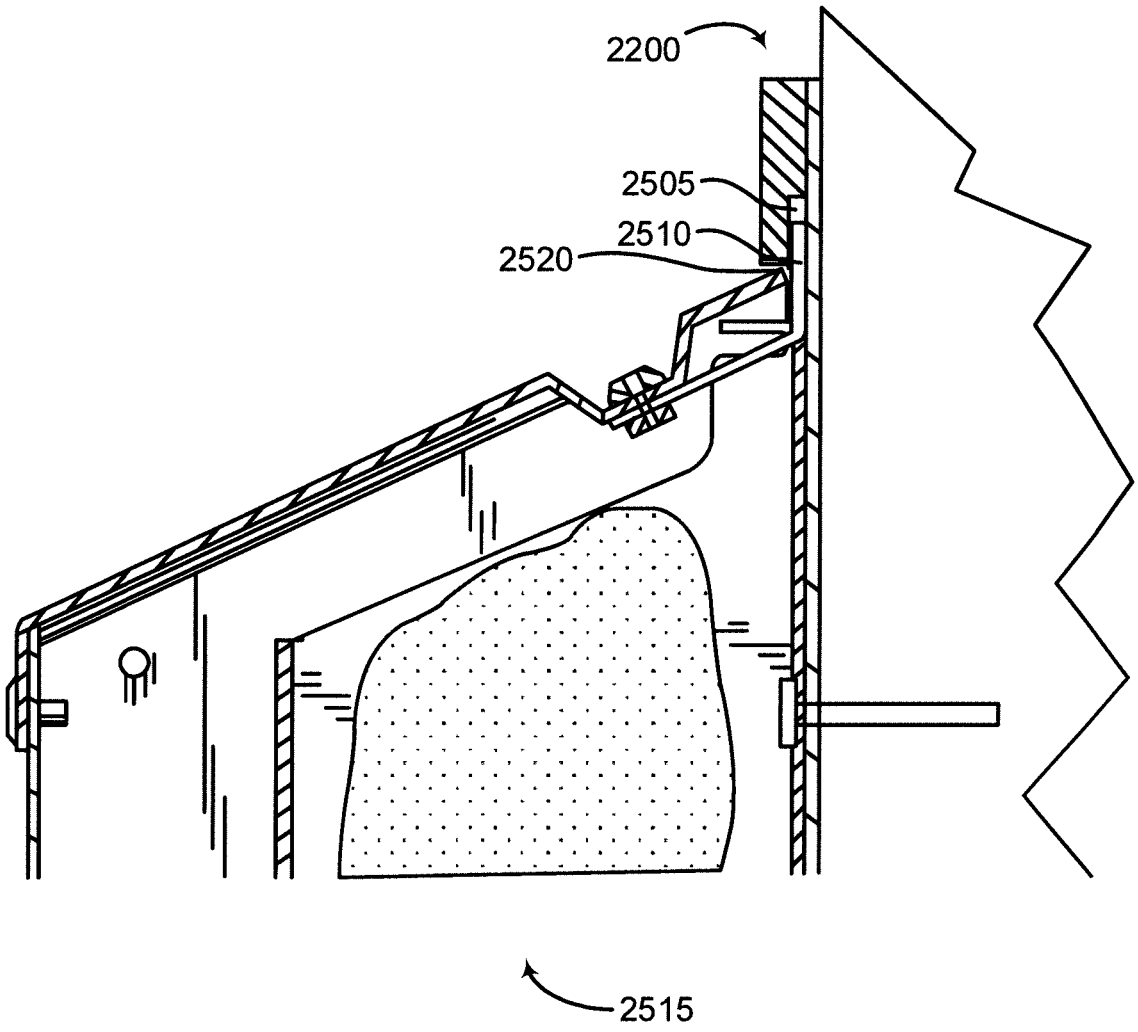
FIG. 25 shows an example of an accessory device with a cam slot in accordance with aspects of the present disclosure.

FIG. 25 shows an example of an accessory device with a cam slot in accordance with aspects of the present disclosure. The example shown includes accessory device 2500, cam slot 2505, cam lock 2510, liquid dispenser 2515, and top edge 2520. In some embodiments the accessory device 2500 may include the underside cam slot 2505 proximate to the top edge 2520 of the dispenser 2515 for receiving the cam lock 2510 for a tight fit at the best possible placement.

Figure 26:
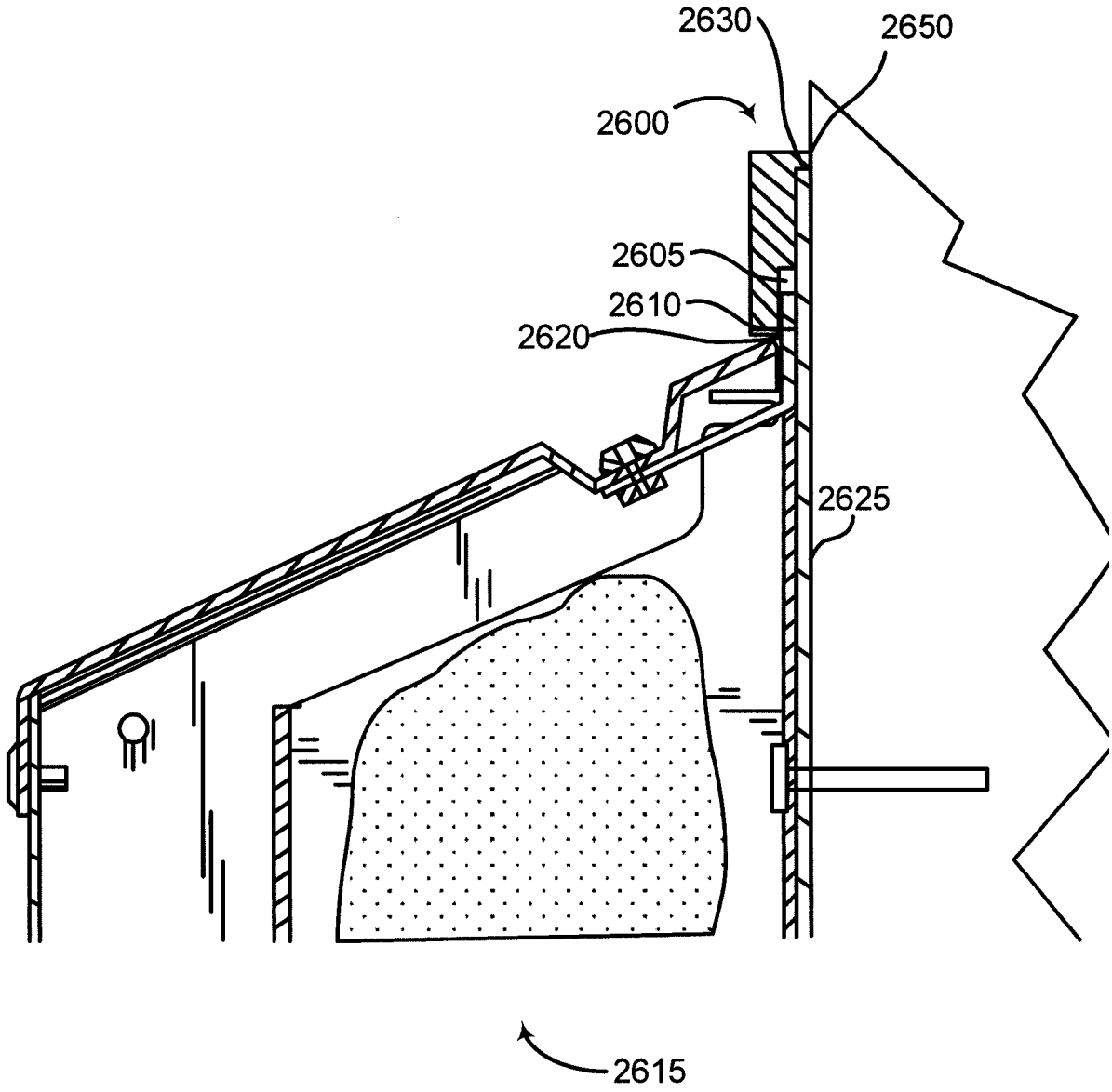
FIG. 26 shows another example of an accessory device with a cam slot in accordance with aspects of the present disclosure.

FIG. 26 shows an example of an accessory device with a cam slot in accordance with aspects of the present disclosure. The example shown includes accessory device 2600, cam slot 2605, cam lock 2610, liquid dispenser 2615, backing plate 2625, cover top edge 2620, and backing plate top edge 2630. In some embodiments the accessory device 2600 may include the underside cam slot 2605 proximate to the top edge 2620 of the dispenser 2615 for receiving the cam lock 2610 for a tight fit at the best possible placement. In some embodiments the accessory device 2610 may include lip 2650 that overlaps the top edge 2630 of the backing plate 2625.

Figure 27:
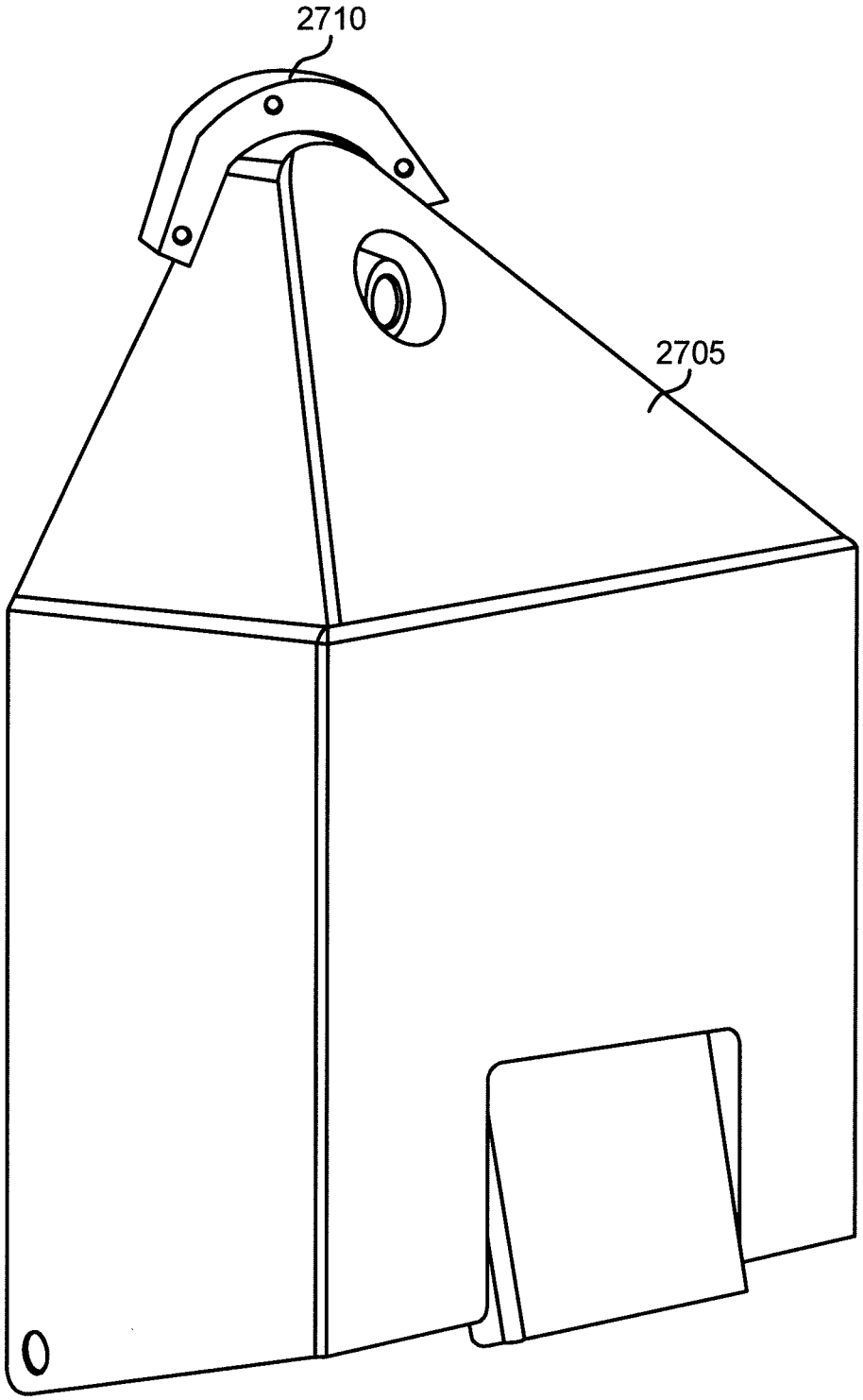
FIG. 27 shows an example of an accessory device for a liquid dispenser with a pyramidal cover in accordance with aspects of the present disclosure.

FIG. 27 shows an example of an accessory device for a dispenser with a pyramidal shape in accordance with aspects of the present disclosure. The example shown includes pyramidal dispenser 2700, cover 2705, and accessory device 2710.

Pyramidal dispenser 2700 may be an example of, or include aspects of, the corresponding element or elements described with reference to FIGS. 1, 2, 13, 16, 17, 20, 22, and 25-26. Pyramidal dispenser 2700 may include cover 2705. Accessory device 2710 may be an example of, or include aspects of, the corresponding element or elements described with reference to FIGS. 17-26, and 28-31.

The accessory device 2710 may include curved top portions or a plurality of straight portions over a dispenser design whose top cover 2705 is a pyramidal shape with a curved top edge, a narrow top portion and angled side edges, as shown in FIG. 27. The accessory device 2405 may be fastened directly to the wall as shown in FIG. 27, or in the embodiment of FIG. 24, the accessory device 2405 is coupled to a partial backing plate 2400 that does not cover the entire back of the dispenser, and the partial back plate 2400 is fastened to the wall.

Figure 28:
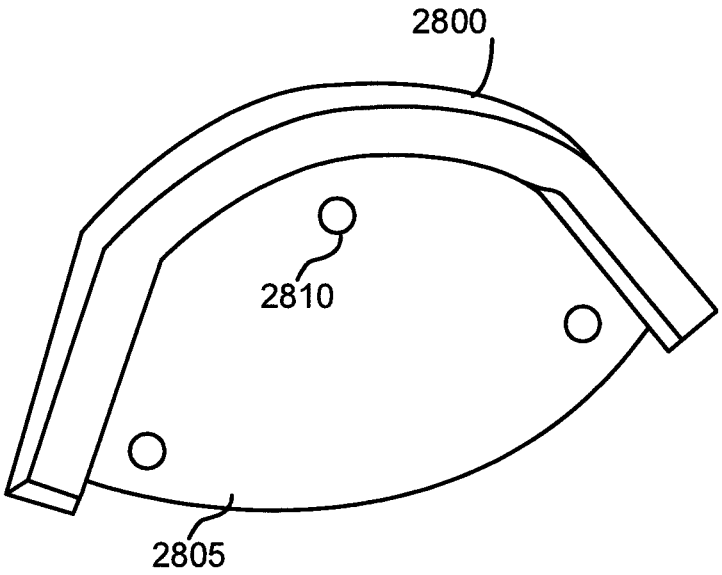
FIG. 28 shows an example of an accessory device for a liquid dispenser, with a partial backing plate in accordance with aspects of the present disclosure.

FIG. 28 shows an example of an accessory device 2800 for a dispenser, with a partial backing plate 2805 in accordance with aspects of the present disclosure. The example shown includes accessory device 2800, backing plate 2805, and mounting holes 2810.

Accessory device 2800 may be an example of, or include aspects of, the corresponding element or elements described with reference to FIGS. 17-26, and 28-31. Backing plate 2805 may be an example of, or include aspects of, the corresponding element or elements described with reference to FIGS. 20 and 22.

FIG. 29 shows an example of a front view of an accessory device 2900 in accordance with aspects of the present disclosure. Accessory device 2900 may be an example of, or include aspects of, the corresponding element or elements described with reference to FIGS. 17-26, and 28-31. Accessory device 2900 may include front surface 2905, outer surface 2910, underside surface 2915, and underside side portion length 2920.

Figure 30:
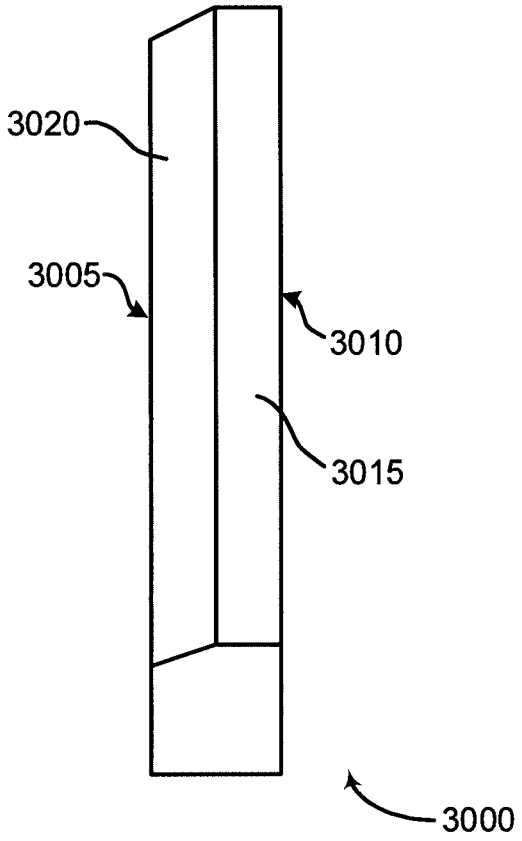
FIG. 30 shows an example of a side view of an accessory device in accordance with aspects of the present disclosure.

FIG. 30 shows an example of a side view of an accessory device 3000 in accordance with aspects of the present disclosure. Accessory device 3000 may be an example of, or include aspects of, the corresponding element or elements described with reference to FIGS. 17-26, and 28-31. Accessory device 3000 may include front surface 3005, rear surface 3010, outer surface 3015, and chamfered edge 3020.

Figure 31:
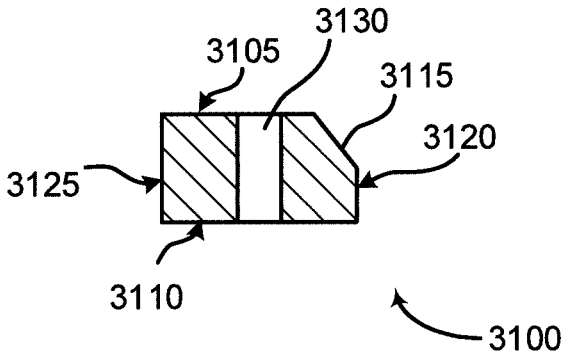
FIG. 31 shows an example of a section of an accessory device in accordance with aspects of the present disclosure.

FIG. 31 shows an example of a section of an accessory device 3100 in accordance with aspects of the present disclosure. Accessory device 3100 may be an example of, or include aspects of, the corresponding element or elements described with reference to FIGS. 17-30. Accessory device 3100 may include front surface 3105, rear surface 3110, chamfered edge 3115, outer surface 3120, underside surface 3125, and mounting hole 3130.

Figure 32:
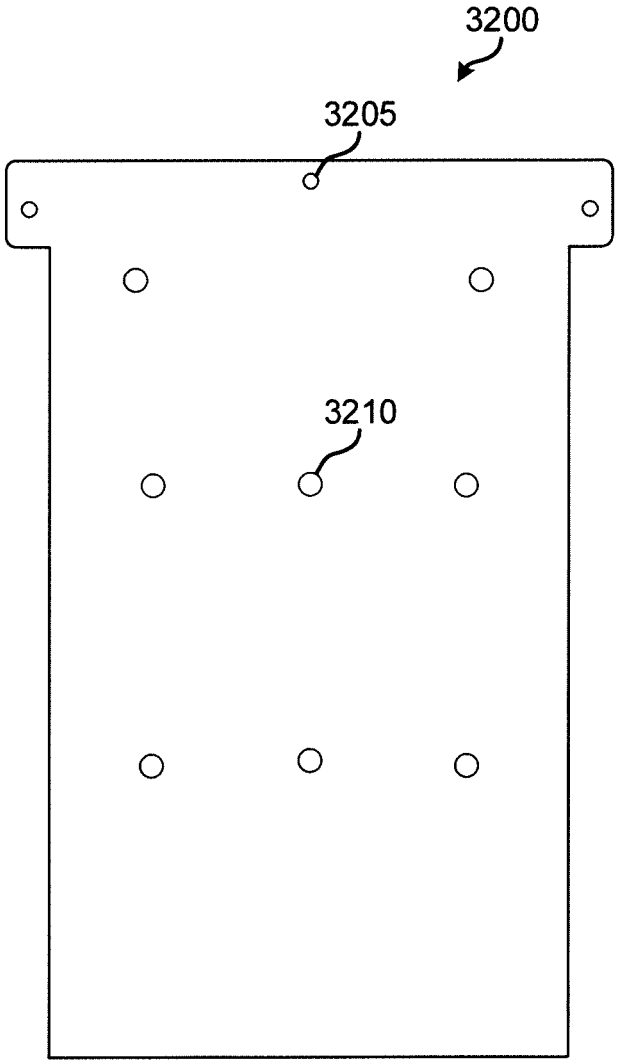
FIG. 32 shows an example of a front elevation of a backing plate in accordance with aspects of the present disclosure.

FIG. 32 shows an example of a front elevation of a backing plate 3200 in accordance with aspects of the present disclosure. Backing plate 3200 may be an example of, or include aspects of, the corresponding element or elements described with reference to FIGS. 20, 22, 23, 25, and 26.

The backing plate 3200 may include a plurality of accessory device mounting holes 3205 configured for receiving fasteners to couple the backing plate 3200 to the accessory device. The backing plate 3200 may include a plurality of dispenser mounting holes 3210 configured for receiving fasteners to couple the backing plate to the dispenser and/or the wall, such as shown in FIG. 20. The holes 3205, 3210 may be configured for security anchors that can't be removed without a specialized tool, such as a security screw that has a star shape in the head so a dime can't be used to unscrew the fastener.

Figure 33:
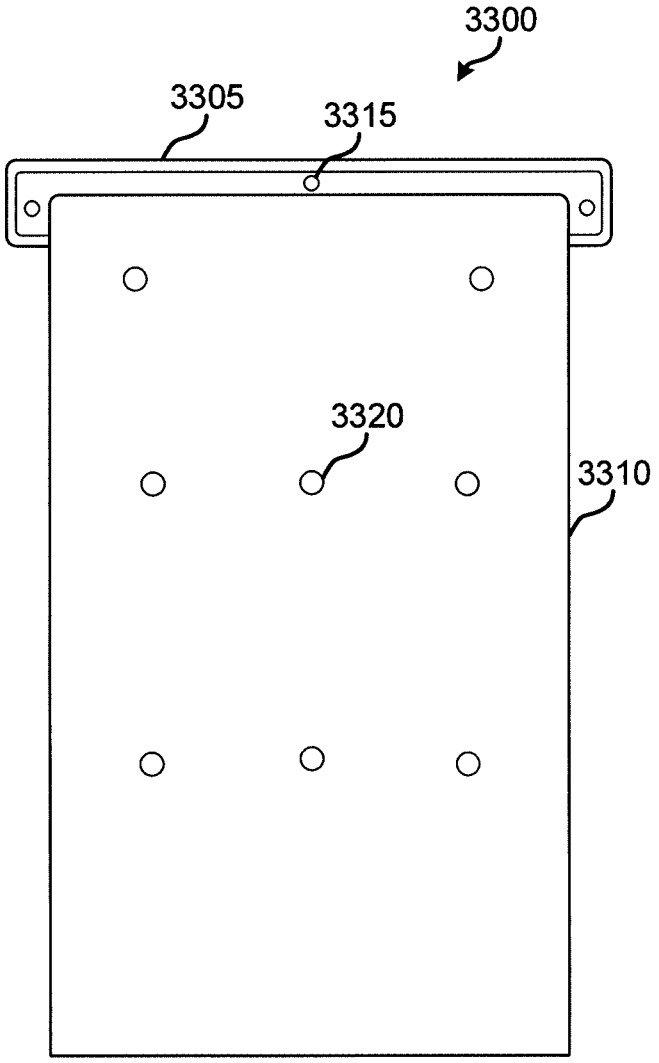
FIG. 33 shows an example of a front elevation of an accessory device system in accordance with aspects of the present disclosure.

FIG. 33 shows an example of a front elevation of an accessory device system 3300 in accordance with aspects of the present disclosure.

The accessory device system 3300 comprises an accessory device 3305 and a backing plate 3305. The accessory device system 3300 may be installed at the same time as the dispenser. A plurality of mounting holes 3320 in the backing plate match installation holes in the back plate of the dispenser. The holes 3320 in the backing plate 3310 are aligned with the holes in the back plate. Fasteners through both holes are installed into the wall, thus fastening both the dispenser and the accessory device system 3300 to the wall. The accessory device 3305 may be welded or bolted to the backing plate 3310. In the example shown in FIG. 33, the accessory device 3305 is coupled to the backing plate 3310 with fasteners 3315. The fasteners 3315 in the embodiment shown are flush with the front surface of the accessory device 3305 to prevent tampering and serve to permanently attach the accessory device 2905 to the backing plate 3310.

Figure 34:
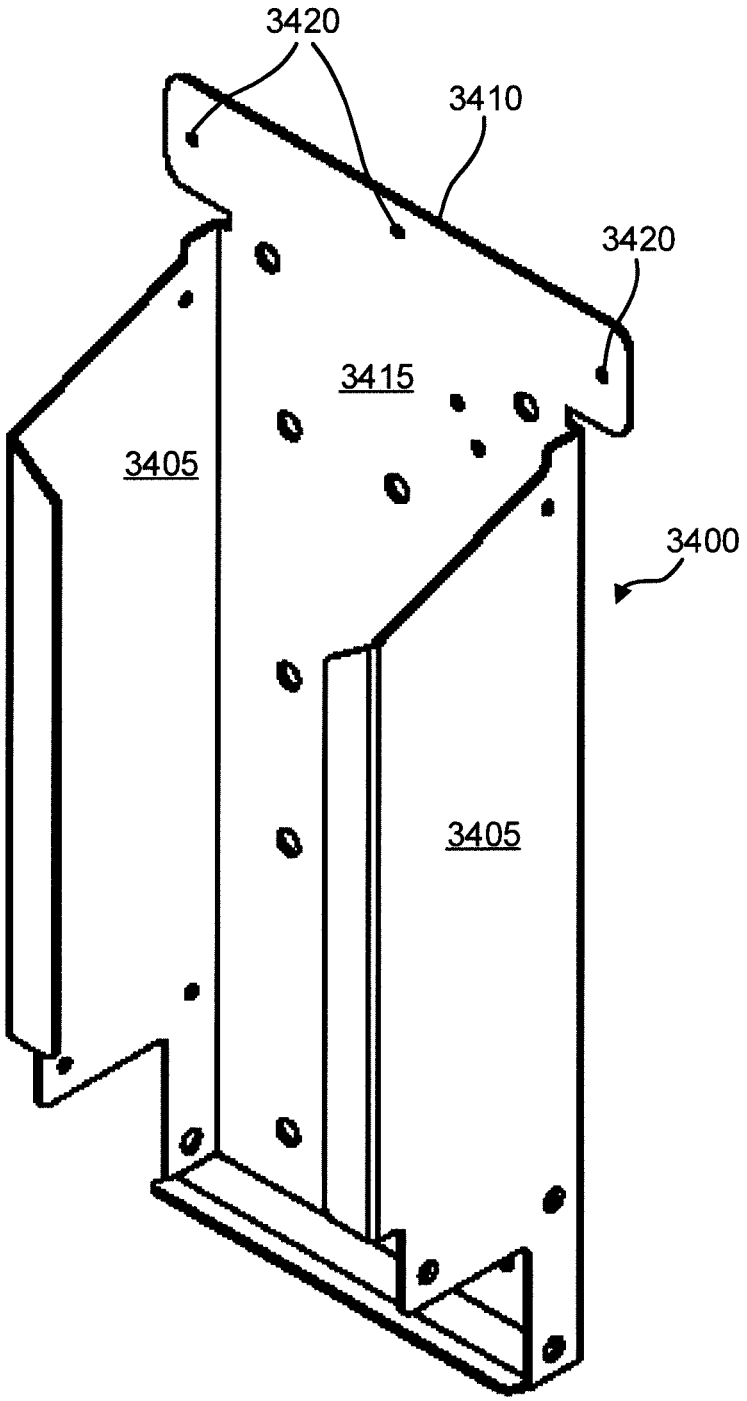
FIG. 34 shows a perspective view of a back housing of a liquid dispenser in accordance with aspects of the present disclosure.

Referring next to FIGS. 34-37, another embodiment of an accessory device system is shown. FIG. 34 shows a perspective view of a back housing 3400 of the liquid dispenser in accordance with another embodiment of the present invention. Back housing 3400 may be an example of, or include aspects of, the corresponding element or elements described with reference to FIGS. 2, 3, 13, 20 and 23.

Figure 35:
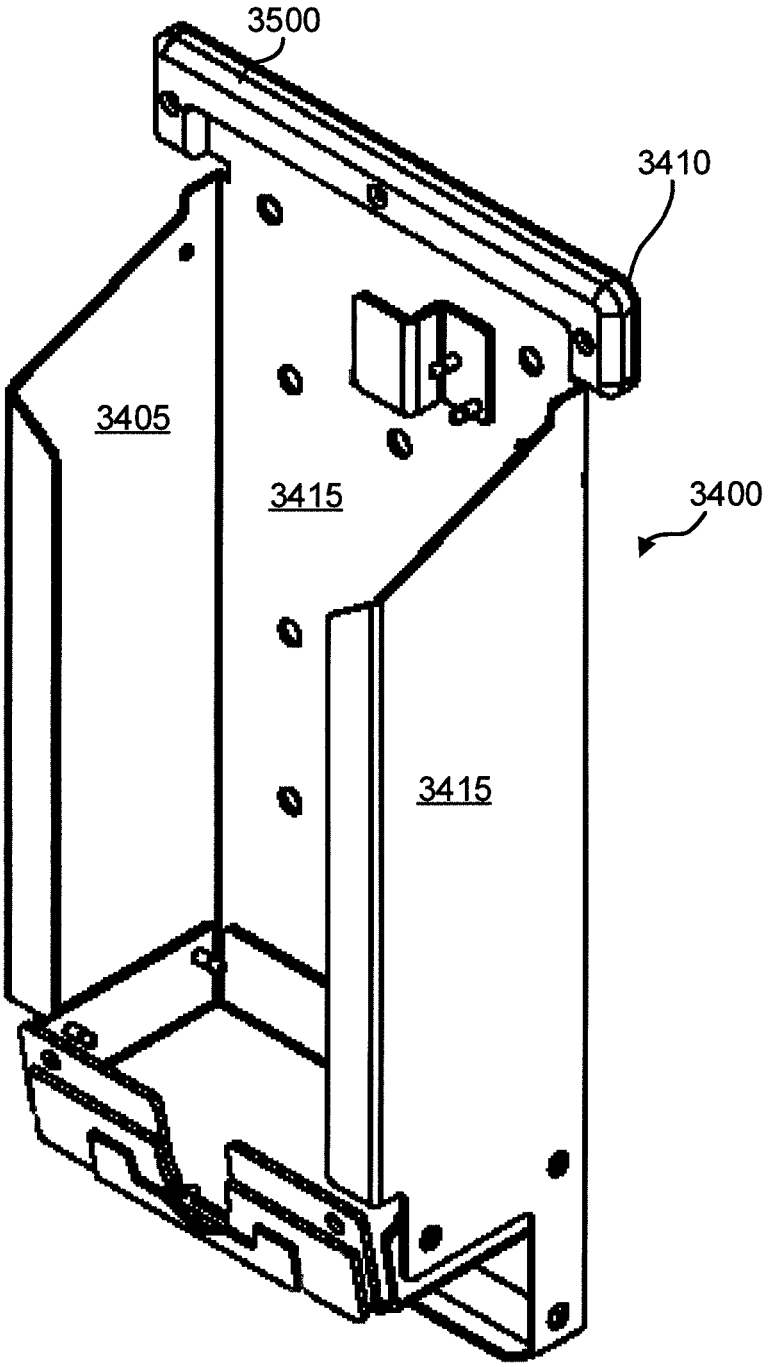
FIG. 35 shows a perspective view of a back housing of a liquid dispenser with an accessory device in accordance with aspects of the present disclosure.

FIG. 35 shows a perspective view of the back housing of the liquid dispenser with an accessory device 3500 in accordance with aspects of the present disclosure. Accessory device 3500 may be an example of, or include aspects of, the corresponding element or elements described with reference to FIGS. 17-35.

Figure 36:
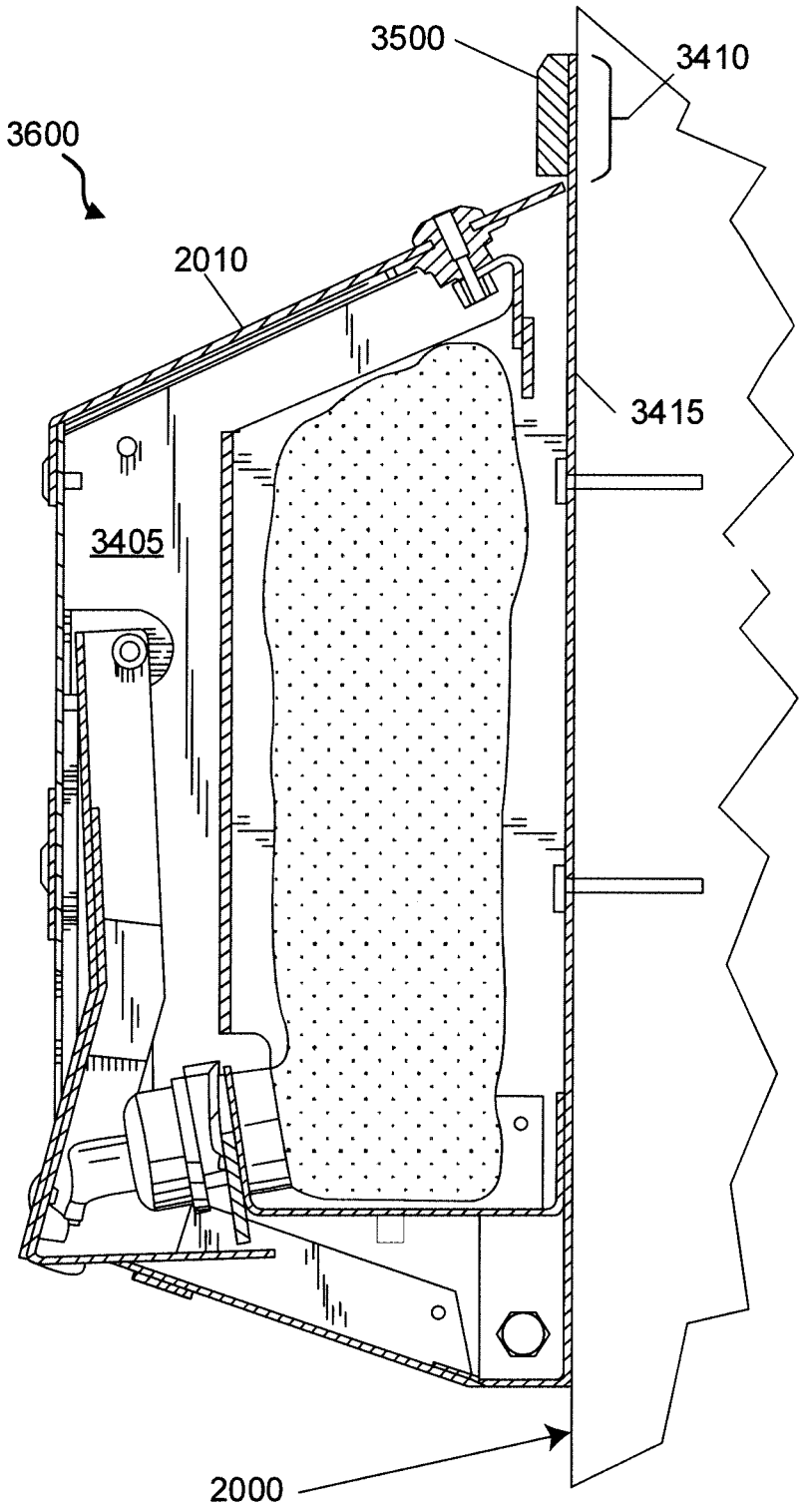
FIG. 36 shows an example of a section through a liquid dispenser with an accessory device, both coupled to a wall in accordance with aspects of the present disclosure.

FIG. 36 shows an example of a section through a liquid dispenser 3600 with the accessory device 3500 and the back housing 3400 of FIGS. 34 and 35, coupled to the wall 2000 in accordance with aspects of the present disclosure. Liquid dispenser 3600 may be an example of, or include aspects of, the corresponding element or elements described with reference to FIGS. 1-10, 13-17, 20, and 22-27.

In another embodiment of the present invention, instead of an upper edge of a back plate rear wall 3415 including the back plate top flange 308 extending outward from the back plate rear wall 3415 (as previously shown in FIG. 3), the back plate rear wall 3415 of the back housing 3400 may extended upward to form a back plate rear wall extension 3410. The shape of the back plate rear wall extension 3410 matches the extent of the accessory device to be attached to the back plate rear wall extension 3410. The back plate rear wall extension 3410 includes a plurality of holes 3420 located to align with corresponding holes in the accessory device, so that fasteners may be used to couple the accessory device 3500 to the back plate rear wall extension 3410.

FIG. 35 shows the back plate housing 3400 with the accessory device 3500 coupled to the back plate rear wall extension 3410.

FIG. 36 shows how the back plate rear wall extension 3410 provides a single integral plate that forms both the back side of the dispenser and the attachment point for the the accessory device 3500. In this way the accessory device 3500 may be attached directly to the liquid dispenser itself and the backing plate is not needed.

Figure 37:
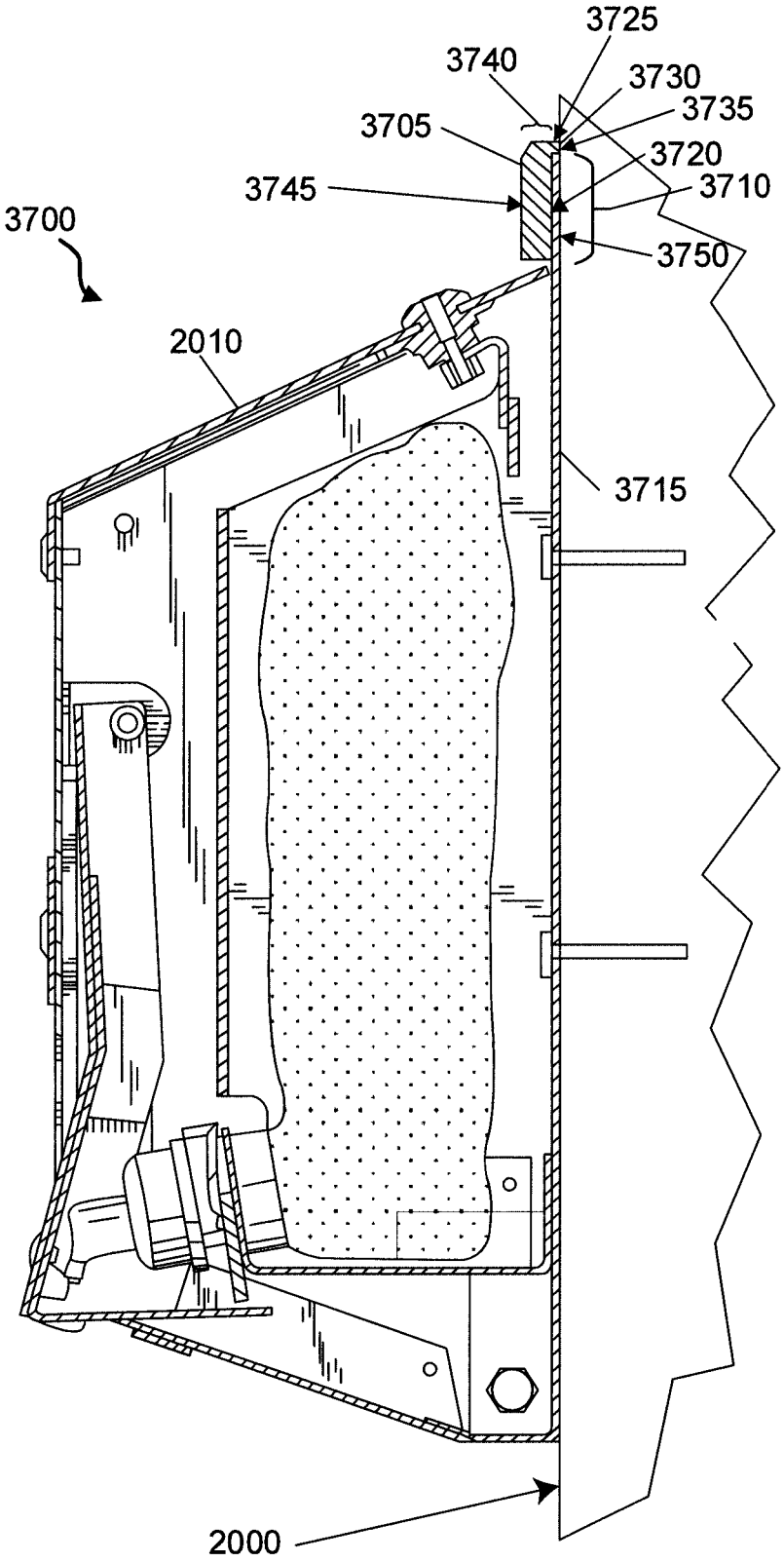
FIG. 37 shows an example of a section through a liquid dispenser with an accessory device, coupled to a wall in accordance with aspects of the present disclosure.

Referring next to FIG. 37, an example of a section through a liquid dispenser with an accessory device, coupled to a wall in accordance with aspects of the present disclosure is shown.

FIG. 37 illustrates the embodiment with the back plate housing including a back plate rear wall extension in accordance with the lipped accessory device embodiment shown in FIGS. 21-23, and 26. Shown are a liquid dispenser 3700 including the cover 2010, a back plate rear wall extension 3710, and a rear wall 3715.

Accessory device 3705 coupled to the back plate rear wall extension 3710 may include front surface 3745, rear surface 3720, outer surface 3725, lip 3730, and rear lip surface 3735. The rear lip surface 3735, as shown in FIG. 37, is generally parallel to a back plate rear wall extension rear surface 3750. The accessory device 3705 comprises plate 3740, which has a thickness consisting of the distance between the front surface 3745 and the rear surface 3720. The lip 3730 further provides an additional thickness equal to a thickness of the back plate rear wall extension 3710, whereby a front surface of the back plate rear wall extension 3710 is juxtaposed with the rear surface 3720 and the rear lip surface 3735 is juxtaposed with the wall 2200 surface, i.e. the rear lip surface 3735 is generally in the same plane as the back plate rear wall extension rear surface 3750.

Similarly to FIG. 22, the lip 3730 overlaps an edge of the back plate rear wall extension 3710, blocking access to the interface between the back plate rear wall extension 3710 and the accessory device 3740.

In the embodiment shown in FIG. 37 the back plate rear wall extension 3710 extends generally to the accessory device lip 3730 interior perimeter.

While the invention herein disclosed has been described by means of specific embodiments, examples and applications thereof, numerous modifications and variations could be made thereto by those skilled in the art without departing from the scope of the invention set forth in the claims.

What is claimed is:

1. An accessory device for a dispenser configured to mount to a generally vertical surface, the dispenser having a back housing including a back plate rear wall wherein the back plate rear wall is parallel to and juxtaposed with the generally vertical surface when the dispenser is mounted to the generally vertical surface, the dispenser further having a cover pivotally coupled to a bottom of the back housing such that the cover automatically rotates outward and downward from the generally vertical surface to an open position when the dispenser is mounted to the generally vertical surface, wherein the cover in a closed position has a perimeter edge proximate to the generally vertical surface, the perimeter edge including a cover top edge interposed between and continuous with a cover left side edge and a cover right side edge, the back plate rear wall further comprising a back plate rear wall extension extending past the cover top edge, a portion of the cover left side edge and a portion of the cover right side edge when the cover is in the closed position, the back plate rear wall extension having a top extension edge, a left extension edge, and a right extension edge, the accessory device comprising:

a plate having a front surface and a rear surface, wherein a thickness of the plate is a distance between the front surface and the rear surface, the accessory device configured to couple to the back plate rear wall extension such that the rear surface is juxtaposed with a front surface of the back plate rear wall extension; and a lip extending rearward from a portion of a perimeter of the plate, the lip providing an additional thickness equal to a thickness of the back plate rear wall extension, wherein the accessory device is configured such that when the accessory device is coupled to the back plate rear wall extension the lip covers the top extension edge, the left extension edge, and the right extension edge, the plate further having an underside surface generally normal to the front surface and rear surface, the plate further having an outer surface generally normal to the front surface and the rear surface and excluding the underside surface, wherein the underside surface is shaped to generally match the cover top edge, a portion of the cover left side edge proximate to the cover top edge, and a portion of the cover right side edge proximate to the cover top edge, wherein when the accessory device is coupled to the back plate rear wall extension and the dispenser is mounted to the generally vertical surface and in the closed position, a first gap exists between the underside surface and the cover top edge, a second gap exists between the underside surface and the cover left side edge, a third gap exists between the underside surface and the cover right side edge, wherein each gap is configured such that the dispenser is able to be opened and closed when the dispenser is mounted to the generally vertical surface, whereby when the accessory device is coupled to the dispenser and the dispenser is mounted to the generally vertical surface lodging of ligation material between the accessory device and the dispenser is prevented.

2. The accessory device of claim 1, wherein the plate thickness is at least 5 mm (0.20 inches).

3. The accessory device of claim 1 further comprising a plurality of fastener holes through the plate thickness.

4. The accessory device of claim 1, further comprising a normal distance between the underside surface and the outer surface of at least 13 mm.

5. The accessory device of claim 1, wherein the first gap is no more than 2.5 mm (0.1 inches).

6. The accessory device of claim 1, wherein the underside surfaces matching the portion of the cover left side edge and the portion of the cover right side edge are each at least 15 mm (0.6 inches) long.

7. The accessory device of claim 1, wherein the second gap and the third gap are configured to prevent opening of the dispenser when the accessory device is coupled to the back plate rear wall extension and the dispenser is mounted to a generally vertical surface, the dispenser is closed and locked, and a lateral blow is applied to the dispenser.

8. The accessory device of claim 1, the lip further comprising a rear lip surface generally parallel to the rear surface, wherein when the accessory device is coupled to the back plate rear wall and the dispenser is mounted to the generally vertical surface the rear lip surface is juxtaposed with the generally vertical surface.

9. The accessory device of claim 1, further comprising a chamfer at the intersection of the front surface and the outer surface.

10. The accessory device of claim 1, wherein the lip has a width greater than the lip thickness.

11. A wall-mounted dispenser system, comprising:

a dispenser configured to mount to a generally vertical surface and including:

a back housing including a back plate rear wall wherein the back plate rear wall is parallel to and juxtaposed with the generally vertical surface when the dispenser is mounted to the generally vertical surface; and a cover pivotally coupled to a bottom of the back housing such that the cover automatically rotates outward and downward from the generally vertical surface to an open position when the dispenser is mounted to the generally vertical surface, wherein the cover in a closed position has a perimeter edge proximate to the generally vertical surface, the perimeter edge including a cover top edge interposed between and continuous with a cover left side edge and a cover right side edge, the back plate rear wall further comprising a back plate rear wall extension extending past the cover top edge, a portion of the cover left side edge and a portion of the cover right side edge when the cover is in the closed position, the back plate rear wall extension having a top extension edge, a left extension edge, and a right extension edge; and an accessory device coupled to the back plate rear wall extension and comprising:

a plate having a front surface and a rear surface, wherein a thickness of the plate is a distance between the front surface and the rear surface, wherein the accessory device is coupled to the back plate rear wall extension such that the rear surface is juxtaposed with a front surface of the back plate rear wall extension; and a lip extending rearward from a portion of a perimeter of the plate, the lip providing an additional thickness equal to a thickness of the back plate rear wall extension, whereby the lip covers the top extension edge, the left extension edge, and the right extension edge, the plate further having an underside surface generally normal to the front surface and rear surface, the plate further having an outer surface generally normal to the front surface and the rear surface and excluding the underside surface, wherein the underside surface is shaped to generally match the cover top edge, a portion of the cover left side edge proximate to the cover top edge, and a portion of the cover right side edge proximate to the cover top edge, whereby when the dispenser is mounted to the generally vertical surface and in the closed position, a first gap exists between the underside surface and the cover top edge, a second gap exists between the underside surface and the cover left side edge, a third gap exists between the underside surface and the cover right side edge, wherein each gap is configured such that the dispenser is able to be opened and closed when the dispenser is mounted to the generally vertical surface, whereby lodging of ligation material between the accessory device and the dispenser is prevented when the dispenser system is mounted to the vertical surface.

12. The wall-mounted dispenser system of claim 11, wherein the plate thickness is at least 5 mm (0.20 inches).

13. The wall-mounted dispenser system of claim 11, further comprising a plurality of fastener holes through the plate thickness.

14. The wall-mounted dispenser system of claim 11, further comprising a normal distance between the underside surface and the outer surface of at least 13 mm.

15. The wall-mounted dispenser system of claim 11, wherein the first gap is no more than 2.5 mm (0.1 inches).

16. The wall-mounted dispenser system of claim 11, wherein the underside surfaces matching the portion of the cover left side edge and the portion of the cover right side edge are each at least 15 mm (0.6 inches) long.

17. The wall-mounted dispenser system of claim 11, wherein the second gap and the third gap are configured to prevent opening of the dispenser when the dispenser is mounted to the generally vertical surface, the dispenser is closed and locked, and a lateral blow is applied to the dispenser.

18. The wall-mounted dispenser system of claim 11, the lip further comprising a rear lip surface generally parallel to the rear surface, wherein when the dispenser is mounted to the generally vertical surface the rear lip surface is juxtaposed with the generally vertical surface.

19. The wall-mounted dispenser system of claim 11, the accessory device further comprising a chamfer at the intersection of the front surface and the outer surface.

20. The wall-mounted dispenser system of claim 11, wherein the lip has a width greater than the lip thickness.

* * * * *